US009951444B2

(12) United States Patent
Dzenis

(10) Patent No.: US 9,951,444 B2
(45) Date of Patent: Apr. 24, 2018

(54) METHOD OF FABRICATING A CONTINUOUS NANOFIBER

(71) Applicant: NUtech Ventures, Lincoln, NE (US)

(72) Inventor: Yuris Dzenis, Lincoln, NE (US)

(73) Assignee: NUtech Ventures, Lincoln, NE (US)

( * ) Notice: Subject to any disclaimer, the term of this patent is extended or adjusted under 35 U.S.C. 154(b) by 980 days.

(21) Appl. No.: 14/104,930

(22) Filed: Dec. 12, 2013

(65) Prior Publication Data

US 2014/0162063 A1 Jun. 12, 2014

Related U.S. Application Data

(60) Provisional application No. 61/736,044, filed on Dec. 12, 2012, provisional application No. 61/736,638, filed on Dec. 13, 2012.

(51) Int. Cl.

| | |
|---|---|
| ***D01F 1/10*** | (2006.01) |
| ***D01F 6/18*** | (2006.01) |
| ***D01D 5/00*** | (2006.01) |
| ***D01D 10/02*** | (2006.01) |
| ***D01D 1/02*** | (2006.01) |
| ***D01F 1/02*** | (2006.01) |

(52) U.S. Cl.

CPC ..... *D01F 6/18* (2013.01); *D01D 1/02* (2013.01); *D01D 5/003* (2013.01); *D01D 5/0038* (2013.01); *D01D 5/0046* (2013.01); *D01D 5/0092* (2013.01); *D01D 10/02* (2013.01); *D01F 1/02* (2013.01); *Y10T 428/298* (2015.01)

(58) Field of Classification Search

CPC ..... D01D 1/02; D01D 5/003; D01D 5/0038; D01D 5/0046; D01D 10/02; D02J 13/02

USPC ..... 264/103, 211.15, 211.17, 232, 234, 464, 264/465, 466, 484, 494

See application file for complete search history.

(56) References Cited

U.S. PATENT DOCUMENTS

| | | | | |
|---|---|---|---|---|
| 8,066,932 | B2 | 11/2011 | Xu | |
| 8,435,628 | B2 | 5/2013 | Tsotsis | |
| 2002/0020509 | A1* | 2/2002 | Yanai | D06M 11/05 162/9 |

(Continued)

OTHER PUBLICATIONS

Bashir et al., "Orientation Studies in Polyacrylonitrile Films Uniaxially Drawn in the Solid State," *Polym. Int.*, 1994, 33(1):9-17.

(Continued)

*Primary Examiner* — Leo B Tentoni
(74) *Attorney, Agent, or Firm* — Fish & Richardson P.C.

(57) ABSTRACT

A method of fabricating a continuous nanofiber is described. The method includes preparing a solution of one or more polymers and one or more solvents and electrospinning the solution by discharging the solution through one or more liquid jets into an electric field to yield one or more continuous nanofibers. The electrospinning process (i) highly orients one or more polymer chains in the one or more continuous nanofibers along a fiber axis of the one or more continuous nanofibers, and (ii) suppresses polymer crystallization in the one or more continuous nanofibers. The one or more continuous nanofibers can have diameters below about 250 nanometers and exhibit an increase in fiber strength and modulus while maintaining strain at failure, resulting in an increase in fiber toughness.

15 Claims, 43 Drawing Sheets

(56) References Cited

U.S. PATENT DOCUMENTS

| | | | | |
|---|---|---|---|---|
| 2007/0038290 | A1* | 2/2007 | Huang | A61F 2/90 623/1.16 |
| 2007/0082197 | A1 | 4/2007 | Ko et al. | |
| 2007/0228612 | A1 | 10/2007 | Durst et al. | |
| 2009/0326128 | A1* | 12/2009 | Macossay-Torres | D01D 5/0038 264/465 X |
| 2011/0151737 | A1* | 6/2011 | Moore | D04H 1/4291 442/334 |
| 2011/0236974 | A1* | 9/2011 | Ogle | B82Y 5/00 264/465 X |
| 2011/0242310 | A1* | 10/2011 | Beebe, Jr. | D01D 5/0069 264/484 X |

OTHER PUBLICATIONS

Bennet and Johnson, "Structural Heterogeneity in Carbon Fibres," *Proc. 5th London Carbon and Graphite Conf;* Society of Chemical Industry, 1978, 1:377-386.

Bhattacharyya et al., "Crystallization and Orientation Studies in Polypropylene/Single Wall Carbon Nanotube Composite Fibers," *Polymer,* 2007, 48:3781-3789.

Bunsell et al., *Fibre Reinforcements for Composite Materials,* Composite Materials, 1988, 2:537.

Cancado et al., "General Equation of the Determination of the Crystallite Size L[sub a] of Nanographite by Raman Spectroscopy," *Appl Phys Lett,* 2006, 88:163106.

Chae et al., "Stabilization and Carbonization of the Gel Spun Polyacrylonitrile/Single Wall Carbon Nanotube Composite Fibers," *Polymer,* 2007, 48:3781-3789.

Chen et al., "Fabrication and Structural Characterization of Polyacrylonitrile and Carbon Nanofibers Containing Plasma-Modified Carbon Nanotubes by Electrospinning," *J. Phys. Chem,* 2010, 114:13532-13539.

Chew et al., "Mechanical Properties of Single Electrospun Drug-Encapsulated Nanofibers," *Nanotechnology,* 2006, 17:3880.

Chou et al., An Assessment of the Science and Technology of Carbon Nanotube-based Fibers and Composites, *Composites Sci. Technol.,* 2010, 70:1-19.

Compton and Nguyen, "Graphene Oxide, Highly Reduced Graphene Oxide and Graphene: Versatile Building Blocks for Carbon-Based Materials," Small, 2010, 6:711-723.

Damodaran et al., "Chemical and Physical Aspects of the Formation of Carbon Fibres from PAN-based Precursors," *Journal of The Textile Institute,* 1990, 81:384-420.

Dzenis and Wen, "Continuous Carbon Nanofibers for Nanofiber Composites," *Mat. Res. Soc. Symp. Proc.,* 2002, 702:173-178.

Dzenis, "Spinning Continuous Fibers for Nanotechnology," *Science,* 2004, 304:1917-1919.

Dzenis, "Structural Nanocomposites," *Science,* 2008, 319:419-420.

Ferrari and Robertson, "Interpretation of Raman Spectra of Disordered and Amorphous Carbon," *Phys. Rev. B,* May 15, 2000, 61(20):14095-14107.

Ferrari, "Raman Spectroscopy of Graphene and Graphite: Disorder, electron-phonon coupling, doping and nonadiabatic effects," *Solid State Commun.,* 2007, 143:47-57.

Fitzer, "Pan-based Carbon Fibers—Present State and Trend of the Technology from the Viewpoint of Possibilities and Limits to Influence and to Control the Fiber Properties by the Process Parameters," *Carbon,* 1989, 27:621-645.

Fratzl, "Cellulose and Collagen: from Fibres to Tissues," *Curr. Opin. Colloid Interface Sci.,* 2003, 8:32-39.

Greiner and Wendorff, "Electrospinning: A Fascinating Method for the Preparation of Ultrathin Fibers," *Angewandte Chemie International Edition,* 2007, 46:5670-5703.

Griffith, "The Phenomena of Rupture and Flow in Solids," *Philos. Trans. R. Soc.,* 1921, 221:163-198.

Henrici-Olive and Olive, "The Chemistry of Carbon Fiber Formation from Polyacrylonitrile," 1983, 51:1-60.

Hou et al., "Electrospun Polyacrylonitrile Nanofibers Containing a High Concentration of Well-Aligned Multiwall Carbon Nanotubes," *Chemistry of Materials,* 2005, 17:967-973.

Inagaki et al., "Carbon Nanofibers Prepared via Electrospinning," *Adv. Mater,* 2012, 24:2547-2566.

Jain and Abhiraman, "Conversion of Acrylonitril-based Precursor Fibres to Carbon Fibres," *J. Mater. Sci.,* 1987, 22:278-300.

Jain et al., "Conversion of acrylonitrile-based precursors to carbon fibres," *Journal of Materials Science,* 1987, 22:301-312.

Kakade et al., "Electric Field Induced Orientation of Polymer Chains in Macroscopically Aligned Electrospun Polymer Nanofibers," *J. Am. Chem. Soc.,* 2007, 129:2777-2782.

Knight and White, "Characterization of Diamond Films by Raman Spectoscopy," *J. Mater Res,* 1989, 4:385-393.

Ko et al., "Electrospinning of Continuous Carbon Nanotube-Filled Nanofiber Yarns," *Adv Mater,* 2003, 15:1161-1165.

Kongkhlang et al., "Electrospinning as a New Technique to Control the Crystal Morphology and Molecular Orientation of Polyoxymetylene Nanofibers," *J. Am. Chem. Soc.,* 2008, 130:15460-15466.

Kovtyukhova et al., "Layer-by-Layer Assembly of Ultrathin Composite Films from Micron-Sized Graphite Oxide Sheets of Polycations," *Chem Mater,* 1999, 11:771-778.

Kurban et al., "Turbostatic Graphite Nanofibres from Electrospun Solutions of PAN in Dimethylsulphoxide," *European Polymer Journal,* 2010, 46:1194-1202.

Laudenslager et al., "Electrospun Materials for Energy Harvesting, Conversion, and Storage: A Review," *Pure Appl. Chem.,* 2010, 82(11):2137-2156.

Lim et al., "Effects of Crystalline Morphology on the Tensile Properties of Electrospun Polymer Nanofibers," *Appl. Phys. Lett.,* 2008, 92:141908-141908-3.

Luo et al., "Compression and Aggregation-Resistant Particles of Crumpled Soft Sheets," *ACS Nano,* 2011, 5(11):8943-8949.

Ma et al., "Crumpled Nanopaper from Graphene Oxide," *Nano Lett.,* 2012, 12:486-489.

Mack et al., "Graphite Nanoplatelet Reinforcement of Electrospun Polyacrylonitrile Nanofibers," *Adv Mater,* 2005, 17:77-80.

Maitra et al., "Improved Graphitization and Electrical Conductivity of Suspended Carbon Nanofibers Derived From Carbon Nanotube/Polyacrylonitrile Composites by Directed Electrospinning," *Carbon,* 2012, 50:1753-1761.

Miaudet et al., "Hot-Drawing of Single and Multiwall Carbon Nanotube Fibers for High Toughness and Alignment," *Nano Lett.,* 2005, 5:2212-2215.

Motta et al., "High Performance Fibres from 'Dog Bond' Carbon Nanotubes," *Adv. Mater.,* 2007, 19:3721-3726.

Naraghi et al., "A Multiscale Study of High Performance Double-Walled Nanotube—Polymer Fibers," *ACS Nano,* 2010, 4:6463-6476.

Naraghi et al., "Mechanical Deformation and Failure of Electrospun Polyacrylonitrile Nanofibers as a Function of Strain Rate," *Appl. Phys. Lett.,* 2007, 91:151901-151903.

Narahgi et al., "Molecular Orientation and Mechanical Property Size Effects in Electrospun Polycrylonitrile Nanofibers," *Polymer,* 2011, 52:1612-1618.

Pai et al., "Mechanical Properties of Individual Electrospun PA 6(3)T Fibers and their Variation with Fiber Diameter," *Polymer,* 2011, 52:2295-2301.

Park et al., "Effects of Electrospun Polyacrylonitril-Based Carbon Nanofibers As Catalyst Support in PEMFC," *J. Appl. Electrochemistry,* 2009, 39:1229-1236.

Potts et al., "Graphene-based Polymer Nanocomposites," *Polymer,* 2011, 52:5-25.

Prilutsky et al., "Carbonization of Electrospun Poly(acrylonitrile) Nanofibers Containing Multiwalled Carbon Nanotubes Observed by Transmission Electron Microscope with the Situ Heating," *Journal of Polymer Science Part B: Polymer Physics,* 2010, 48:2121-2128.

Prilutsky et al., "The Effect of Embedded Carbon Nanotubes on the Morphological Evolution During the Carbonization of Poly(acrylonitrile) Nanofibers," *Nanotechnology,* 2008, 19:165603.

Putthanarat et al., "Investigation of the Nanofibrils of Silk Fibers," *Polymer,* 2000, 41:7735-7747.

(56) References Cited

OTHER PUBLICATIONS

Rafiee et al., "Enhanced Mechanical Properties of Nanocomposites at Low Graphene Content," *ACS Nano,* 2009, 3(12):3884-3890.
Rafique et al., "Fabricaton of Ultrathin and Aligned Carbon Nanofibres from Electrospun Polyacrylonitrile Nanofibres," *Bull. Mater. Sci.,* Oct. 2010, 33(5):553-559.
Ramanathan et al., "Functionalized Graphene Sheets for Polymer Nanocomposites," *Nat Nano,* Jun. 2008, 3:327-331.
Ruoff, "A means to an end: Exploring graphene's chemical properties reveals a world of potential away from the purely tow-dimensional," *Nature,* Mar. 15, 2012, 483:S42-S42.
Sawai et al., "Development of Oriented Morphology and Tensile Properties upon Superdawing of Solution-Spun Fibers of Ultra-High Molecular Weight Poly(acrylonitrile)," *Polymer,* 2006, 47:4445-4453.
Sen et al., "Preparation of Single-Walled Carbon Nanotube Reinforced Polystyrene and Polyurethane Nanofibers and Membranes by Electrospinning," *Nano Lett.,* 2004, 4(3):459-464.
Shin et al., "Size-Dependent Elastic Modulus of Single Electroactive Polymer Nanofibers," *Appl. Phys. Lett.,* 2006, 89:231929-3.
Tan and Lim, "Physical Properties of a Single Polymeric Nanofiber," *Appl. Phys. Lett.,* 2004, 84:1603-1605.
Tran et al., "Carbon Nanofibers and Carbon Nanotubes in Regenerative Medicine," *Adv. Drug Deliv. Rev.,* 2009, 61:1097-1114.
Tuinstra and Koenig, "Characterization of Graphite Fiber Surfaces with Raman Spectroscopy," *J. Comp Mater,* 1970, 4:492-499.
Tyson, "Fracture mechanisms in carbon fibres derived from PAN in the temperature range 1000-2800 °C.," *J. Phys. D: Appl. Phys.,* 1975, 8:749-758.
Vaisman et al., "Polymer-Nanoinclusion Interactions in Carbon Nanotube Based Polyacrylonitrile Extruded and Electrospun Fibers," *Polymer,* 2007, 48:6843-6854.
Vaisman et al., "Processing and Characterization of Extruded Drawn MWNT-PAN Composite Filaments," *Composites Part A,* 2007, 38:1354-1362.
Viculis et al., "A Chemical Route to Carbon Nanoscrolls," *Science,* Feb. 2003, 299:1361.
Vollrath and Knight, "Liquid Crystalline Spinning of Spider Silk," *Nature,* Mar. 29, 2001, 410:541-548.
Watt et al., "High-Strength High-Modulus Carbon Fibers," *The Engineer,* May 27, 1966, 221:815-816.
Wong et al., Effect of Fiber Diameter on Tensile Properties of Electrospun Poly(ϵ-caprolactone), *Polymer,* 2008, 49:4713-4722.
Wu et al., "Modeling of Solvent Evaporation from Polymer Jets in Electrospinning," *Appl. Phys. Lett.,* 2011, 98:223108.
Xu and Buehler, "Geometry Controls Conformation of Graphene Sheets: Membranes, Ribbons, and Scrolls," *ACS Nano,* 2010, 4(7):3869-3876.
Zhang et al., "Multifunctional Carbon Nanotube Yarns by Downsizing an Ancient technology," *Science,* 2004, 306:1358-1361.
Zhao et al., "Ultrasonic Technique for Extracting Nanofibers from Nature Materials," *Appl. Phys. Lett.,* 2007, 90:073112-073112-2.
Zong et al., "Structure and Process Relationship of Electrospun Bioabsorbable Nanofiber Membranes," Polymer, 2002, 43:4403-4412.
Arinstein et al., "Effect of Supramolecular Structure on Polymer Nanofibre Elasticity," Nat. Nanotechnol., 2007, 2:59-62.
Chen et al., "Electrospinning Fabricaton of High Strength and Toughness Polyimide Nanofiber Mambranes Containing Multiwalled Carbon Nanotubes," J. Phys. Chem. B, 2009, 113:9741-9748.
Dalton et al., "Super-Tough Carbon-Nanotube Fibres," Nature, 2003, 423:703.
Huang, "Fabrication and Properties of Carbon Fibers," Materials, 2009, 2:2369-2403.
Miao et al., "Electrospinning of Nanomaterials and Applications in Electronic Components and Devices," J. Nanosci. Nanotechnol., 2010, 10:5507-5519.
Papkov et al., "Simultaneously Strong and Tough Ultrafine Continuous Nanofibers," Structure and Mechanical Properties of Continuous Polymer and Carbon Nanofibers, MRS Fall Technology Meeting, Nov. 2011.
Rafiee et al., "Fracture and Fatigue in Graphene Nanocomposites," Small, 2010, 6:179-183.
Reich and Thomsen, "Raman Spectroscopy of Graphite," *Philosophical Transactions of the Royal Society of London, Series A: Mathematical, Physical and Engineering Sciences,* 2004, 362:2271-2288.
Ritchie, "The Conflicts between Strength and Toughness," *Nat. Mater.,* 2011, 10:817-822.
Srivastava, "Predictions of Enhanced Chemical Reactivity at Regions of Local Conformational Strain on Carbon Nanotubes: Kinky Chemistry," *J Phys Chem B* 1999, 103:4330-4337.
Stankovich et al., "Graphene-based Composite Materials," *Nature,* 2006, 442:282-286.
Zhu and Liao, "Nanostructured Metals: Retaining Ductility," Nat. Mater., 2004, 3:351-352.

* cited by examiner

400

402

| Nanofiber Family | Modulus | | Toughness | |
|---|---|---|---|---|
| | R | $R^2$ | R | $R^2$ |
| As-spun | 0.81 | 0.65 | 0.91 | 0.82 |
| Annealed | 0.87 | 0.76 | 0.88 | 0.77 |

FIG. 4

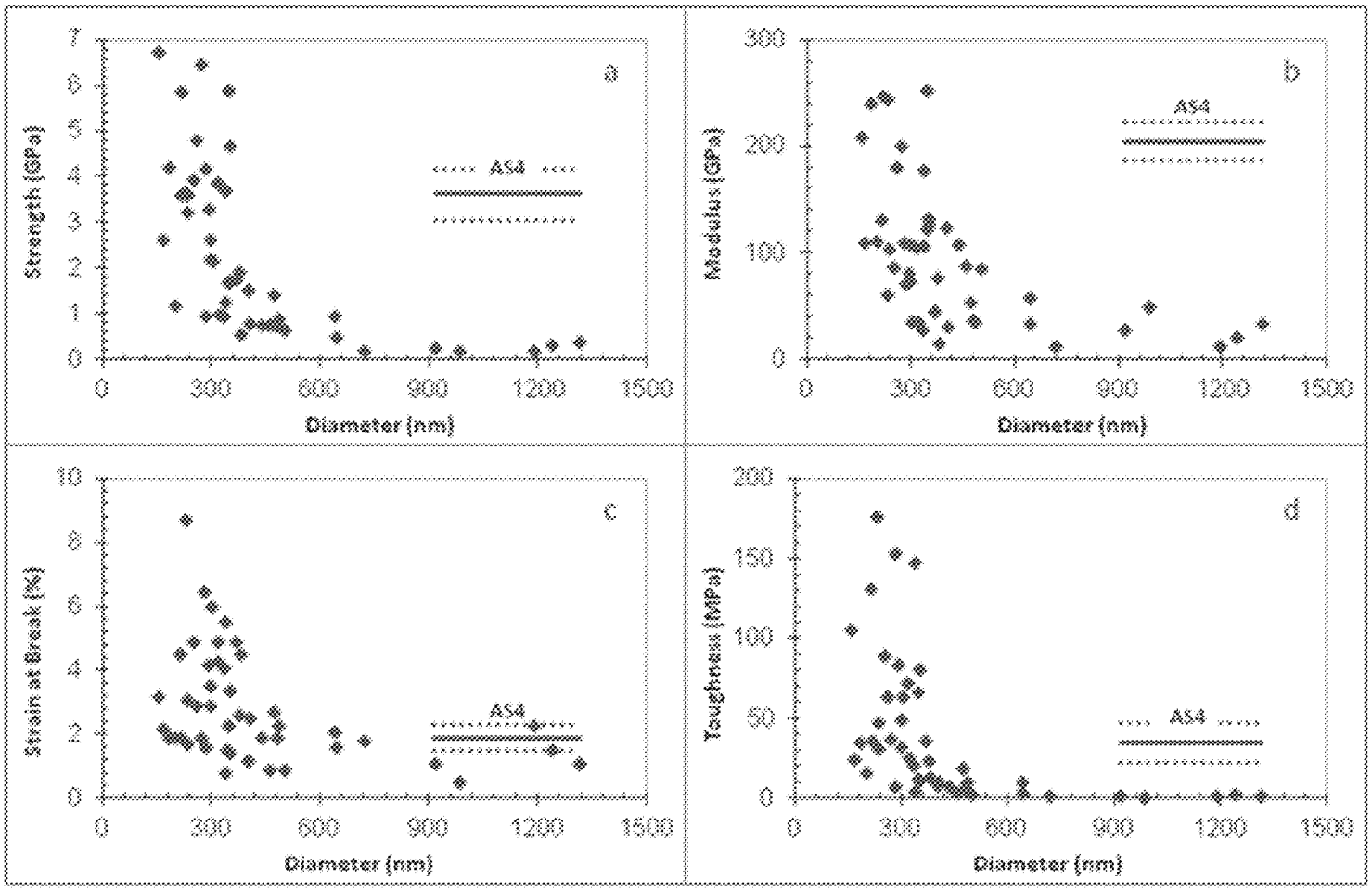
FIG. 9A-D

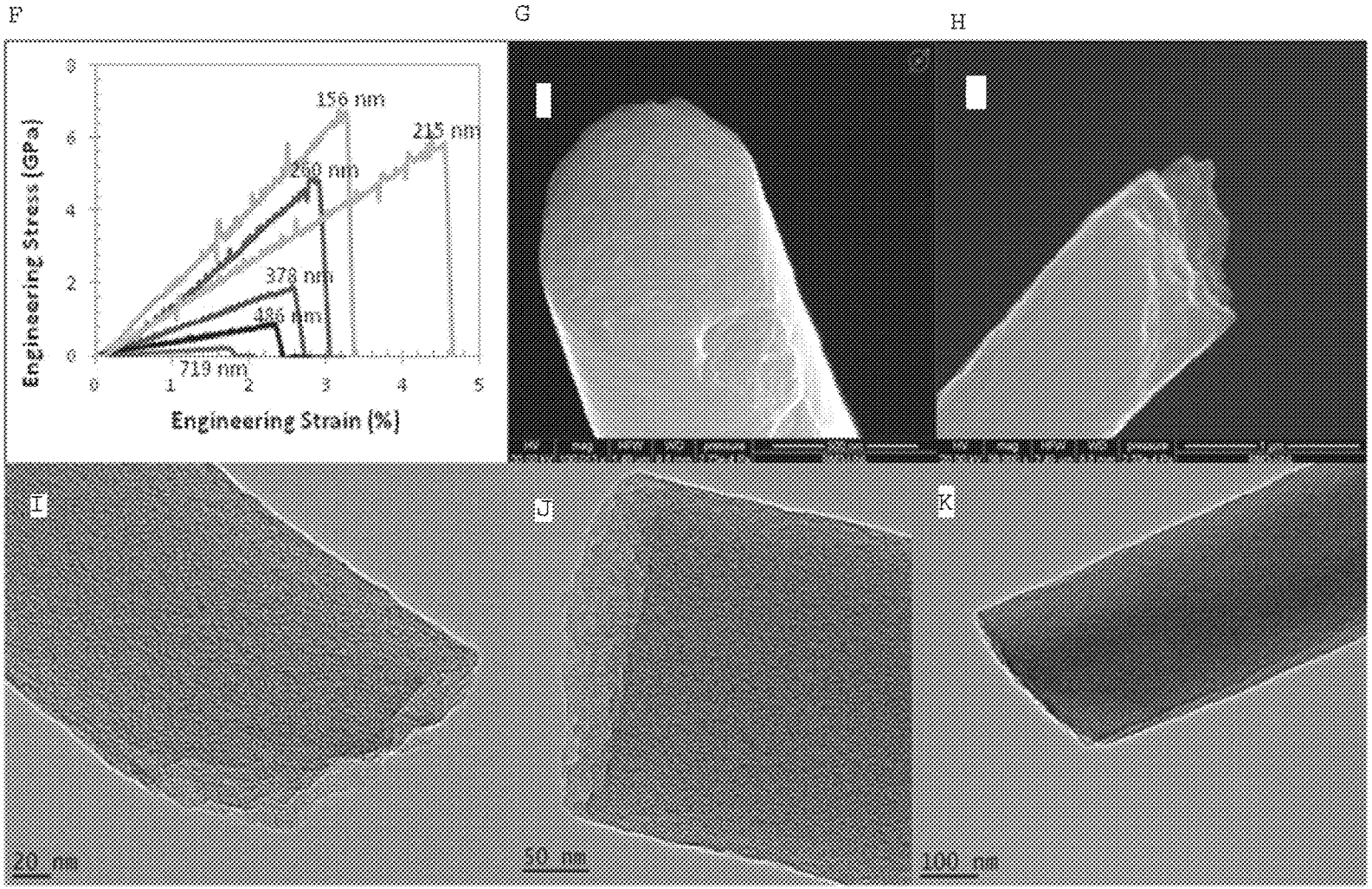
FIG. 9F-K

| Sample | | XRD | | Raman | | |
|---|---|---|---|---|---|---|
| | | $L_c$ (Å) | $L_a$ (Å) | $I_D/I_G$ | FWHM G band | $L_a$ (nm) |
| Current Study | 8% | 13.7 | | 2.9±0.1 | 103±3.7 | 1.51±0.05 |
| | 10% | 15.3 | | 2.9±0.2 | 109±3.0 | 1.31±0.08 |
| | 12% | 4.7 | | 3.5±0.1 | 113±1.8 | 1.27±0.04 |
| AS4 | | 15.8 | 40.8 | 2.2±0.09 | 102±2.4 | 2.0±0.08 |
| T310J/epoxy | | 19.6 | 54.3 | | | |
| T300* | | 15 | 37 | 1.76 | | 2.5 |
| G 30/500* | | | | 1.81 | | 2.4 |
| G 40/700* | | 24 | 49 | 1.49 | | 2.95 |

FIG. 9L

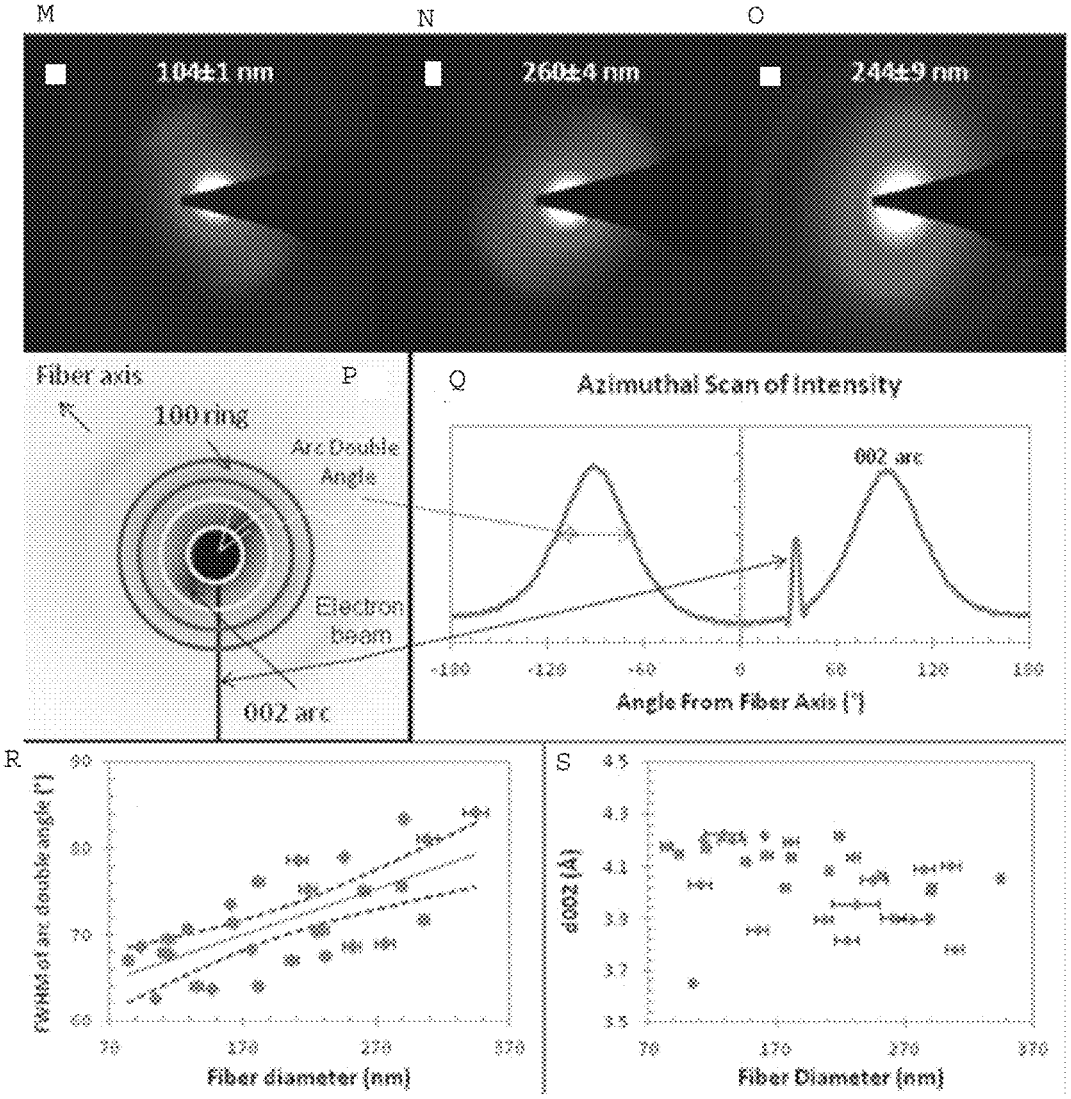
FIG. 9M-S

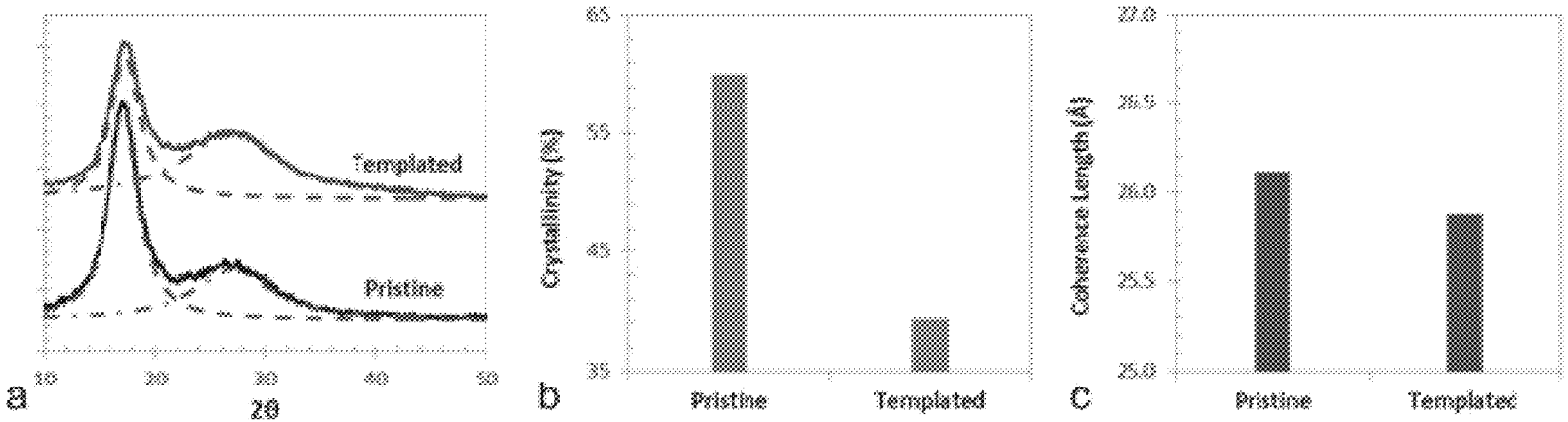
FIG. 10A-C

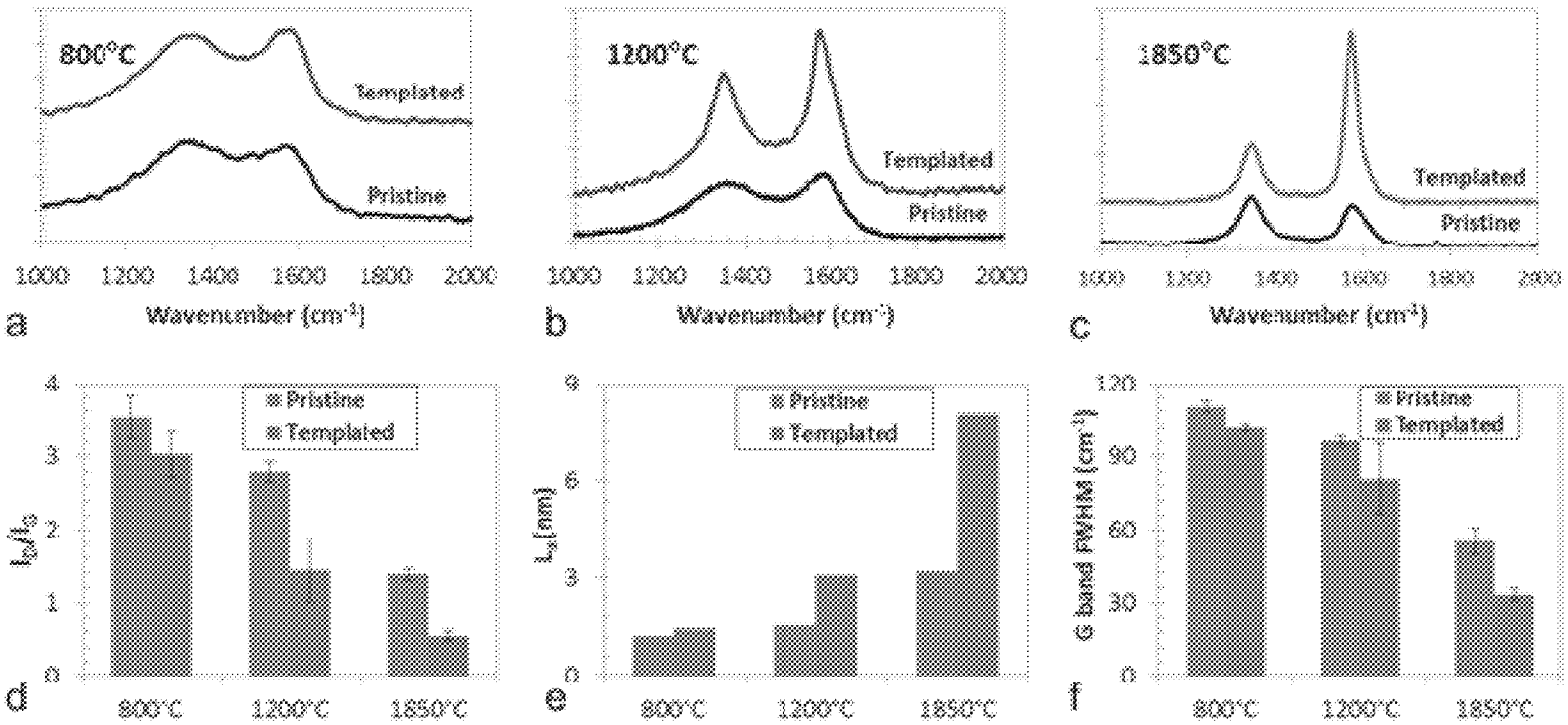
FIG. 11A-F

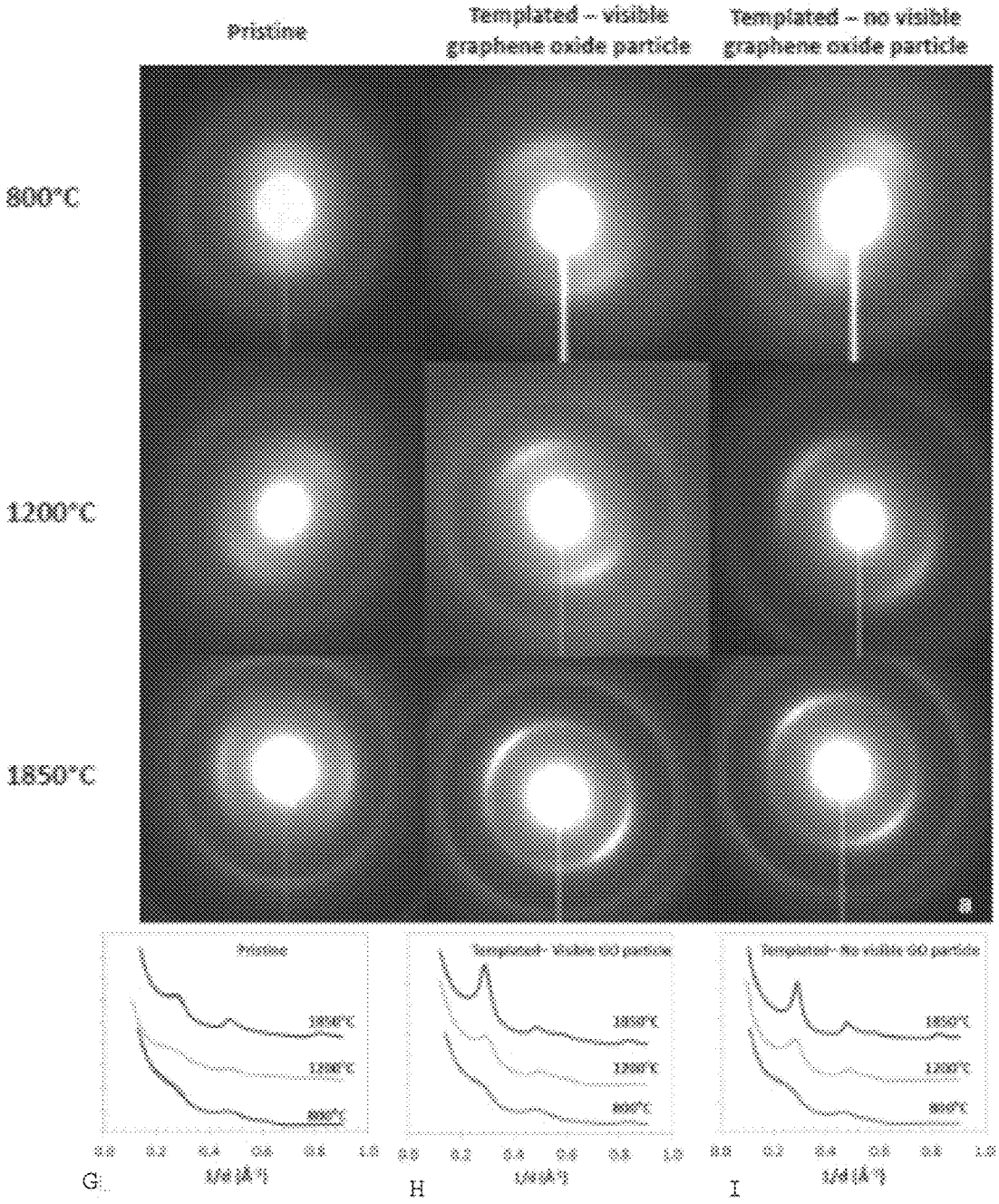
FIG. 11G-I

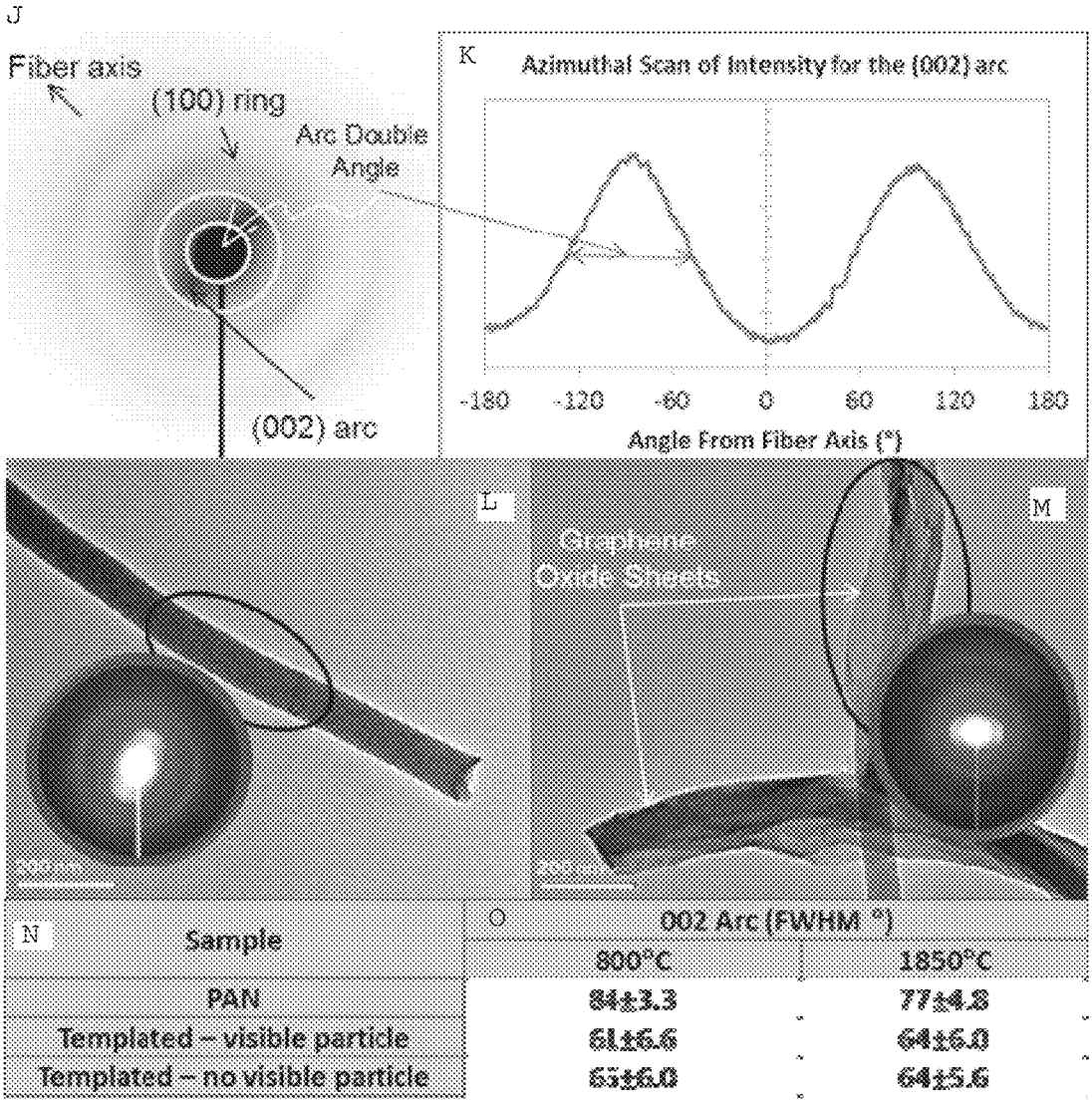
| Sample | 002 Arc (FWHM °) | |
|---|---|---|
| | 800°C | 1850°C |
| PAN | 84±3.3 | 77±4.8 |
| Templated – visible particle | 61±6.6 | 64±6.0 |
| Templated – no visible particle | 65±6.0 | 64±5.6 |
FIG. 11J-O

| Sample | XRD | | | Raman | | |
|---|---|---|---|---|---|---|
| | $L_c$ (Å) | $L_a$ (Å) | $d_{002}$ (Å) | $I_D/I_G$ | FWHM G band | $L_a$ (Å) |
| Pristine PAN | 10.0 | 16.3 | 3.53 | 3.53±0.29 | 110.1±2.5 | 12.5 |
| 1.2% DWNT | 10.6 | 28.9 | 3.55 | 1.76±0.73 | 49.1±5.4 | 25 |

FIG. 15

METHOD OF FABRICATING A CONTINUOUS NANOFIBER

CROSS-REFERENCE TO RELATED APPLICATIONS

This application claims priority under 35 U.S.C. § 119(e) (1), to U.S. Provisional Application Ser. No. 61/736,044, filed on Dec. 12, 2012, and U.S. Provisional Application Ser. No. 61/736,638, filed on Dec. 13, 2012, the entire contents of which are incorporated herein.

STATEMENT AS TO FEDERALLY SPONSORED RESEARCH

This invention was made with government support under 0709333, 0600675/0600733, 11400650, FA9550-11-1-0204, and W911NF-09-1-0541 awarded by National Science Foundation, Air Force Office of Scientific Research and Army Research Office. The government has certain rights in this invention.

TECHNICAL FIELD

This disclosure relates to continuous nanoscale structures and fibers that exhibit improved mechanical properties, and methods for their production.

BACKGROUND

Synthetic fibers are typically manufactured to attain a particular level of performance depending on the intended use of the resulting fibers. Since synthetic fibers are generally manufactured from synthetic polymers or small molecules, the mechanical properties of these fibers may depend on the properties of the polymers or molecules used and the methods used to manufacture the fibers.

For example, the strength of a typical fiber generally increases with a decrease in the diameter of the fiber. Examples fibers that may exhibit this phenomenon can include whiskers, polymer, carbon, glass, and ceramic fibers. The mechanism that may cause the increase in strength varies, but can include improvements in material structure and orientation as well as a reduction in the size and/or quantity of defects in the material structure. As a result, advanced fiber manufacturers usually adopt the smallest fiber diameter that is technologically and economically feasible. However, all existing advanced (structural) fibers are brittle—i.e. they break at small failure strains, thus absorbing relatively low energy to failure. In addition, fibers prepared by conventional mechanical spinning techniques are limited in diameter range. The latest generation of carbon fiber, the smallest commercially available continuous fiber today, has diameter about 4.5 micrometers. A fiber that is simultaneously strong, stiff, and tough may be beneficial for most structural applications, especially so for safety critical applications.

SUMMARY

Strong, stiff, and tough electrospun nanofibers and processes of generating such fibers are described. In particular, ultrafine as-spun PAN nanofibers are shown to exhibit extraordinary simultaneous strength, modulus, and toughness. Structural analysis and experiments on annealed nanofibers suggest that low crystallinity in electrospun nanofibers may be responsible for the exceptionally high nanofiber ductility and toughness while high polymer chain orientation gives rise to high strength and modulus. Several other polymer systems and carbon exhibited similar behavior.

In one implementation, a method of fabricating a continuous nanofiber is provided. The method includes preparing a solution of one or more polymers and one or more solvents and electrospinning the solution. Electrospinning the solution can include discharging the solution through one or more liquid jets into an electric field to yield one or more continuous nanofibers. The electrospinning can (i) highly orient one or more polymer chains in the one or more continuous nanofibers along a fiber axis of the one or more continuous nanofibers, and (ii) suppress polymer crystallization in the one or more continuous nanofibers. The one or more continuous nanofibers can have diameters below about 250 nanometers and exhibit an increase in fiber strength and modulus while maintaining strain at failure, resulting in an increase in fiber toughness. In certain embodiments, the diameter of the one or more continuous nanofibers is about 5 nanometers to about 50 nanometers. In certain embodiments, the diameter of the one or more continuous nanofibers is based at least in part on an applied electric field strength of about 10 kilovolts to about 12 kilovolts over the spinning distance of about 5 centimeters to about 40 centimeters.

In certain embodiments, the method also includes applying one or more of heat, ultraviolet radiation, or a chemical reagent to the one or more continuous nanofibers resulting in an additional increase in fiber modulus, strength, or toughness for the one or more continuous nanofibers.

In certain embodiments of the method of fabricating a continuous nanofiber further includes performing a liquid soaking of the one or more continuous nanofibers, the liquid soaking resulting in a disruption of crystallization. In certain embodiments, highly orienting the one or more polymer chains includes decreasing a diameter of one or more of the continuous nanofibers by introducing, during the electrospinning process, one or more jet instabilities to one or more of the liquid jets using mechanical or electromagnetic perturbations. In certain embodiments, highly orienting the one or more polymer chains includes decreasing a diameter of one or more of the continuous nanofibers by stretching one or more of the continuous nanofibers during or after performing the electrospinning.

In certain embodiments of the method, the increase in fiber true strength includes an increase to about 1750 MPa and the increase in fiber toughness includes an increase to about 600 MPa. In certain embodiments of the method, the increase in fiber true strength includes an increase to about 6500 MPa and the increase in fiber toughness includes an increase to about 2200 MPa. In certain embodiments of the method, the increase in fiber true strength comprises an increase to about 12500 MPa and the increase in fiber toughness comprises an increase to about 2500 MPa.

In certain embodiments, the method includes suppressing polymer crystallization which includes disrupting formation of one or more intermolecular bonds during the electrospinning process by using a solvent interacting with polymer molecules, including in the solution one or more additives, or by altering molecular structure of the polymer using atactic sequences or side groups resulting in suppressing polymer crystallization in the one or more continuous nanofibers. In other embodiments, suppressing polymer crystallization is further achieved by fast solvent evaporation and/or through confining polymer in ultrafine nanofibers with high fraction of molecular chains being at or near the surface.

In certain embodiments of the method, the polymer is selected from the group consisting of polyacrilonitrile (PAN), flexible chain polymers, rigid chain polymers, semi-flexible chain polymers, liquid crystalline polymers, polyester, polyamide 6, nylon 66, Nomex, semi-crystalline polymers, Polyaramid, Kevlar, PBO, PBI, M5, polyimide, soluble polyimide, thermoplastic or thermoset polymers, precursors for carbon or ceramic fibers, natural biopolymers, proteins, collagen, DNA, silk, recombinant silk, biocompatible synthetic polymers, biodegradable polymers, hybrid biological polymers, and hybrid biological-synthetic polymers.

In certain embodiments, the one or more continuous nanofibers is adapted to form a sheet, a membrane, a yarn, a fabric, a two dimensional assembly or array, a three dimensional assembly or array, or a coating.

In one implementation, a continuous nanofiber for use in composites is prepared by a process including the steps of electrospinning a polymeric solution, the electrospinning comprising discharging, through one or more jets, the polymeric solution through an electric field to yield one or more fibers, and suppressing, during the electrospinning, crystal formation to obtain one or more continuous nanofibers having a diameter of below about 250 nanometers, the one or more continuous nanofibers exhibiting a toughness of about 500 MPa to about 600 MPa and a true strength of about 1500 MPa to about 1700 MPa.

In certain embodiments, process steps for preparing the continuous nanofiber further include highly orienting one or more polymer chains by decreasing a diameter of one or more of the continuous nanofibers by introducing, during the electrospinning process, one or more jet instabilities using mechanical or electromagnetic perturbations. In certain embodiments, process steps for preparing the continuous nanofiber further include highly orienting one or more polymer chains to decrease a diameter of one or more of the continuous nanofibers by stretching one or more of the continuous nanofibers during or after performing the electrospinning.

In certain embodiments, suppressing crystal formation includes performing (a) polymer solidification of the fibers and (b) an evaporation of a solvent in the polymeric solution, to yield one or more continuous nanofibers.

In one implementation, a continuous nanofiber, composed essentially of polymer and generated in an electrospinning process includes an average diameter ranging from about 50 nanometers to about 100 nanometers, wherein the nanofiber has strength of about 1550 MPa to about 1750 MPa and a toughness of about 500 MPa to about 600 MPa. In certain embodiments, the continuous nanofiber includes a nanoreinforcement adapted to form a composite, an adhesive, a nanoreinforced interlaminar or fiber-matrix interface, or a nano-Velcro bond. In certain embodiments, the continuous nanofiber is adapted to form a sheet, a membrane, a yarn, a two dimensional assembly, a three dimensional assembly, or a coating. In certain embodiments, the diameter of the one or more continuous nanofibers is about 50 nanometers.

Advantageously, the described systems and techniques may provide for one or more benefits, such as providing high molecular orientation in nanofibers to ensure improved optical, mechanical, transport, and electronic properties.

The details of one or more implementations are set forth in the accompanying drawings and the description below. Other features, objects, and advantages will be apparent from the description and drawings, and from the claims.

DESCRIPTION OF DRAWINGS

FIG. 4 illustrates a table depicting correlation of mechanical properties of nanofibers.

FIGS. 10A-C illustrate example analysis of as-spun nanofibers with graphene oxide nanoparticles.

FIGS. 11A-O illustrate example structural analysis of carbon nanofibers with graphene oxide nanoparticles.

FIG. 15 illustrates a summary of crystal properties extracted from XRD and Raman spectra.

Like reference symbols in the various drawings indicate like elements.

DETAILED DESCRIPTION

Figure 1:
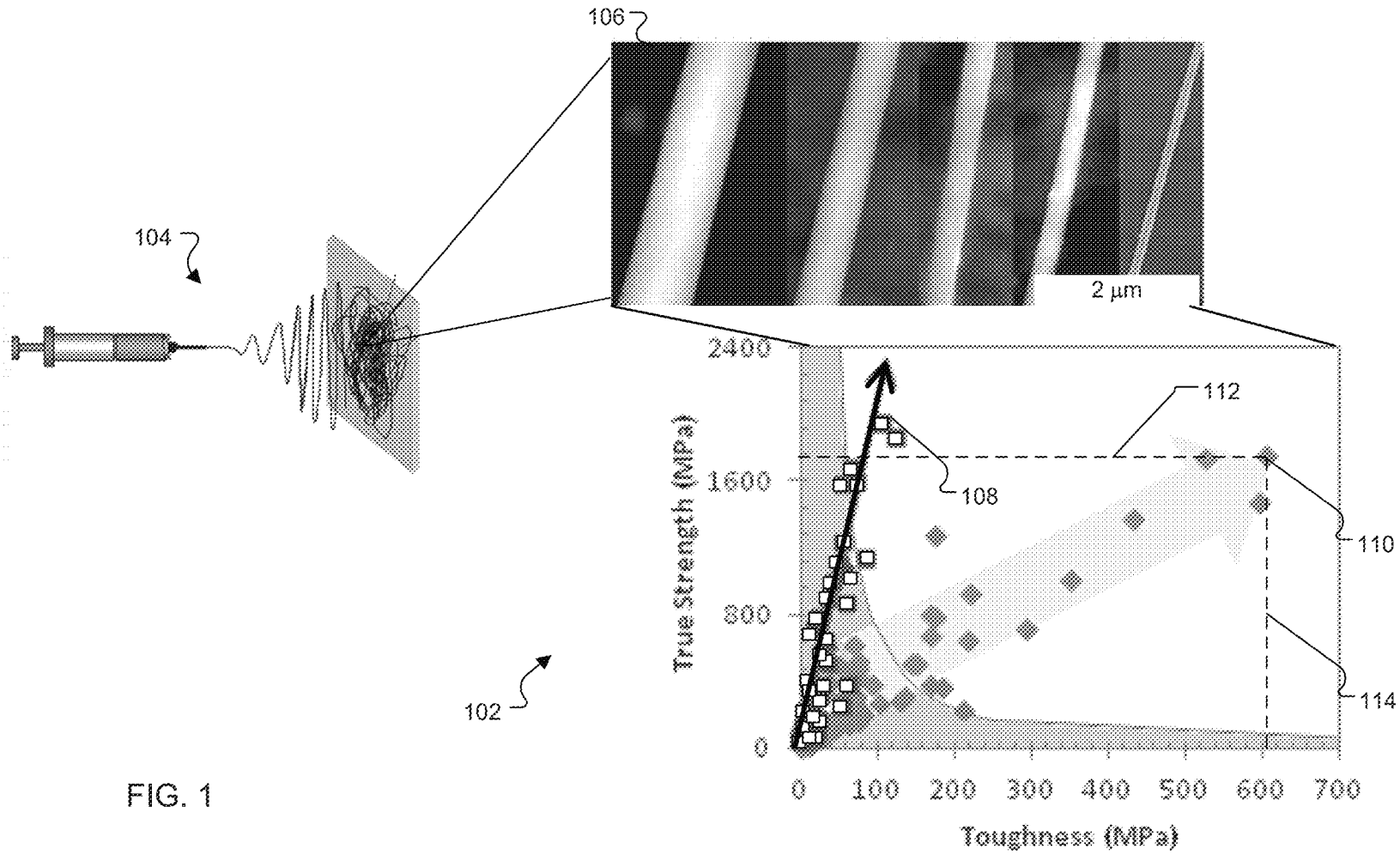
FIG. 1 is a block diagram showing example results of electrospinning a polymer into nanofibers.

The mechanical properties of structural materials and fibers can depend on a number of factors including, but not limited to chemical composition, particle size, external interactions (chemical or physical), processing methods, and pre- or post-processing steps. These factors can be changed in order to tune a material or fiber to attain particular performance specifications. Strong fibers have been developed in the last several decades. However, existing structural fibers are brittle. The following disclosure describes a number of methods to generate and process simultaneously strong, tough, and continuous nanofibers.

Continuous nanofibers possess unique macro-nano nature, which makes such fibers readily available for macroscopic materials and composites that can be used in safety-critical applications. The proposed mechanisms described below allow for simultaneously high strength, modulus, and toughness of nanofibers. This mechanical performance outcome challenges the prevailing 50-year old paradigm of high-performance polymer fiber development calling for high polymer crystallinity and may have broad implications in fiber science and technology, in addition to nanotechnology.

The following disclosure describes comprehensive generation and analysis of individual continuous nanofibers that exhibit improved strength, toughness, and modulus. In one example, polymer fibers are electrospun to reduce the fiber diameter from about 2.8 micrometers to about 100 nanometers resulting in simultaneous increases in elastic modulus from about 0.36 GPa to about 48 GPa, a true strength from about 15 MPa to about 1750 MPa, and toughness from about 0.25 MPa to about 605 MPa, with the largest increases recorded for ultrafine nanofibers smaller than about 250 nanometers.

The methods used to generate the simultaneously strong and tough nanofibers in this disclosure include electrospinning polymer materials. In some implementations, the synthetic polymer materials include polyacrilonitrile (PAN), flexible chain polymers, rigid chain polymers, semi-flexible chain polymers, liquid crystalline polymers, polyester, polyamide 6, nylon 66, Nomex, semi-crystalline polymers, Polyaramid, Kevlar, PBO, PBI, M5, polyimide, soluble polyimide, thermoplastic or thermoset polymers, precursors for carbon and ceramic nanofibers, and/or hybrids of any of the above. In some implementations, simultaneously strong and tough nanofibers can be electrospun from biological polymers, such as natural biopolymers, proteins, collagen, DNA, silk, recombinant silk, biocompatible synthetic polymers, biodegradable polymers, hybrid biological polymers, hybrid biological-synthetic polymers, or any combination thereof. Strong and tough continuous nanofibers can be also produced by electrospinning polymer or other fiber-forming precursors followed by a post-treatment resulting in the final fiber. Examples include imidization of polyamic acid precursors to obtain polyimide nanofibers, carbonization of a variety of organic or inorganic polymer precursors resulting in carbon or ceramic nanofibers, and firing (or calcination) of sol-gel derived ceramic nanofibers.

The following disclosure also describes structural investigations and comparisons with mechanical behavior of annealed nanofibers. Structural improvements, such as further increased stiffness and strength, as compared to as-spun nanofibers, can be attributed to higher nanofiber crystallinity resulting from annealing.

The term "toughness" as described herein represents the energy a sample can absorb before it breaks. The term "modulus" as described herein represents a ratio of the stress along the fiber axis over the strain along that axis. The terms "electrospinning" and "electrospun" as described herein is a process used to obtain nanofibers. The process uses high voltage applied to polymer fluid to eject and stretch a fiber-forming jet from a liquid (or melt) polymer. Polymer fluid can be delivered through a nozzle, via open surface, or through a sheet or film of fluid spread over a solid surface or a wire. In some implementations, electrical jet forming and driving forces are supplemented or augmented by mechanical forces such as forces produced by additional mechanical drawing, moving or rotating substrate, supplementary air flow, etc.

FIG. 1 is a block diagram showing example results 102 of electrospinning 104 a polymer into nanofibers 106. The results 102 show analysis of long (e.g., 5-10 mm) individual nanofiber specimens that exhibit improved strength and toughness for annealed nanofibers (e.g., square shapes, such as square 108) versus as-spun nanofibers (e.g., shown as diamond shapes, such as diamond 110). The results 102 depict an analysis of diameter size effects on strength and toughness of continuous electrospun polyacrilonitrile (PAN) nanofibers in a broad range of diameters with emphasis on ultrasmall diameters. In one example, the PAN fibers are electrospun to reduce the fiber diameter from about 2.8 micrometers to about 100 nanometers resulting in simultaneous increases in elastic modulus from about 0.36 GPa to about 48 GPa, a true strength from about 15 MPa to about 1750 MPa (112), and toughness from about 0.25 MPa to about 605 MPa (114), with the largest increases recorded for ultrafine nanofibers smaller than about 250 nanometers.

In some implementations, the electrospinning is performed using a spiral-shaped continuous electrospun jet. This characteristic jet shape is the result of bending instability. This instability can occur hierarchically, at continuously reducing scales and is responsible for the ultrafine diameters of electrospun nanofibers.

Figure 2:
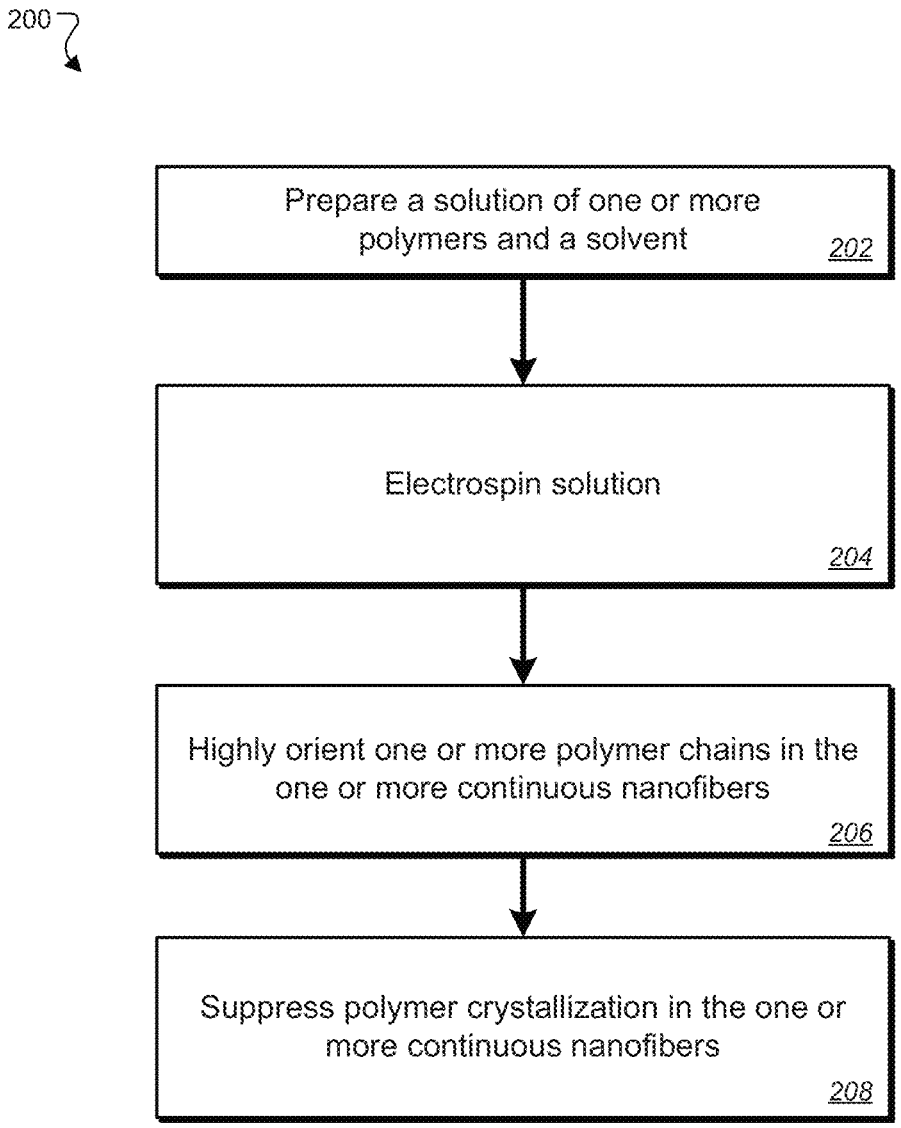
FIG. 2 illustrates an example process for fabricating a continuous nanofiber.

FIG. 2 illustrates an example process 200 for fabricating a continuous nanofiber. The process 200 can include preparing (202) a solution of one or more polymers and one or more solvents. For example, a polymer, such as polyacrilonitrile PAN, can be prepared in about 8-11% wt/wt solution (e.g., Pfaltz and Bauer, Inc.; cat #P21470, MW 150,000) and a solvent of dimethylformamide (DMF) (e.g., Sigma-Aldrich; cat #271012) can be prepared. Other solvents and other concentrations can be used instead and in some implementations, these other solvents and concentrations are depicted in the figures of this disclosure. In addition, the polymer used in the electrospinning processes can vary. For example, the polymer may include any of the following: flexible chain polymers, rigid chain polymers, semi-flexible chain polymers, liquid crystalline polymers, polyester, polyamide 6, nylon 66, Nomex, semi-crystalline polymers, Polyaramid, Kevlar, PBO, PBI, M5, polyimide, soluble polyimide, thermoplastic or thermoset polymers, precursors for carbon or ceramic fibers, natural biopolymers, proteins, collagen, DNA, silk, recombinant silk, biocompatible synthetic polymers, biodegradable polymers, hybrid biological polymers, and hybrid biological-synthetic polymers. In some implementations, the continuous nanofibers generated using process 200 can be adapted to form a sheet, a membrane, a yarn, a two dimensional assembly, a three dimensional assembly, or a coating, for example.

The prepared solution is electrospun (204) to produce one or more continuous nanofibers having diameters below about 250 nanometers. In some implementations, the electrospinning can produce continuous nanofibers having diameters between about 50 nanometers and about 500 nanometers. In some implementations, the diameter of the one or more continuous nanofibers is about 5 nanometers to about 50 nanometers. The diameter of the one or more continuous nanofibers can be based at least in part on an applied electric field strength of about 10 kilovolts to about 12 kilovolts over the spinning distance of about 5 centimeters to about 40 centimeters, for example.

In general, the electrospinning can include discharging the solution through one or more liquid jets into an electric field to yield one or more continuous nanofibers. In some implementations, the electrospinning can be performed to highly orient (206) one or more polymer chains in the one or more continuous nanofibers along a fiber axis of the one or more continuous nanofibers. In some implementations, highly orienting the one or more polymer chains includes decreasing a diameter of one or more of the continuous nanofibers by introducing, during the electrospinning process, one or more jet instabilities to one or more of the liquid jets using mechanical or electromagnetic perturbations. In some implementations, highly orienting the one or more polymer chains includes decreasing a diameter of one or more of the continuous nanofibers by stretching one or more of the nanofibers during or after performing the electrospinning.

In some implementations, the electrospinning can be performed to suppress (208) polymer crystallization in the one or more continuous nanofibers. The suppression of polymer crystallization can cause the one or more continuous nanofibers to exhibit an increase in fiber strength and modulus while maintaining strain at failure, resulting in an increase in fiber toughness. For example, the increase in fiber true strength for a particular nanofiber can include an increase to about 1750 MPa while the increase in fiber toughness can include an increase to about 600 MPa. In some implementations, suppressing polymer crystallization can include disrupting formation of one or more intermolecular bonds during the electrospinning process by including in the solvent one or more additives, such as plasticizers, or by altering molecular structure of the polymer using atactic polymer resulting in suppressing polymer crystallization in the one or more continuous nanofibers.

In some implementations, the process 200 additionally includes performing a liquid soaking of the one or more continuous nanofibers to result in a disruption of crystallization of one or more continuous nanofiber. In some implementations, suppressing polymer crystallization can be achieved by fast solvent evaporation or through confining polymer in ultrafine nanofibers. In some implementations, the method 200 additionally includes applying one or more of heat, ultraviolet radiation, or a chemical reagent to the one or more continuous nanofibers resulting in an additional increase in fiber modulus, strength, or toughness for the one or more continuous nanofibers. For example, application of heat, ultraviolet radiation or chemical reagents or other steps described in this specification can result in producing continuous nanofibers with an increase in fiber true strength to about 6500 MPa with a simultaneous increase in fiber toughness to about 2200 MPa. In another example, particular steps described throughout this specification can produce a continuous nanofiber with an increase in fiber true strength to about 12500 MPa and an increase in fiber toughness to about 2500 MPa.

In some implementations, individual nanofibers can be processed into a variety of nanofiber assemblies, meshes, membranes, layered structures, yarns, bundles, fabrics, and two- and three-dimensional constructs and arrays. These can be fabricated by integrated on-line nanomanufacturing methods via controlled electrospinning; by post-processing methods, e.g. mechanical bundling, twisting, and stretching of electrospun nanofibers; or by a combination of the integrated and postprocessing methods.

Figure 3:
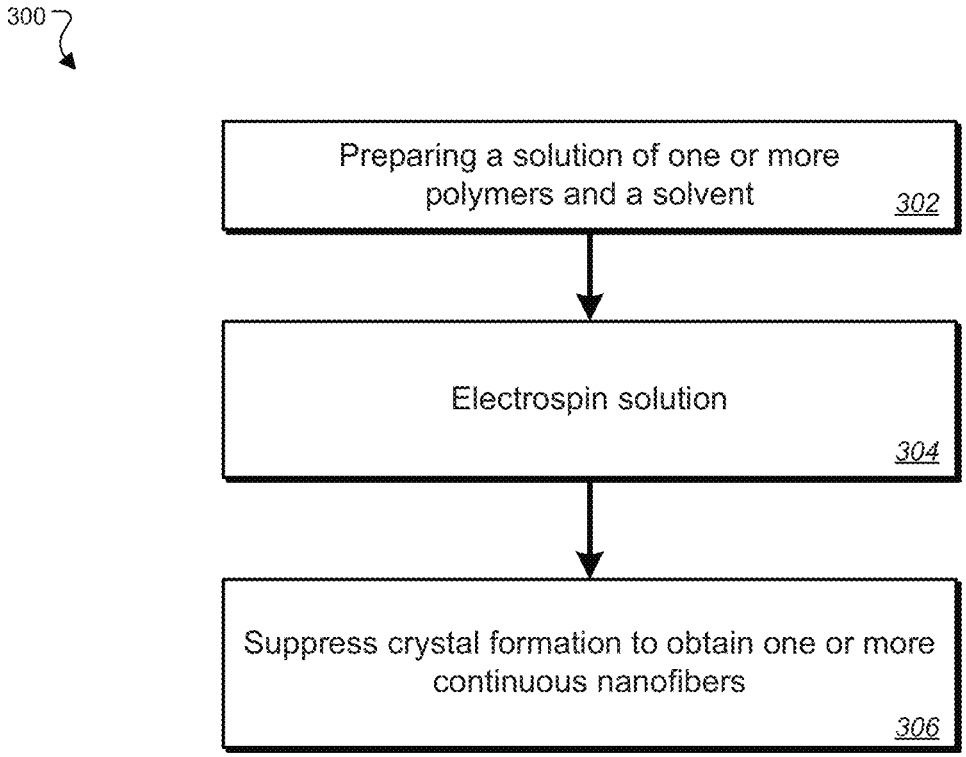
FIG. 3 illustrates another example process for fabricating a continuous nanofiber.

FIG. 3 illustrates an example process 300 for fabricating a continuous nanofiber for use in composites. The process can include preparing (302) a solution of one or more polymers and a solvent. For example, a polymer, such as polyacrilonitrile PAN, can be prepared in about 8-11% wt/wt solution (e.g., Pfaltz and Bauer, Inc.; cat #P21470, MW 150,000) and a solvent of dimethylformamide (DMF) (e.g., Sigma-Aldrich; cat #271012) can be prepared.

A polymeric solution can be electrospun (304) by discharging, through one or more jets, the polymeric solution through an electric field to yield one or more fibers. During the electrospinning, crystal formation can be suppressed (306) to obtain one or more continuous nanofibers having a diameter of below about 250 nanometers. Such continuous nanofibers may exhibit a toughness of about 500 MPa to about 600 MPa and a true strength of about 1500 MPa to about 1700 MPa. In some implementations, suppressing crystal formation includes performing (a) polymer solidification of the fibers and (b) an evaporation of a solvent in the polymeric solution, to yield one or more continuous nanofibers.

In some implementations, the process 300 additionally includes highly orienting one or more polymer chains by decreasing a diameter of one or more of the continuous nanofibers by introducing, during the electrospinning process, one or more jet instabilities using mechanical or electromagnetic perturbations. In some implementations, the process 300 additionally includes highly orienting one or more polymer chains to decrease a diameter of one or more of the continuous nanofibers by stretching one or more of the continuous nanofibers during or after performing the electrospinning.

In some implementations, the processes described throughout this disclosure (e.g., FIGS. 2 and 3) can be used to generate, via electrospinning, a continuous nanofiber, composed essentially of polymer. The continuous nanofiber can have average diameter ranging from about 50 nanometers to about 100 nanometers while exhibiting a strength of about 1550 MPa to about 1750 MPa and a fracture toughness of about 500 MPa to about 600 MPa. In some implementations, the continuous nanofiber can include a nanoreinforcement adapted to form a composite, an adhesive, a nanoreinforced interface, or a nano-Velcro bond. In some implementations, the continuous nanofiber is adapted to form a sheet, a membrane, a yarn, a two dimensional assembly, a three dimensional assembly, or a coating, for example.

The resulting one or more continuous nanofibers exhibit a toughness of about 600 MPa, a strength of about 1700 MPa, and a Young's modulus of about 48 GPa. No saturation of the mechanical properties is observed, so further improvements are expected with further reduction of nanofiber diameter, improvement of polymer chain orientation, and/or reduction of crystallinity. As described above, additional pre- or post-processing can be performed. Although the various actions in FIGS. 2 and 3 have been shown in a linear grouping as one example, the particular determinations made in the process and the order of those determinations may vary depending on the implementation. Further, although the various actions above are described with respect to particular polymers and solvents, other polymers and solvents can be used with the described method to form fibers with similar mechanical properties, as described throughout this disclosure.

FIG. 4 illustrates a table 400 depicting correlation of mechanical properties of nanofibers. In particular, the table 400 shows Pearson correlation coefficients and coefficients of determination for linear regression of true strength/modulus and true strength/toughness correlations for as-spun and annealed nanofibers.

In general, XRD crystallinity was calculated by dividing the area under the crystalline peaks by the total area under the curve, as shown by equation (1):

$$\%_{crystallinity} = \frac{A_{c1} + A_{c2}}{A_a + A_{c1} + A_{c2}} * 100 \quad (1)$$

The coherence length was calculated from the width of the main crystalline peak using the Scherrer equation as shown at equation (2):

$$C.L.\left(\overset{o}{(A)}\right) = \frac{\kappa\lambda}{\beta\cos\vartheta} = \frac{0.9 * 1.542}{\sqrt{FWHM(\mathrm{Rad})^2 - 0.002^2)\cos\vartheta}} \quad (2)$$

where shape factor was taken as 0.9, the 'A' represents the standard wavelength for a copper source, 0.002 represents the instrumental peak widening calculated based on a single crystal Si standard, and 'e' is the Bragg angle for the crystalline peak.

Linear regression curves for the true strength/modulus and true strength/toughness correlations were fitted separately for each of the nanofiber families (as-spun and annealed). The associated Pearson correlation coefficients (R) and coefficients of determination (R2) are shown in FIG. 4 at table 400. Strong, positive correlations were observed, with the strongest correlation between strength and toughness of as-spun nanofibers 402.

The slopes of the strength/modulus regression lines for the two nanofiber families (examined in SAS® Proc Glimmix software, Version 9.2 TS of the SAS System for Windows. Copyright ©2002-2008 SAS Institute Inc. SAS and all other SAS Institute Inc. product or service names are registered trademarks or trademarks of SAS Institute Inc., Cary, N.C., USA) were not statistically different at the u=0.05 confidence level (p-value for the slope/nanofiber family interaction term was 0.3345), while in case of strength/toughness correlations the lines for the two nanofiber families were statistically different at the same confidence level. Analysis of strength/failure strain relationships showed that the slopes of the regression lines for both samples were not statistically different from zero (p-values for strain and sample*strain terms were 0.67 and 0.24 respectively), indicating no correlation between these properties.

Figure 5A:
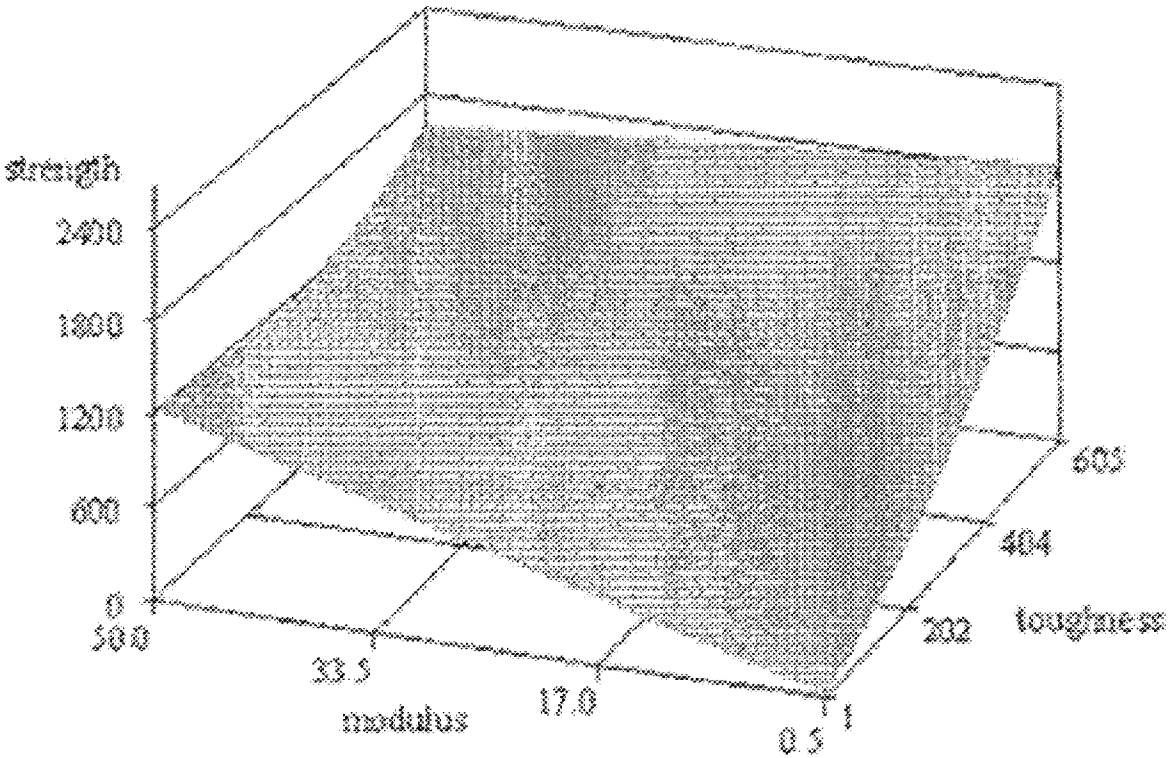
FIGS. 5A-B illustrate a response surface for strength/modulus and strength/toughness reduced second order linear regression model.
Figure 5B:
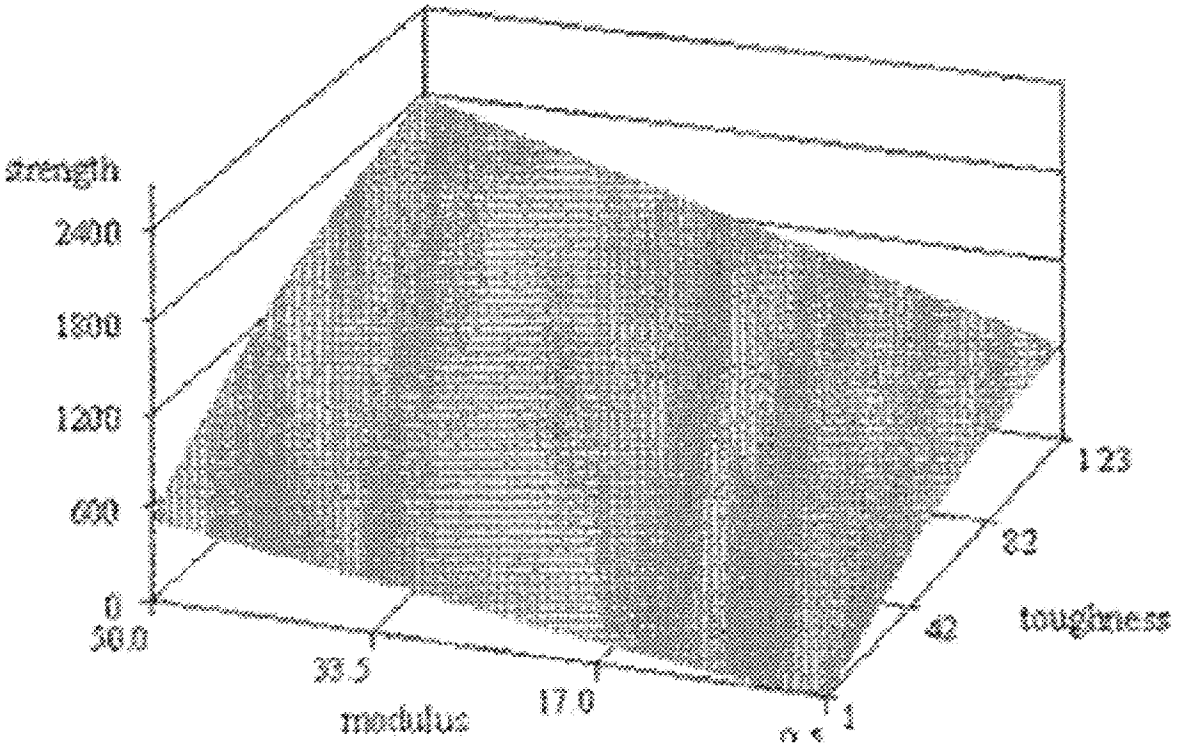

Two parameter response surfaces for the correlation of strength with modulus and toughness were also plotted and analyzed. A second order linear regression model was examined. The model was subsequently reduced by eliminating statistically insignificant terms. While second order terms associated with modulus were eliminated from the model, the second order terms for toughness and linear by linear terms for modulus*toughness were retained. The coefficient of determination for the reduced models was 0.9 for both the as-spun and the annealed fiber families FIGS. 5A-B illustrate a response surface for strength/modulus and strength/toughness reduced second order linear regression model. The computed response surfaces for the as-spun and the annealed fiber families are shown in FIGS. 5A and 5B. As shown in FIG. 5A, the as-spun fibers show an increase in toughness that began to decelerate slightly relative to increase in strength. However, the absolute value of the positive coefficient for the quadratic term in this case was more than one order of magnitude smaller, indicating weaker dependence.

As shown in FIG. 5B, an increase in toughness for the annealed fibers accelerated relative to the increase in strength. This was also expressed by the negative coefficient of the quadratic term associated with toughness in the response surface for annealed fibers.

FIGS. 6A-6F illustrate graphs showing mechanical properties and structure of as-spun nanofibers based on fiber diameter. The graphs in FIGS. 6A-6F were achieved measuring electrospun fibers. For example, continuous polyacrilonitrile (PAN) nanofibers were electrospun from about 8 to about 11% polymer solutions in a dimethylformamide (DMF) solvent. Fiber diameters were controlled by varying voltage and polymer concentration. A gauge length of 5 millimeter to 10 millimeter sections of individual long nanofibers were tested in tension under constant strain rate using a nanomechanics testing system. Nanofiber diameters were measured by FE-SEM. To avoid possible radiation damage, the diameters were measured on the sections of continuous nanofibers adjacent to the tested section.

The resulting nanofibers generated by methods described here and above in FIGS. 2 and 3 represent continuous nanofibers that can be used in a variety of filamentary materials, including porous membranes, fabrics, and composites. The continuous nanofibers may be prepared, for example, by a process that includes (i) highly orienting one or more polymer chains in the one or more continuous nanofibers along a fiber axis of the one or more continuous nanofibers, and (ii) suppressing polymer crystallization in the one or more continuous nanofibers, the one or more continuous nanofibers having diameters below about 250 nanometers and exhibiting an increase in fiber strength and modulus while maintaining strain at failure, resulting in an increase in fiber toughness.

As shown in FIGS. 6A-6F, as-spun PAN nanofibers exhibited pronounced elasto-plastic behavior with large deformations to failure. True stress and strain were used to describe material behavior at large deformations. Nanofiber modulus, failure stress (strength), strain at failure, and toughness (area under the stress-strain curve) were extracted from individual nanofiber test results. Modulus and toughness values were computed using engineering stress-strain diagrams.

Variations of the measured strength, modulus, strain at failure, and toughness with diameter of individual as-spun PAN nanofibers are presented in FIGS. 6A-6D. Typical stress-strain diagrams of nanofibers with different diameters are shown in FIG. 6E. The results (FIG. 6A-6B) show increases in strength and modulus as nanofiber diameter decreases. The most dramatic increases were recorded for nanofibers finer than about 200 nanometers to about 250 nanometers. The highest strength and modulus values measured in this study were 5-10 times higher than the strengths and moduli of commercial PAN fibers and are on par with the highest reported strength and modulus achieved in a superdrawn (80×) ultra-high molecular weight (UHMW) PAN microfiber.

Such high values of modulus and strength in polymers are usually achieved at the expense of strain at failure. Remarkably, the high strength of the ultrafine PAN nanofibers was achieved without statistically noticeable reduction of their failure strain (FIG. 6C). Though the scatter is high (typical for fiber studies), the average strain at failure appears to slightly increase with the diameter decrease and stays well above 50%. These unique simultaneous increases in modulus, strength, and strain at failure led to a dramatic increase of toughness (FIG. 6D). The highest recorded toughness was an order of magnitude higher than toughness of the best existing advanced fibers (see lines in FIG. 6D) and exceeded toughness of spider silk. Similar behavior on several other nanofiber systems also occurred, including synthetic and biological polymers.

Figure 6A:
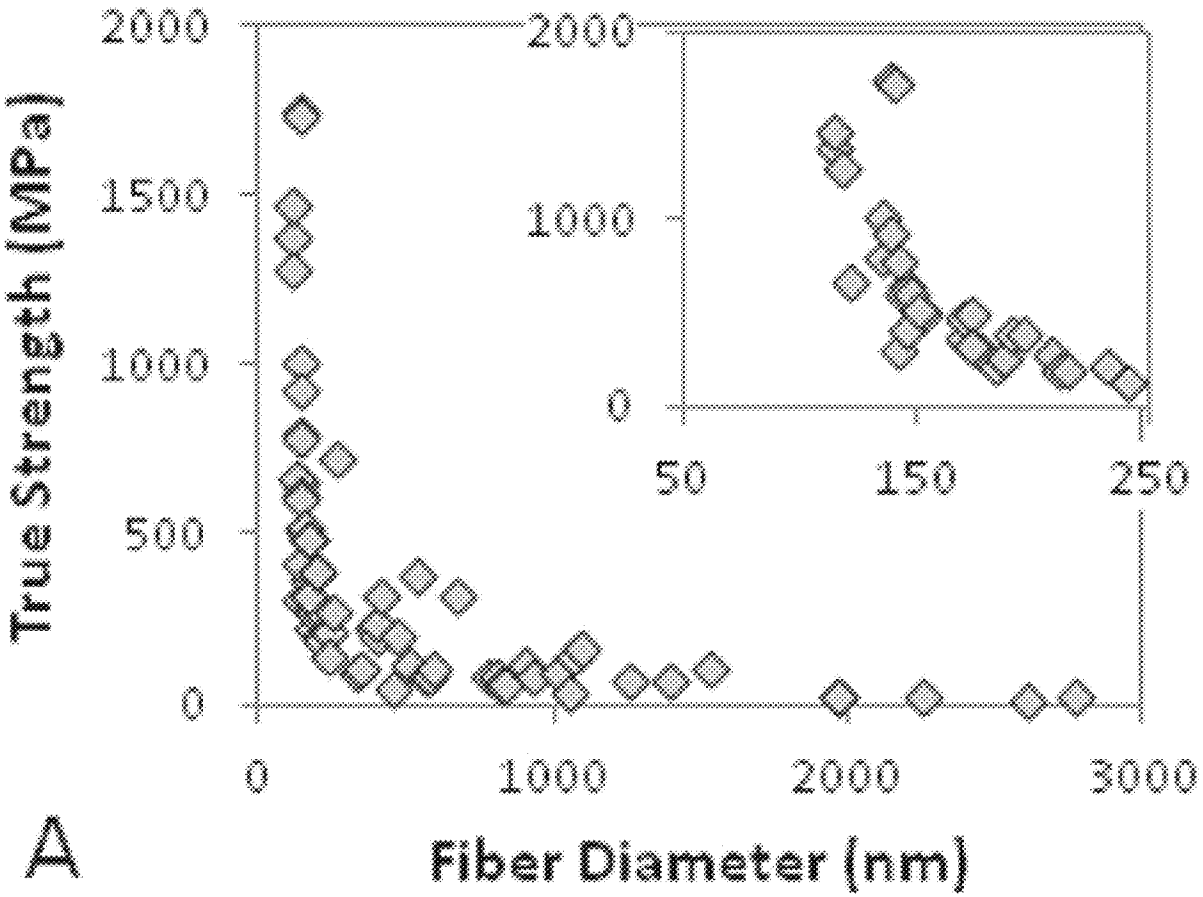
FIGS. 6A-6F illustrate graphs showing mechanical properties and structure of as-spun nanofibers based on fiber diameter.
Figure 6B:
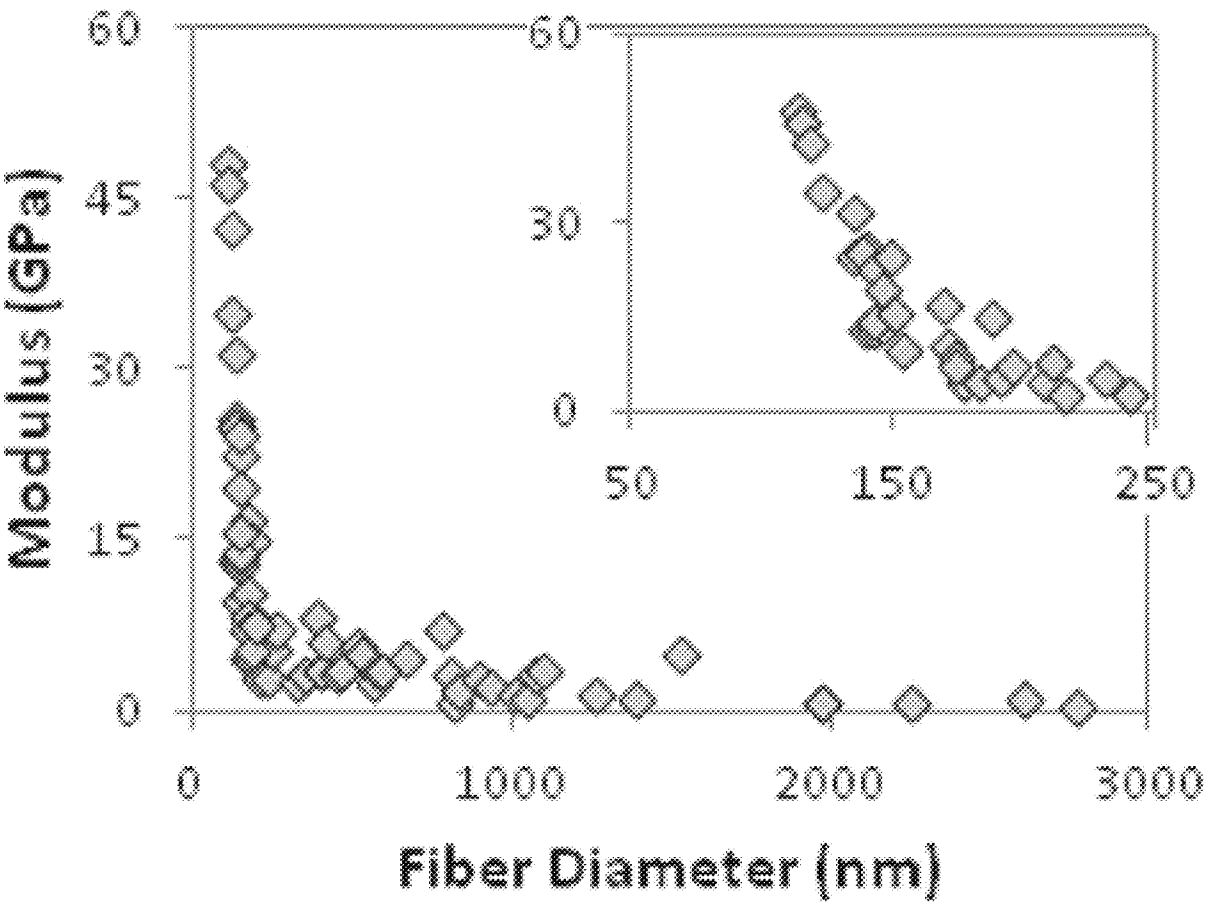
Figure 6C:
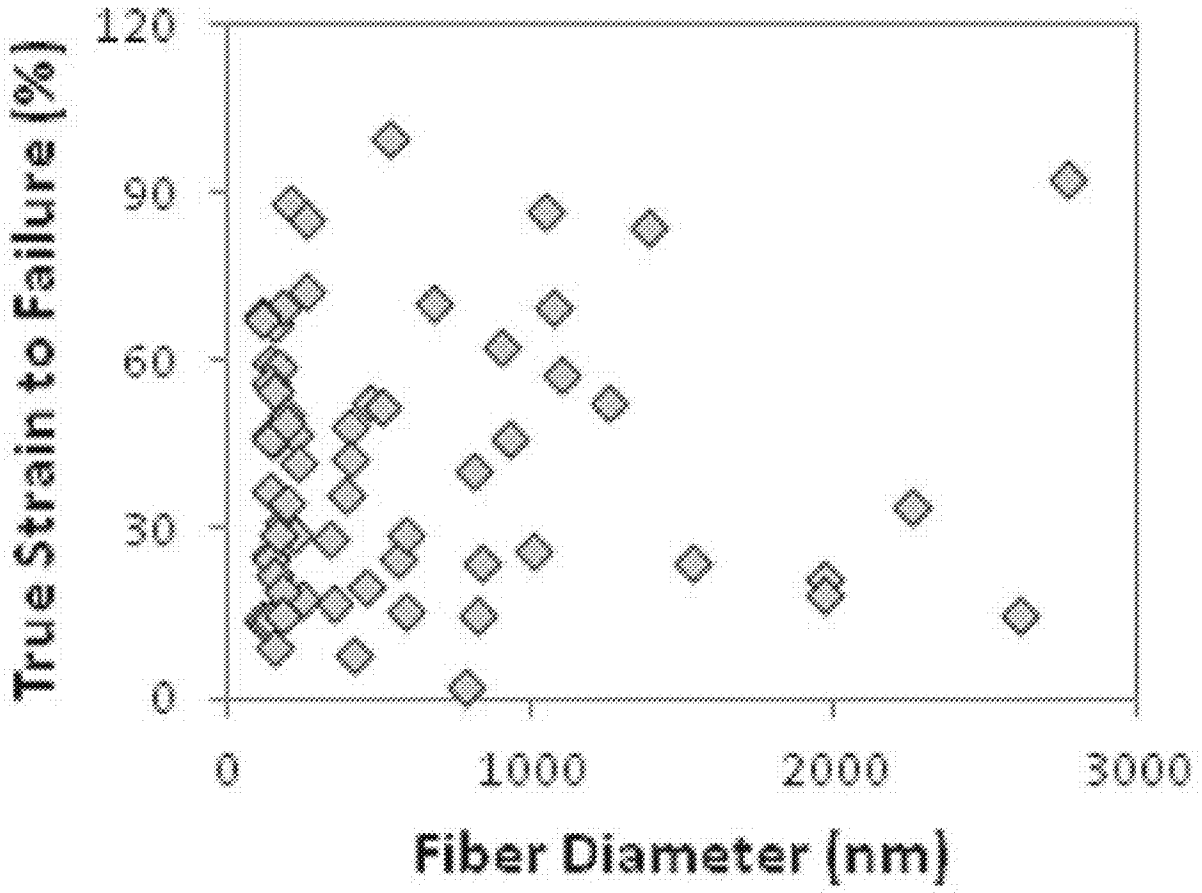
Figure 6D:
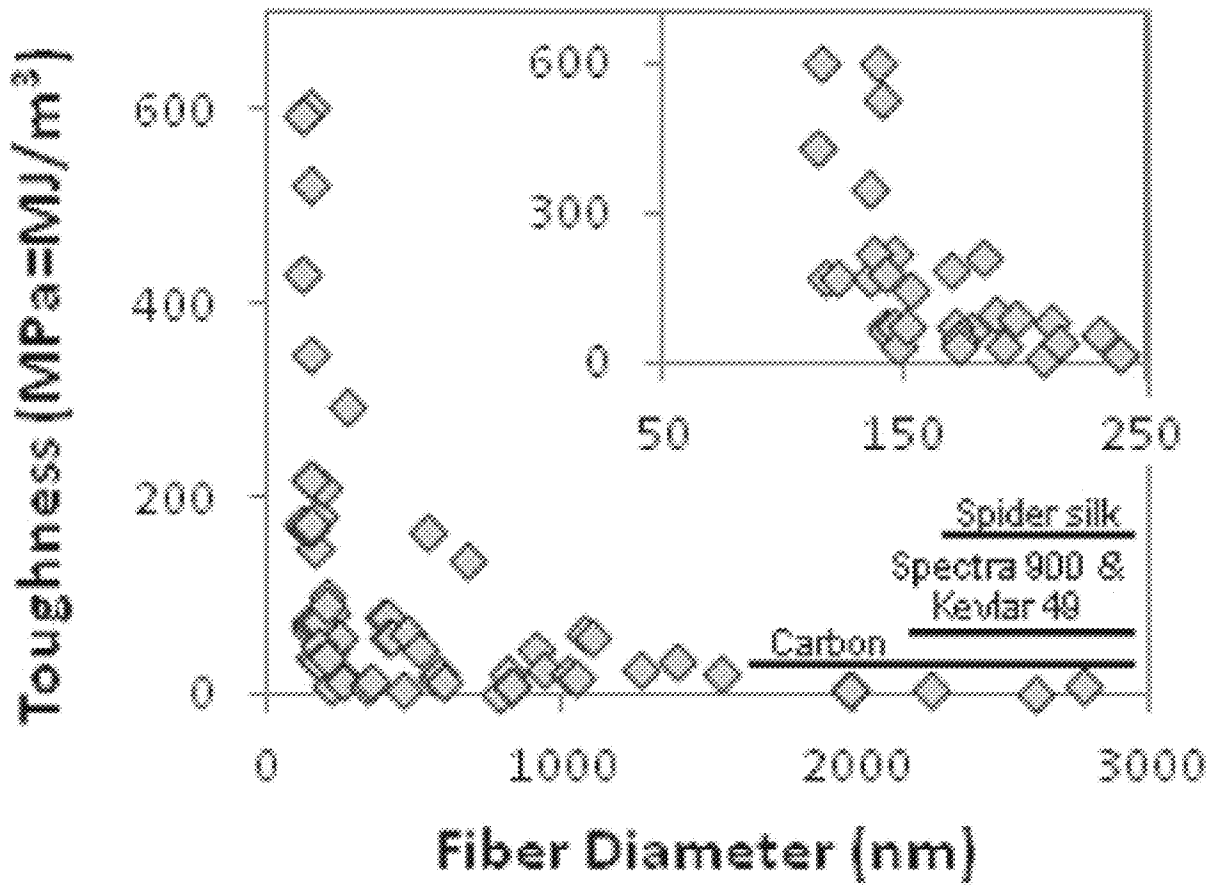
Figure 6E:
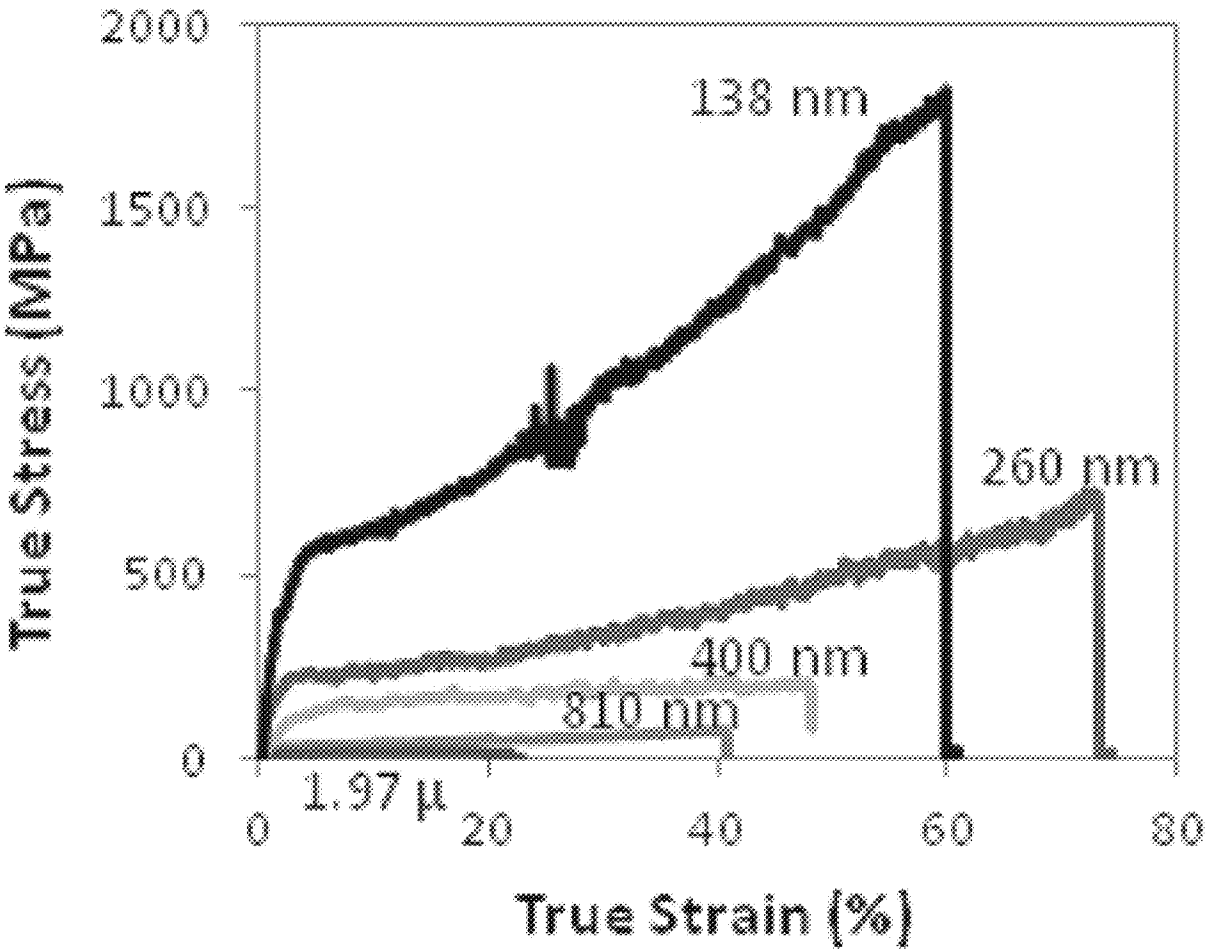
Figure 6F:
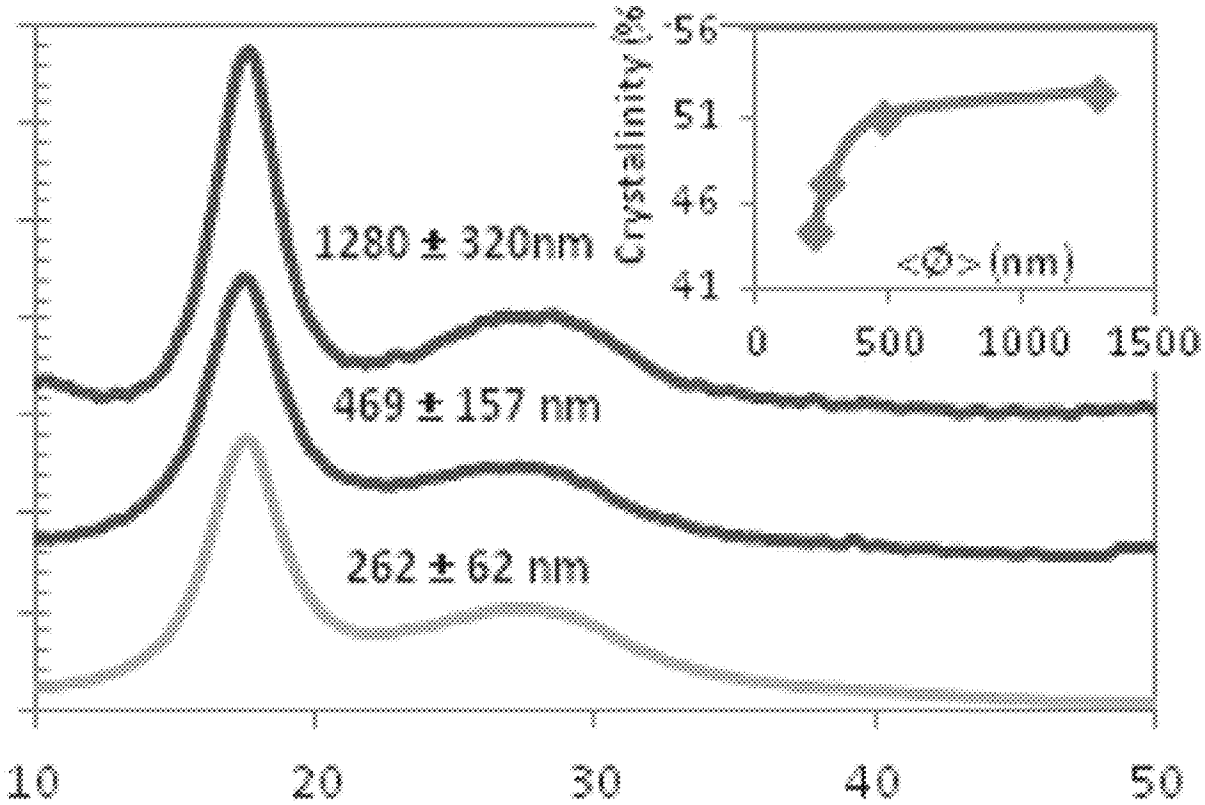

FIG. 6A illustrates true strength versus fiber diameter. FIG. 6B illustrates modulus versus fiber diameter. FIG. 6C illustrates true strain to failure versus fiber diameter. FIG. 6D illustrates toughness versus fiber diameter. The lines indicate comparison values for several high-performance fibers and spider silk. FIG. 6E illustrates typical stress/strain behavior versus fiber diameter. FIG. 6F illustrates XRD patterns for nanofiber bundles with different average fiber diameters and variation of degree of crystallinity with average fiber diameter shown in the inset.

In some implementations, observed increases in elastic modulus and strength can be attributed to improved chain orientation in the ultrafine nanofibers. Because chain orientation will only increase with the decrease of nanofiber diameters, the finest nanofibers in this study were highly oriented, which is reflected in the high values of their elastic moduli (FIG. 6B). In addition to orientation, ultrahigh strength and modulus of conventional high-performance polymer fibers are usually achieved as a result of high crystallinity. The two strongest commercial polymer fibers, polyaramid (Kevlar) and UHMW polyethylene (Spectra or Dyneema), rely on specialized fiber spinning techniques promoting crystallinity, i.e., spinning from a liquid crystalline (LC) solution and gel drawing, which result in high respective crystallinities of 75% and 95%. Most other high-performance polymer fibers, including experimental fibers under development, also rely on spinning from LC solutions of rigid-rod polymers that result in high crystallinity. However, while helping to further increase strength and modulus, high crystallinity may also reduce macromolecular mobility in the crystalline phase and may lead to low deformations to failure. Mutual sliding mobility of long chains in the amorphous regions of semi-crystalline polymers is a desired response for ductile, plastic behavior. Due to high crystallinity, all existing high-performance polymer fibers have very low deformations at failure (<3%) compared to bulk polymers.

The crystallinity of the as-spun PAN nanofibers was analyzed using wide angle X-ray diffraction (XRD). XRD diffractograms of nanofiber bundles with several different average nanofiber diameters are shown in FIG. 6F. All XRD spectra exhibited broad amorphous halo in addition to the crystalline peak and closely resembled the spectra of unoriented semi-crystalline PAN powder and undrawn cast PAN. Degree of crystallinity (see inset in FIG. 6F) was relatively low and further decreased for the finer fiber diameters. The results are consistent with low crystallinity in as spun PAN nanofibers. The XRD measurements in the current study were performed on nanofibers with relatively broad diameter distributions (see FIG. 6F). Analysis showed significant reduction of the average crystallinity in as-spun nanofibers with reduced average nanofiber diameter. Crystallinity of the smallest nanofibers tested is expected to be lower than the average value measured for the bundle because the bundle results are dominated by the largest fibers in the sample. The latter were shown to have higher crystallinity (see inset FIG. 6F).

The observed low crystallinity of the highly oriented fine nanofibers is atypical in the prior art. In conventional polymer fibers and films, increased macromolecular orientation achieved by drawing results in increased crystallinity. It is easier for the oriented polymer chains to organize into a crystal as opposed to unoriented entangled chains.

Analysis of PAN nanofiber crystalline structure in the electrospun fibers described above showed that as-spun nanofiber crystallinity did not increase with the reduction of diameter but rather decreased for finer diameters, despite the higher chain orientation in the ultrafine nanofibers that is supported, among other things, by their high modulus. Low crystallinity in electrospun nanofibers may be the result of fast solvent evaporation from electrospun jets leading to rapid jet solidification. Indeed, solvent evaporation in electrospinning occurs rapidly in-flight, resulting in solid nanofibers deposited on a collector. Fast evaporation and solidification may preclude polymer crystallization, despite the beneficial effect of chain orientation in nanofibers. Note that smaller jets lose solvent and solidify quicker.

Another possible mechanism of reduced crystallinity in fine nanofibers may be the high fraction of polymer located near the fiber surface. As such, crystallization in fine electrospun PAN nanofibers may be suppressed by fast solvent evaporation and rapid polymer solidification and, possibly, by two-dimensional surface confinement effects. This reduced crystallinity in the ultrafine electrospun nanofibers may be responsible for preserving high nanofiber ductility while increased chain molecular orientation caused by intense jet stretching in electrospinning may be responsible for high strength and modulus.

Direct observation of fine as-spun PAN nanofibers in low-voltage Transmission Electron Microscopy (TEM) and electron diffraction analysis confirmed low polymer crystallinity. However, diffuse diffraction patterns did not allow quantitative structural characterization of individual nanofibers. To further elucidate the role of crystallinity on mechanical behavior we performed mechanical analysis of annealed nanofibers. As such, annealing processes can be used to increase the degree of crystallinity in rapidly solidified thermodynamically metastable polymers. For example, annealing temperature for PAN nanofibers can be selected at about 130° C., which falls in the range of temperatures between PAN glass transition (i.e., 90-120° C.) and oxidation temperature. Oxidation of PAN, a process essential in the conversion of PAN precursors to carbon, does not usually start at temperatures below 200° C. Results of mechanical and structural evaluation of annealed PAN nanofibers are shown in FIGS. 7A-7F.

FIGS. 7A-7F illustrate graphs showing mechanical properties and structure of as-spun nanofibers and annealed nanofibers based on fiber diameter. In all figures, diamonds represent as-spun fibers and squares represent annealed fibers.

Figure 7A:
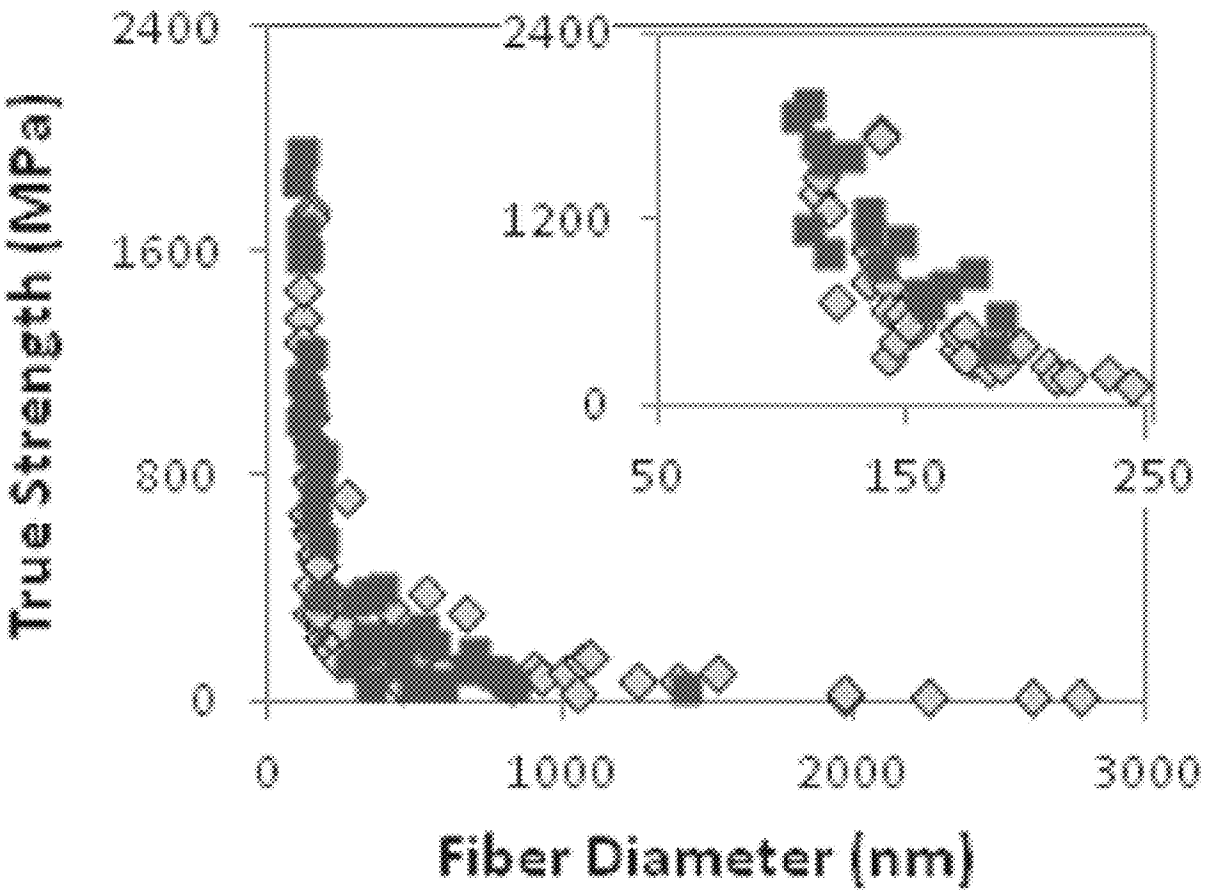
FIGS. 7A-7F illustrate graphs showing mechanical properties and structure of as-spun nanofibers and annealed nanofibers based on fiber diameter.
Figure 7B:
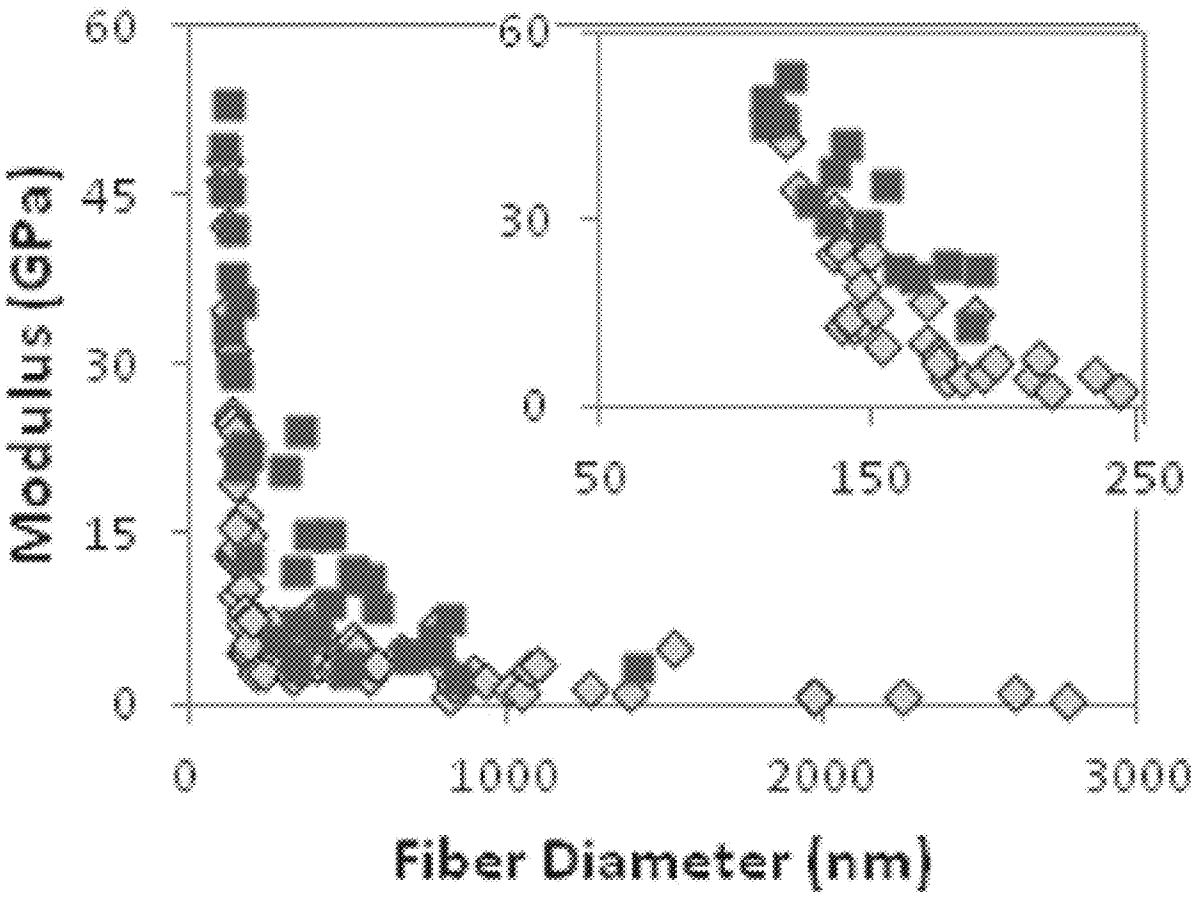
Figure 7C:
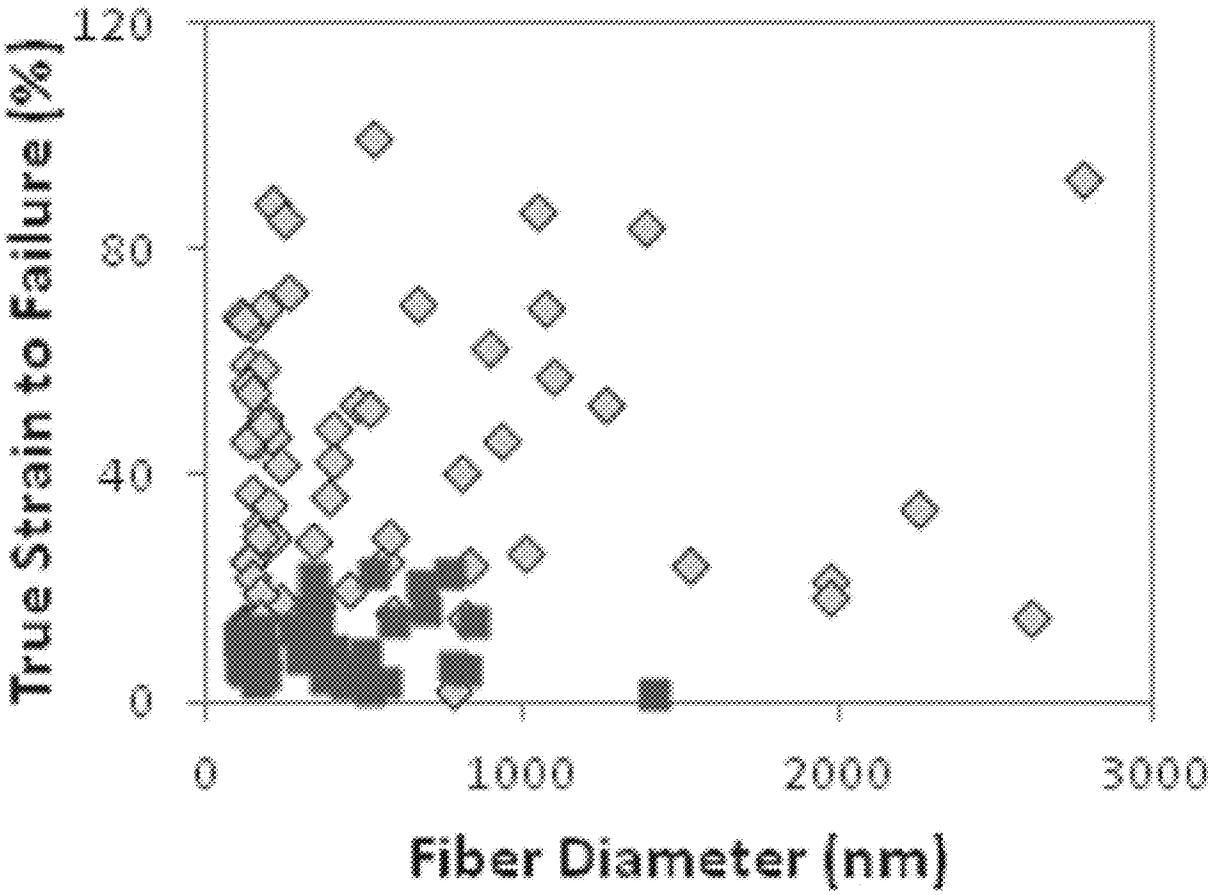
Figure 7D:
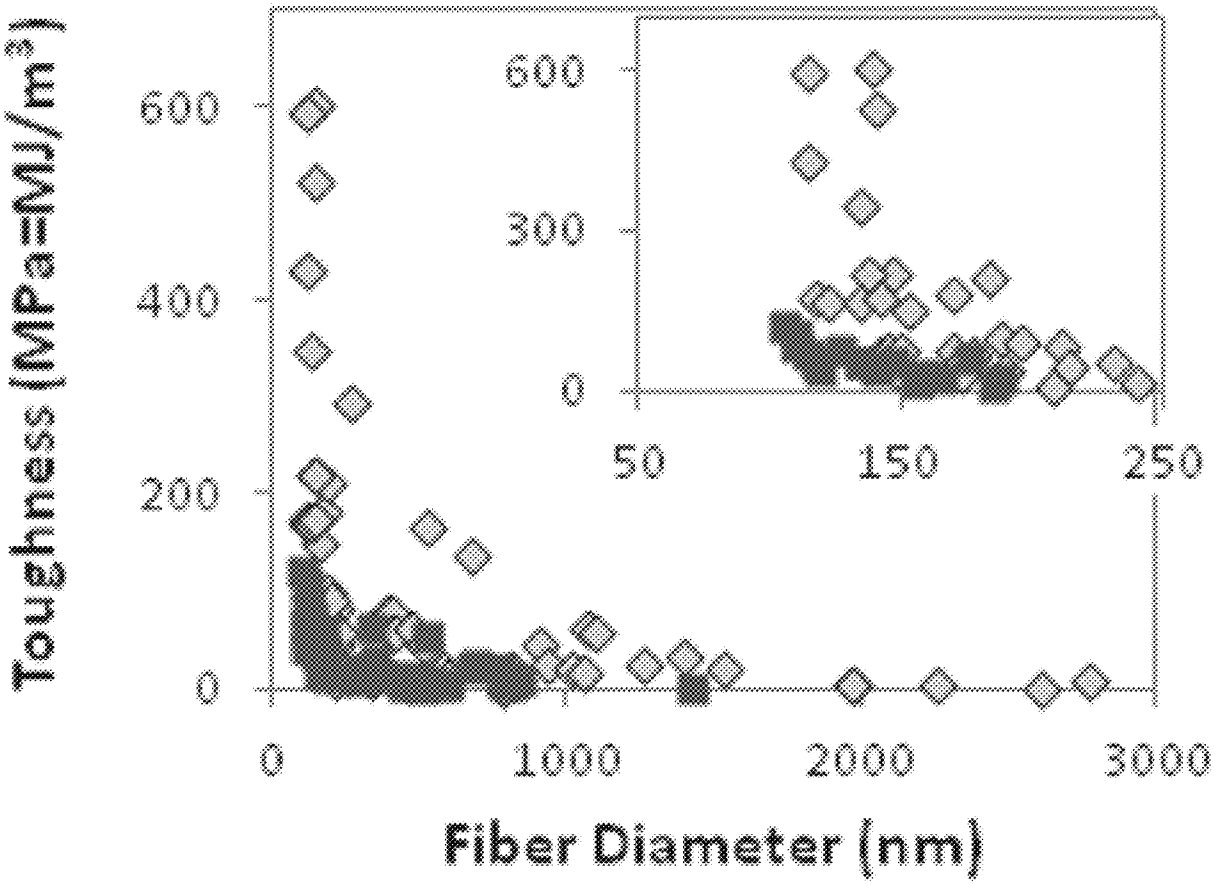
Figure 7E:
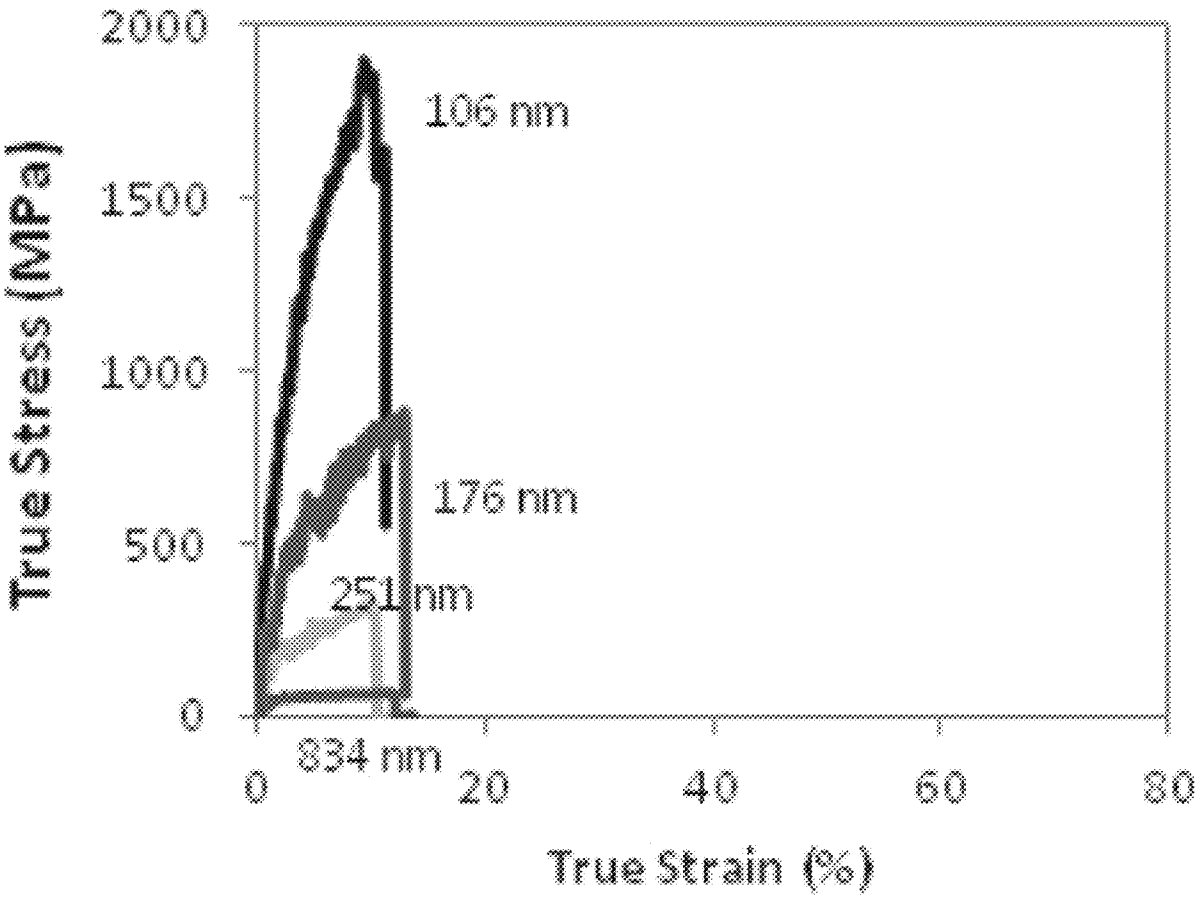
Figure 7F:
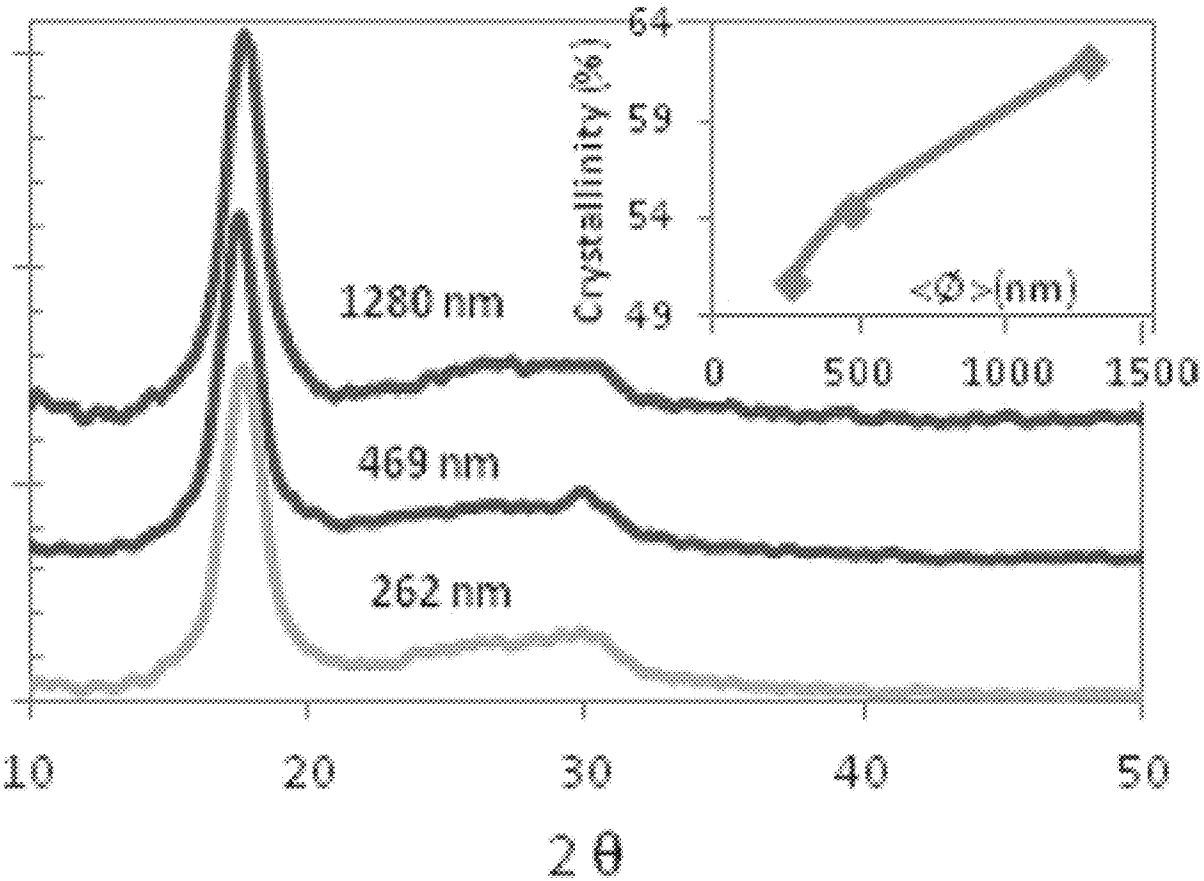

FIG. 7A illustrates true strength versus fiber diameter. FIG. 7B illustrates modulus versus fiber diameter. FIG. 7C illustrates true strain to failure versus fiber diameter. FIG. 7D illustrates toughness versus fiber diameter. FIG. 7E illustrates typical stress/strain behavior versus fiber diameter on the same strain scale as in FIG. 6E. FIG. 7F illustrates XRD spectra for annealed nanofiber bundles with different average fiber diameters. The annealed bundles were the same bundles studied in FIG. 6E. Nanofiber diameter distributions were not significantly changed by the annealing. The inset shows the dependence of crystallinity on average fiber diameter for annealed nanofibers.

Wide-angle x-ray analysis confirmed the increase in crystallinity as compared to as-spun nanofibers across the range of nanofiber diameters (FIG. 7F). Interestingly, similar to as-spun nanofibers, the degree of crystallinity of annealed samples also decreased with the decrease of average nanofiber diameter. This may be due to the differences in the initial structure of the nanofibers (see data for as-spun nanofibers of different diameters in FIG. 6F)

Typical stress-strain diagrams of annealed nanofibers are plotted in FIG. 7E in the same strain scale as as-spun nanofiber diagrams in FIG. 6E, for easier comparison. The analysis shows a significant increase in modulus compared to as-spun nanofibers of similar diameters. Strength values were also higher. However, nanofiber failure strain sharply decreased. The measured strains at failure of annealed nanofibers shown in FIG. 7C are within the range of strains typical of commercial textile polymer fibers such as polyester, polyamide 6, nylon 66, and Nomex.

Textile fibers have higher strains to failure than advanced high performance fibers, such as Kevlar and Spectra/Dyneema, but exhibit lower strength and modulus. Annealed PAN nanofibers still exhibited a strong size effect in modulus and strength. However, the observed reduction of strain at failure led to reduction of toughness (FIG. 7D). Overall, these results correlate with the increased crystallinity of the annealed nanofibers and support our hypothesis that large strains at failure and ultrahigh toughness of as-spun nanofibers are due to their low crystallinity.

To further analyze the size effects in electrospun nanofibers, correlations were made between various mechanical characteristics (FIG. 8A-8F).

Figure 8A:
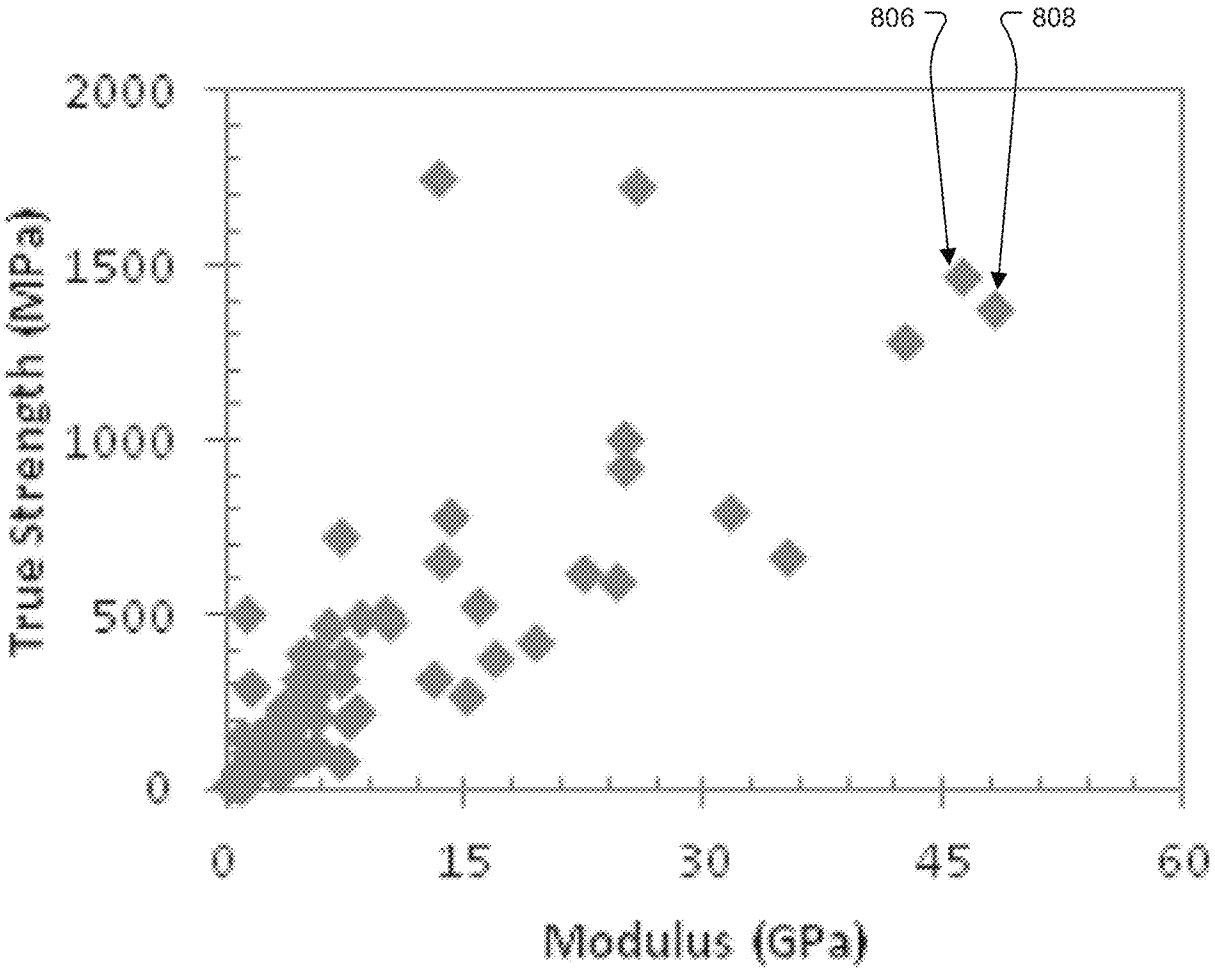
FIGS. 8A-8F illustrate graphs of correlations of mechanical properties of nanofibers of different diameters.
Figure 8B:
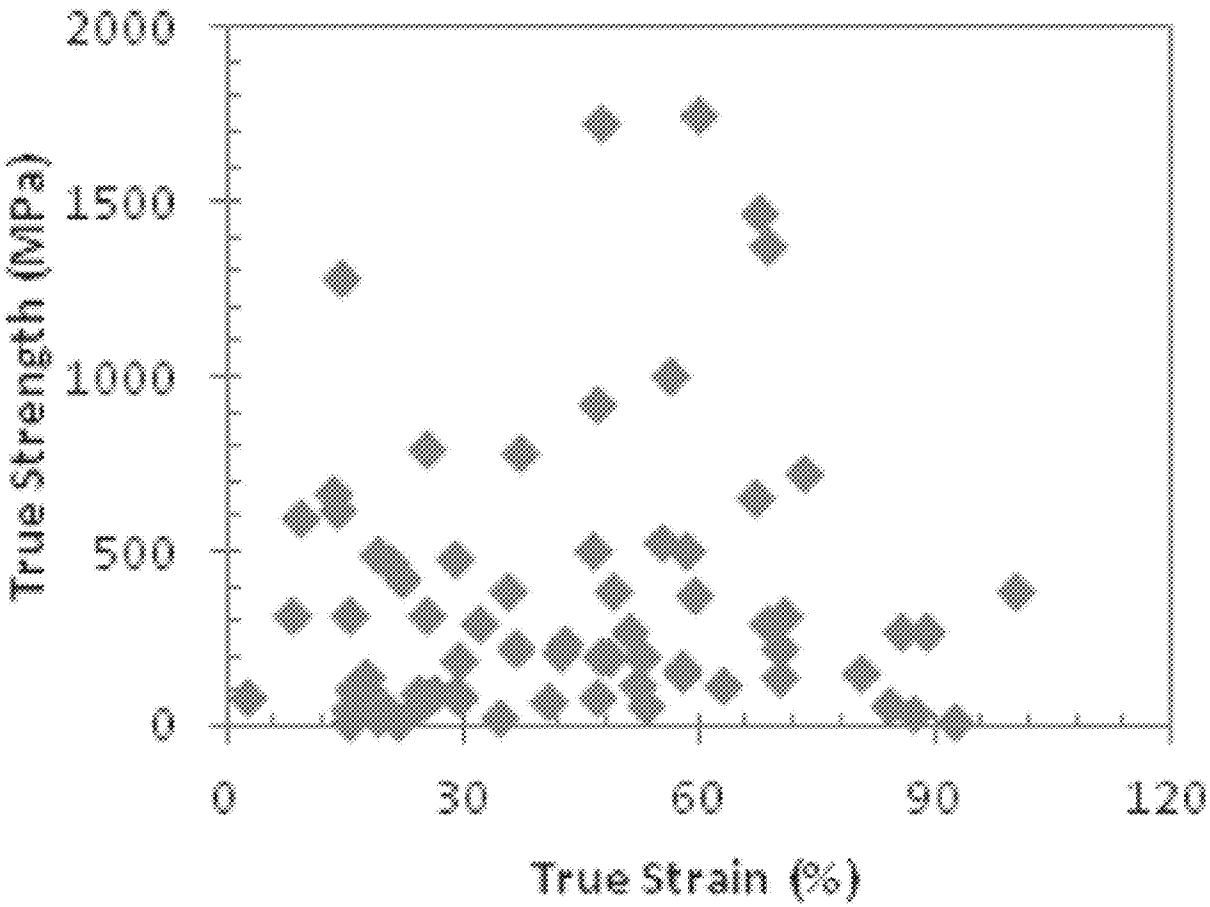
Figure 8C:
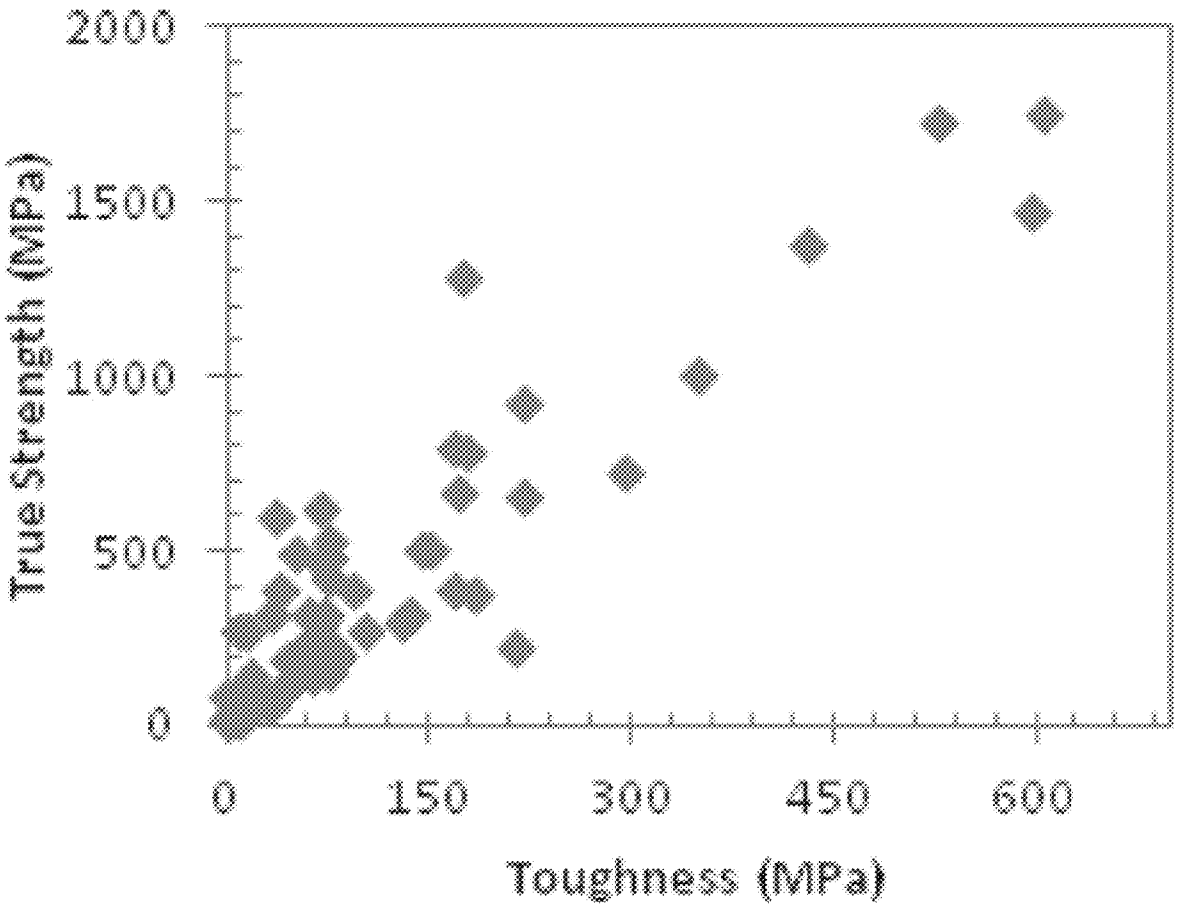
Figure 8D:
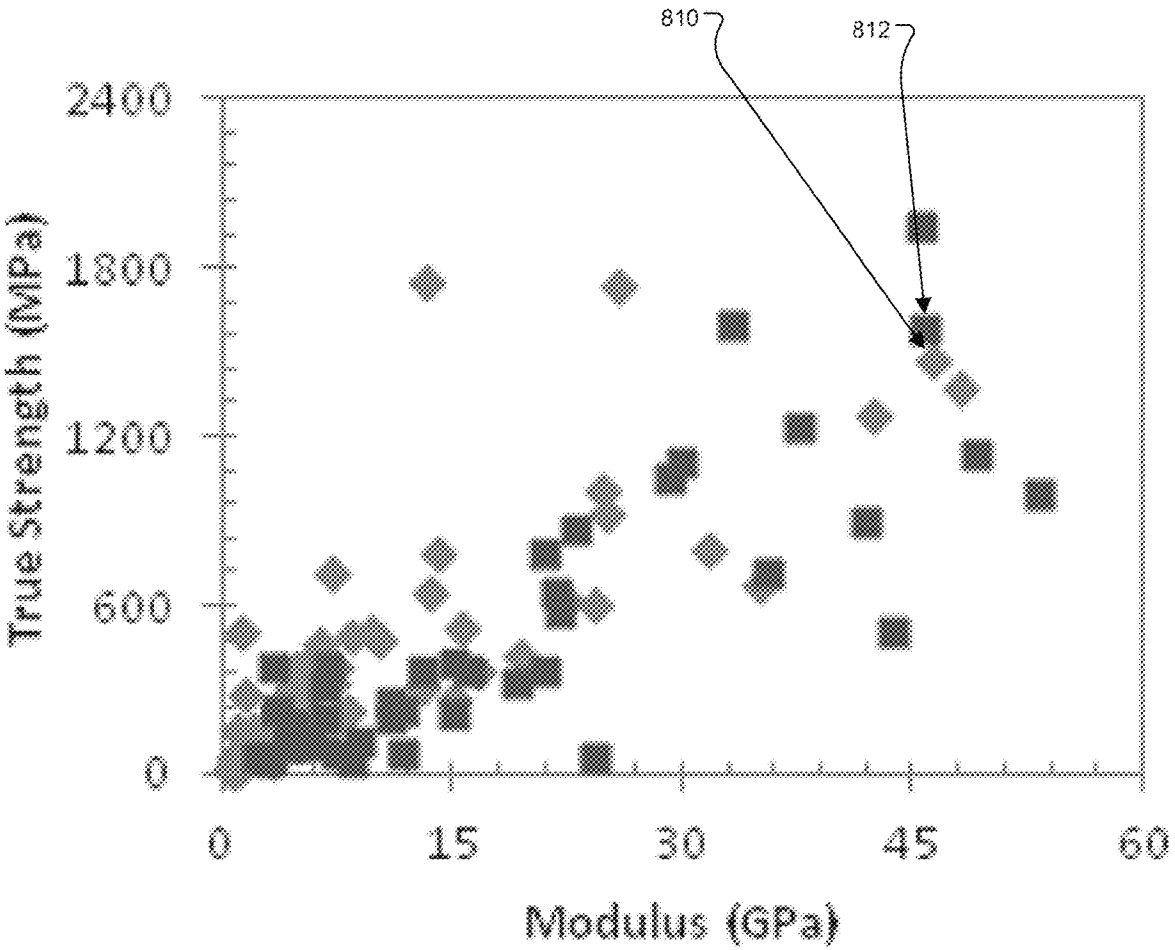
Figure 8E:
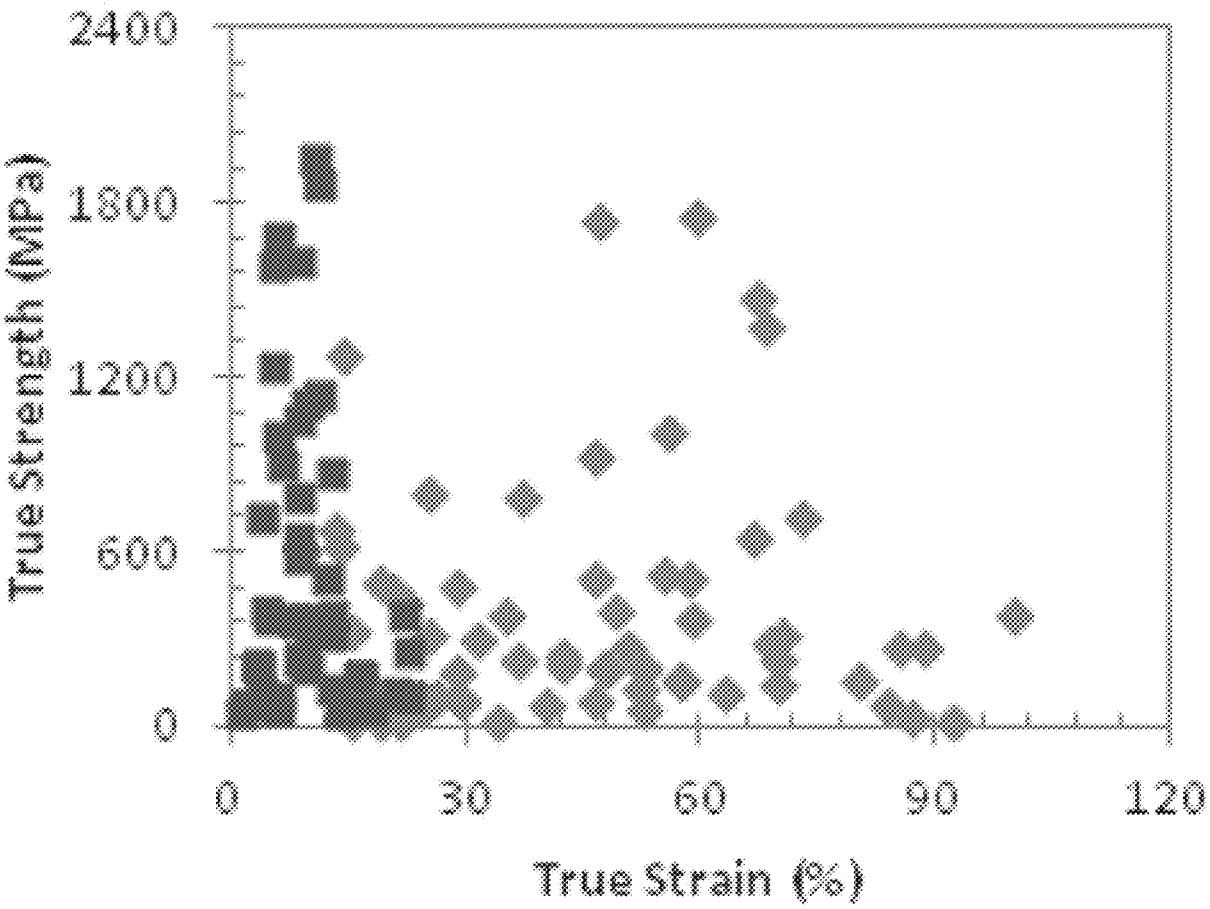
Figure 8F:
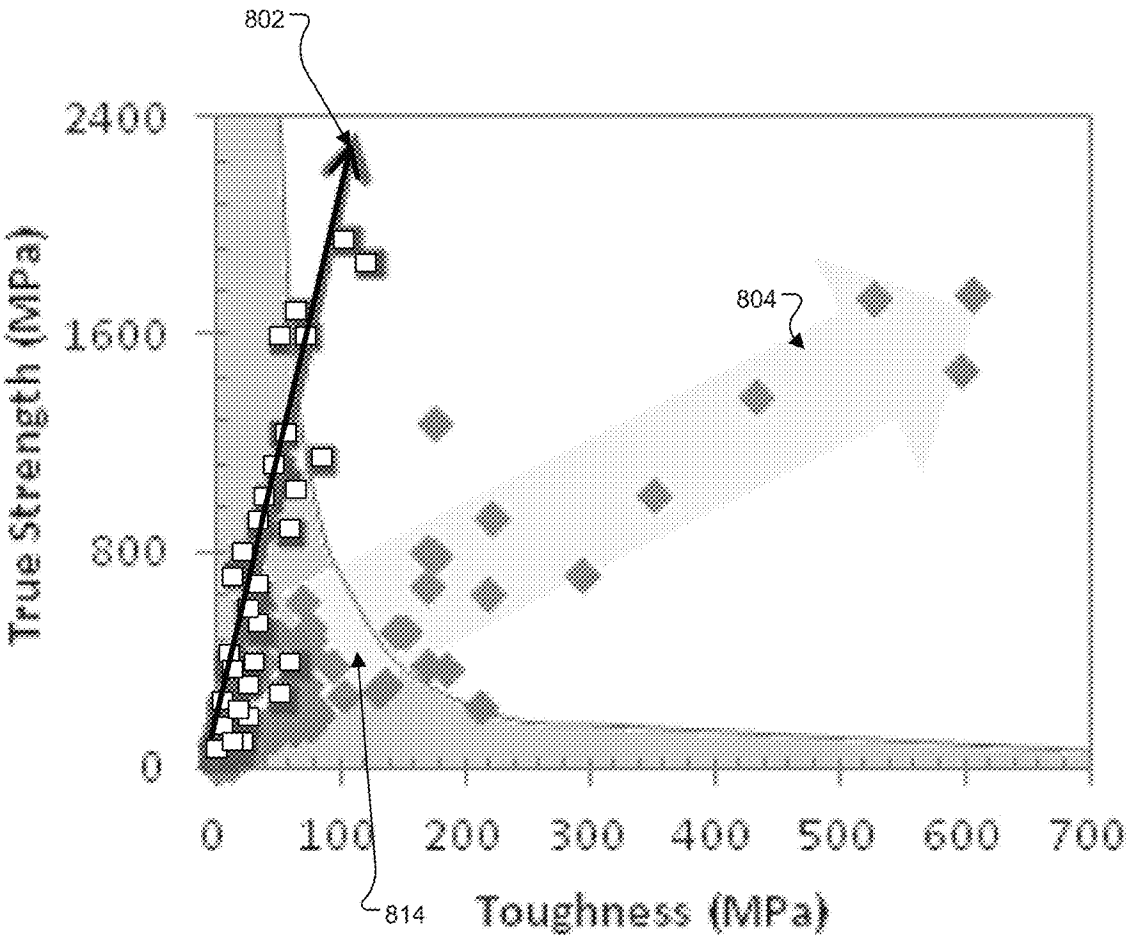

FIGS. 8A-8F illustrate graphs of correlations of mechanical properties of nanofibers of different diameters. In particular, FIG. 8A illustrates true strength versus modulus for an as-spun nanofiber; FIG. 8B illustrates true strength versus true strain to failure for an as-spun nanofiber; FIG. 8C illustrates true strength versus toughness for an as-spun nanofiber; FIG. 8D illustrates a comparison between as-spun (diamonds) and annealed (squares) nanofibers for true strength versus modulus; FIG. 8E illustrates a comparison between as-spun (diamonds) and annealed (squares) nanofibers for true strength versus true strain to failure; FIG. 8F illustrates a comparison between as-spun (diamonds) and annealed (squares) nanofibers for true strength versus toughness. The arrows 802 and 804 in FIG. 8F point in the directions of decreasing nanofiber diameters.

A relatively good correlation (within typical high scatter in fiber studies) was observed for strength and modulus (806 and 808) in both as-spun and annealed nanofibers (see FIGS. 8A and 8D; computed coefficients of determination r2=0.65 and 0.76, respectively). In some materials, the strength-modulus correlation is generally expected and is often observed in structural materials and fibers as a result of processes aimed at material strengthening. Interestingly, the data for the as-spun 810 and annealed 812 nanofibers overlap as seen in FIG. 8D, indicating that relative stiffening of the annealed nanofibers occurred simultaneously with their strengthening. The observed correlation supports macromolecular chain orientation as the mechanism responsible for improvements in both modulus and strength. The strength-failure strain plots (FIGS. 8B and 8E) did not show any correlation (the slope of the regression curve was not statistically different from zero at $\alpha$=0.05 confidence level) and the strain at failure was randomly distributed across the strength range for both nanofiber systems. Unusually, strong correlation was observed for strength and toughness (see FIGS. 8C and 8F; r2=0.82 and 0.77 for the as-spun and annealed nanofibers, respectively; the arrows in FIG. 8F point in the direction of decreasing nanofiber diameters). The observed strong strength-toughness correlation is unique in structural materials. Although some biological composite materials, such as spider silk, through their hierarchical structure, attain simultaneously high strength and toughness, most engineering materials exhibit strength-toughness trade-off, revealing that high strength is usually achieved at low toughness and vice-versa (see area 814 in FIG. 8F).

In general, processing techniques that improve the strength of the originally ductile materials, such as metals or semi-crystalline polymers, cause the material parameters to move from the bottom right to the top left corner of the strength-toughness diagram. This applies to such widely used processes as drawing of polymers and metals, and to newer processes, such as nanostructuring of metals. High-performance fibers also follow this trend, all exhibiting high tensile strength but relatively low toughness. Reaching the upper right corner of the diagram in FIG. 8F is highly desirable for safety-critical applications requiring both high strength and fracture resistance. Demonstrated consistent shift of the properties of as-spun electrospun nanofibers toward the upper right corner with the reduction of diameter is encouraging. While annealed nanofibers exhibited lower toughness compared to as-spun PAN nanofibers, their strain at failure still did not appear to decrease with the decrease of diameter (and corresponding increase in strength), resulting in steeper but still positive correlation between toughness and strength (FIG. 8F). Moreover, multiple regression analysis shows that the slope of the strength-toughness correlation for the annealed nanofibers is decreasing for higher strength values indicating a larger toughness increase. This suggests that change of crystallinity via annealing or other methods can be used to alter nanofiber properties and provides the means to expand the coverage of the strength-modulus-toughness performance space. Note that the highest toughness of annealed nanofibers was still in the range of the toughness values of spider silk. Compared to spider silk, the best annealed nanofibers had lower strain at failure but higher strength—a property combination that may be useful for ballistic applications.

The magnitudes of the mechanical improvements in the current study are among the strongest size effects recorded for any material. While most fibrous materials exhibit increases in strength with diameter decrease (observation of diameter-dependence of strength in glass fibers triggered the development of modern fracture mechanics theory), these increases usually are moderate (tens to hundreds percents). Reduction of as-spun PAN nanofiber diameter from 2.8 micrometers to about 100 nanometers resulted in simultaneous increases in modulus from about 0.36 GPa to about 48 GPa and true strength from about 15 MPa to about 1750 MPa, both increasing by more than 10,000%. In addition, and contrary to the typical embrittlement of the strengthened structural materials and fibers, PAN nanofiber exhibited simultaneous increase of toughness from about 0.25 MPa to about 605 MPa, that amounts to 240,000% increase.

Continuous Carbon Nanofibers

In some implementations, continuous polymer nanofibers can be further converted into carbon nanofibers (CNFs). PAN is one of the popular polymer precursors for carbon fibers due to its high carbon yield and good mechanical properties of the resulting carbon fibers, but a number of other polymers can also be used as precursors. A typical process involves polymer precursor stabilization (e.g. oxidation of PAN precursor fiber) followed by carbonization. Initial orientation and mutual arrangement of the polymer chains in the precursor nanofibers and their preservation during stabilization and carbonization processes are paramount for the structure and orientation of the resulting carbon fiber and have major effect on carbon fiber properties. Currently, carbon fibers with exceptional strength from about 3 GPa to about 7 GPa and diameters from about 4.5 micrometers to about 7 micrometers have been developed. However, all existing carbon fibers are brittle with strain to failure in the range from 0.5-2%.

Continuous carbon nanofibers were produced from PAN polymer precursors fabricated by the methods described above. Precursor nanofibers were oxidized and carbonized at low carbonization temperature. Nanofiber mechanical properties were measured using technique similar to the described above for PAN nanofibers.

FIGS. 9A-D show variation of carbon nanofiber strength, modulus, strain at failure, and toughness plotted as a function of nanofiber diameter. The levels of properties for a popular commercial AS4 carbon microfiber are shown for comparison. The results show dramatic simultaneous improvements in strength, modulus, and toughness of carbon nanofibers with the decrease of their diameter. Best nanofibers rival the strength of best commercial carbon fibers while being 5 times tougher. Similar to the polymer precursor nanofibers, no saturation of size effects was observed in the diameter range studied.

Figure 9E:
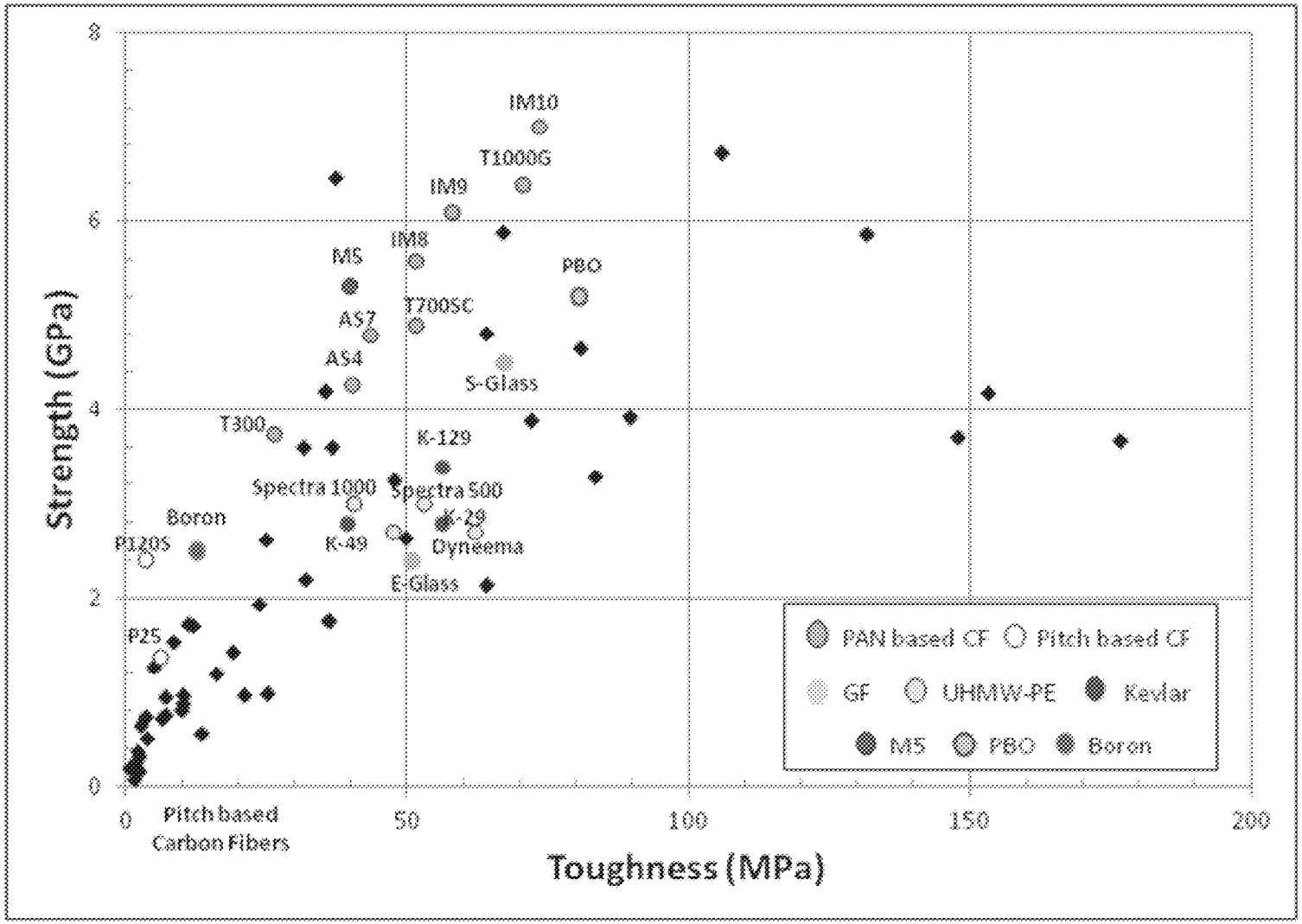
FIGS. 9A-9S illustrate mechanical properties and structure of continuous carbon nanofibers.

FIG. 9E shows strength-toughness correlation for electrospun PAN-based nanofibers and comparison with best carbon, polymer, glass, and metal fibers. Best CNFs exceeded the strength of all but a few commercial carbon fibers. Uniquely, best CNF toughness was 3-4 times higher than the toughness of Kevlar and M5 fibers and twice the toughness of PBO fiber. The later polymer fibers are typically considered the toughest structural fibers developed.

FIGS. 9F-K show stress-strain diagrams and failure modes of individual CNFs. The results demonstrate ultrahigh failure strains for strong fine carbon nanofibers (typical carbon fiber failure strains are below 1.5%). The maximum recorded CNF failure strain was the world record strain for a high-performance carbon (9%). CNF fracture surfaces showed rough, angular fractures with no evidence of brittle mirror. Reduction of visible fracture-causing defects in fine CNFs appears to confirm the classical size effect mechanism of strength.

FIG. 9L Shows structural parameters extracted from XRD and Raman analyses of CNF bundles, compared to commercial carbon fibers. One can see a relatively poor graphitic structure of CNFs compared to commercial carbon fibers.

FIGS. 9M-S show results of electron diffraction (SAED) analysis of structure of individual CNFs as a function of their diameter. The results indicate ultrasmall graphitic crystal structure with orientation gradually improving with diameter reduction. Improved orientation contributes to the observed increases in modulus and strength of CNFs. Large interplanar distances relatively independent of diameter confirmed generally poor graphitic structure of CNFs. The latter is likely responsible for large strains to failure and uniquely high toughness of carbon CNFs.

HRTEM observations confirmed ultrasmall (3-4 graphitic planes) graphitic crystals with preferential orientation along CNF axis. Direct measurement of interplanar distances confirmed poor structure observed by SAED. Diffractograms obtained by FFT of HRTEM images of CNF showed mostly amorphous structure with orientation along the fiber axis. The maximum of the interlayer spacing was in the range from 3.6-4.1 A further confirming poor graphitic structure.

The results of carbon nanofibers analysis allow one to link the unusual CNF mechanical properties to their structure in a manner similar to the links made earlier for polymer nanofibers. The high CNF strength and modulus are due to the improved orientation of their nanocrystalline structure and reduction of size and quantity of defects with diameter reduction, while increased failure strain is due to relatively poor crystalline (graphitic) structure. The CNF structure can be linked to the structure of the polymer precursor nanofibers fabricated by the methods described in this application. In addition, the observed generally poor graphitic structure is likely to be due to non-optimized off-the-shelf commercial polymer precursor and low carbonization temperature.

Preservation of Polymer Chain Orientation in Carbon Nanofibers During Oxidation and Carbonization One advance in carbon fibers was the discovery of the method to preserve orientation of polymer chains in the precursor fiber during stabilization (oxidation) and carbonization. This preservation is typically accomplished by stretching polymer precursor filaments during carbon fiber manufacturing. A simplest preservation technique is to constrain precursor fibers from shrinking during stabilization and oxidation (equivalent to a stretch of a filament that would otherwise become shorter due to entropic and chemical shrinkage), with constraint during stabilization being the most important.

In the CNF experiments described above, individual nanofibers were constrained during their stabilization and carbonization by maintaining their constant length (which is equivalent to applying a stretching force). Application of such stretch or constraint, while possible on individual or highly oriented nanofibers, is impossible on the typical random nanofiber sheets or mats, resulting from jet instabilities in electrospinning. It is also impossible in various random and regular 2D and 3D nanofiber assemblies such as membranes, layered structures, fabrics, yarns, and arrays that can be produced using integrated on-line or post-processing manufacturing methods.

Unconstrained precursor nanofibers will shrink during stabilization and carbonization that will cause them to loose (or reduce) polymer chain orientation, resulting in poor carbon structure orientation and poor properties.

One way to improve polymer chain orientation in precursor nanofibers and to preserve this orientation during oxidation and carbonization is by incorporating small inclusions into nanofibers that can orient along the nanofiber axis during electrospinning. Such inclusions can cause additional polymer chain alignment during electrospinning. Attachment or anchoring of polymer chains on the aligned inclusions will provide the necessary constraint during stabilization and carbonization, thus improving carbon nanofiber structure and properties. Nanoparticles of materials compatible with the final nanofiber type (for example nanoscopic carbon allotropes for carbon nanofibers or small diameter whiskers for respective ceramic nanofibers) can also assist the growth of desired atomic or molecular arrangements and morphologies.

Any small inclusion capable of orienting in the electrospinning jets can be used. These include any nanorod or nanoneedle, whisker, carbon or other nanotube or nanotube assembly or bundle, nanoparticle chain, nanoplatelet such as individual graphitic sheet (graphene) or small stacks of sheets (graphitic nanoparticles), and others. Platelets can be oriented preserving their 2D morphology. Thin platelets such as graphene can be anisotropically crumpled and oriented in the direction of the fiber. Crumpling can further increase polymer anchoring. Interaction of particles with polymer chains and chain anchoring on particles can be facilitated by chemical or physical treatment of nanoparticles. It is expected that significant anchoring and orientation preservation can be achieved with a small quantity of nanoparticles added.

The described approach to preserve polymer orientation to improve structure and properties of carbon fibers can be used with any polymer precursor. It is not restricted to electrospun nanofibers and can be used on other small diameter fibers such as melt-blown nonwovens and others. It can be also used on conventional microfibers.

A similar approach can be used with precursors of ceramic nano and micro fibers to improve their orientation and properties. Ceramic fibers are typically produced by applying thermal treatments to polymer or sol-gel precursors.

Example A

Improved Graphitic Structure and Orientation of Continuous Carbon Nanofibers Via Incorporation of Graphene Oxide In some implementations, the processes and methods described in this disclosure can generate carbon nanofibers (CNF) using a combination of PAN polymers and graphene oxide (GO). Such a combination may improve graphitic structure of fibers generated from the combined material. In general, continuous carbon nanofibers (CNF) present an attractive building block for a variety of nanostructured materials and devices. Continuous nanofibers were prepared from polyacrylonitrile (PAN) with 1.4% GO nanoparticles by electrospinning, stabilized, and carbonized at 800° C., 1200° C., and 1850° C. The GO/PAN nanofibers exhibited significantly reduced polymer crystallinity. Raman analysis showed that both templating and increase of carbonization temperature improved graphitic order in CNFs. The effect of GO may be larger at higher carbonization temperatures. Select area electron diffraction analysis of individual nanofibers revealed an increased graphitic order and orientation both in the vicinity of visible GO nanoparticles and outside. The results indicate a possibility of global templating in CNFs with a small addition of GO nanoparticles that can provide an inexpensive new route to continuous nanofibers with improved structure and properties. Observed anisotropic GO crumpling in electrospun jets may be beneficial for carbon templating and other applications.

Continuous carbon nanofibers are typically produced by carbonization of electrospun polymer precursors, such as PAN precursors. Intensive electrical forces coupled with electrohydrodynamic instabilities may be responsible for ultrathin nanofiber diameters that can range from single nanometers to microns. In general, higher orientation of PAN precursor results in better carbon fibers. A direct correlation can be seen between the elastic modulus of PAN precursor fibers and the modulus of carbon fibers. As described above, polymer chain orientation can be improved by incorporation of oriented inclusions with high surface area. Carbon-based nanoinclusions may be especially beneficial as they may simultaneously serve as a nucleating or templating agent for carbon structure formation during carbonization.

The following paragraphs describe analysis of using graphene oxide (GO) as a possible carbon templating/orientation agent for improvement of continuous carbon nanofibers (CNFs). PAN nanofibers modified with a small quantity of GO were produced and characterized by SEM and wide-angle X-ray diffraction (XRD). Nanofibers were stabilized and carbonized and their graphitic structure and orientation were evaluated by Raman spectroscopy and electron diffraction (ED). The results were compared with pristine PAN nanofibers and CNFs.

Nanofibers were electrospun from a 10%/0.142% wt/wt dispersion of PAN/GO in dimethylformamide (DMF) from 20 cm spinneret-collector distance at 12 KV, using a 0.6 ml/h feed rate and 20 ga needle. The above weight ratio resulted in 1.4% weight fraction of GO in PAN. Note that the weight fraction of GO in carbonized nanofibers was higher due to the weight loss of PAN during oxidation and carbonization. The exact weight loss was not known so, for simplicity, both PAN and carbon nanofibers containing GO were labeled as 1.4% GO nanofibers. Templated polymer and carbon nanofibers were compared with pristine PAN and carbon nanofibers produced under similar conditions (10% wt/wt solution of PAN in DMF).

The nanofibers containing the GO nanoinclusions was slightly thinner than the pristine PAN nanofibers but exhibited occasional thicker regions that contained larger GO particles. Closer examination of these regions showed crumpled GO inclusions incorporated in PAN matrix. Such crumpling is not unusual for exfoliated graphene sheets that have been shown to bend and fold easily into various shapes depending on substrate or temperature and that were also shown capable to roll spontaneously into scrolls under particular conditions. Crumpling of GO particles inside nanofibers may be caused by radial forces in the fast thinning electrospun jets. Note that crumpled GO particles were all still covered by PAN. Nanofiber regions between the thicker regions with visible GO particles had uniform diameters with relatively little variation between different fibers as opposed to a broader distribution of diameters and generally thicker nanofibers in the case of pristine PAN nanofibers. Smaller nanofiber diameters may be due to higher solution conductivity in the presence of GO particles.

FIGS. 10A-C illustrate graphs of XRD diffractograms of neat PAN and 1.4% GO/PAN samples and polyacrylonitrile XRD crystallinity and crystal size for neat PAN and 1.4% GO/PAN samples. Significant reduction of PAN crystallinity in the presence of GO is in contrast to the effects typically reported for CNT. Increase in glass transition temperature may indicate reduced macromolecular mobility as a result of strong polymer-graphene interaction over extensive interfacial area. Note that the surface area of GO accessible for interaction with PAN did not necessary decrease with crumpling, unless GO layers folded onto themselves to form a more or less tight stack. No such stacks were observed in the electrospun nanofibers. Strong polymer-inclusion interaction and reduced chain mobility can be expected to result in lower polymer crystallinity.

Analysis of carbon fibers literature shows that PAN crystallinity does not usually play a major role in carbon fiber stabilization and carbonization. In fact, co-monomers that are typically used in PAN precursors of commercial fibers usually reduce PAN fiber crystallinity, yet result in carbon fibers with better structure and properties. Both amorphous and crystalline regions are well oriented along the fiber axis. The clearly visible (statistical) axial symmetry may be the result of nanoparticle orientation by the shear forces in the electrospun jets (particle normal is oriented perpendicularly to the jet axis) followed by radial crumpling. In this case, polymer molecules in the vicinity of the crumpled particles can still maintain and even further increase their preferred orientation along the fiber axis. Their simultaneously reduced mobility can help preserve this orientation during stabilization and carbonization.

In operation, nanofiber mats were stabilized in air at 270° C. and carbonized at 800° C. and 1200° C. under nitrogen atmosphere, and at 1850° C. under vacuum at the heating rate of 10°/min and dwell time 1 hour. After carbonization, the samples were examined using TEM and Raman spectroscopy. TEM imaging showed that anisotropic crumpled morphology was preserved during carbonization. Select area electron diffraction (SAED) from the same spot didn't show any 3D crystalline order, confirming full exfoliation and random nature of radial GO particle crumpling, as opposed to more regular folding or scrolling. The anisotropic, statistically axisymmetric nature of crumpling is clearly visible. Raman spectra of neat and templated nanofibers carbonized at different temperatures are compared in FIGS. 11A-C. The spectra show significant difference as a result of small addition of GO nanoparticles. D and G bands were fitted using Lorentzian curve shape and the integrated intensities ID and IG and the width of G bands were calculated. For every fiber mat, an average and standard deviation for measurements in five different places on the mat were calculated. In addition, the width of the G band can be used as an indicator of the level of graphitization of the fibers (smaller G band width indicates better graphitic structure). The 1.4% GO/PAN sample showed improved graphitic structure as indicated by smaller R and FWHM of the G band. The graphitic structure further significantly improved for both samples at higher carbonization temperatures, with 1.4% GO sample showing greater improvement. Both XRD and Raman analyses of nanofibers exhibited significant changes in the structure of polymer precursor and resulting carbon nanofibers as a result of addition of a small amount of GO nanoparticles.

Structure of PAN and GO/PAN nanofibers carbonized at different temperatures was also examined by electron diffraction analysis (FIGS. 11G-I). In the case of templated nanofibers, both nanofiber regions containing visible, larger GO nanoparticles and uniform nanofiber regions without visible nanoparticles were analyzed and compared. At least 5 experiments were performed for each type of material, carbonization temperature, and the nanofiber region. Analysis of the results showed that templating led to significant improvements in graphitic structure of CNFs as seen in more pronounced 002 and 100 diffraction intensities. The SAED of the 1.4% GO samples was qualitatively similar in the regions with visible GO particles and areas where no such particles were observed for all carbonization temperatures indicating apparent global nature of the templating effect. Analysis of pristine samples showed that there was no significant improvement of graphitic structure in samples carbonized at 1200° C. (compared to 800° C.), while there was a marked improvement for further increased carbonization temperature. In contrast, the 1.4% GO samples showed significant improvement for the intermediate carbonization temperature and further improvement for 1850° C. This result is consistent with the Raman results discussed above.

In addition to crystal size and quality, crystal orientation may be a possible parameter contributing to increased mechanical and other properties of carbon fibers. Crystal orientation was examined in pristine PAN and 1.4% GO/PAN nanofibers carbonized at 800° C. and 1850° C., as shown in FIGS. 11J-0. In the case of templated CNFs, both regions with and without visible GO nanoparticles were evaluated. Average FWHM values and standard deviations were computed based on the analysis of 5-20 scans for each specimen type. The standard deviations for PAN at 800° C. is 84+/−1.7 and for 1850° C. is 77+/−2.6. The standard deviations for 1.4% GO visible particle 800° C. is 61+/−3.4 and for 1850° C. is 64+/−3.1. The standard deviations for 1.4% GO with no visible particle at 800° C. is 65+/−3.1 and for 1850° C. is 65+/−2.9.

Analysis of SAED data shown in FIGS. 11J-O illustrates that all CNF specimens exhibited preferred orientation of the 002 planes parallel to the fiber axis. The degree of this orientation as expressed by the 002 double angle was higher in the templated CNFs. A two parameter factorial analysis of the 002 double angles showed no statistically significant difference (at $\alpha$=0.05 confidence level) between the orientation in thicker areas with visible GO particles and the thinner ones without visible GO. Both regions in the templated CNFs had better orientation than pristine PAN CNFs. Interestingly, structural orientation in the CNFs was roughly independent of carbonization temperature.

The above results show apparent global improvement in carbon nanofiber graphitic structure and orientation as a result of small addition of GO nanoinclusions. The results also indicate apparent acceleration of the graphitization process in the presence of GO particles at intermediate carbonization temperatures. These effects can be the result of axial propagation of the templated graphitic order nucleated by larger GO particles. Alternatively, they can be due to the presence of smaller GO particles in the thinner CNF regions. Although there is no definitive evidence at this time, we believe that the latter is a more likely scenario. A large number of smaller particles are generally present in the nanofibers. These particles are likely to experience similar orientation and crumpling forces, so there may be multiple radially crumpled smaller nanoparticles distributed within the CNFs (crumpling process is complex and may dependent on peculiarities of inhomogeneous solvent evaporation and flow profiles in electrospun jets, however that should not affect the overall crumpling tendency and axial symmetry). These distributed nanoparticles can then be responsible for the observed near-uniform CNF templating evidenced by SAED. Overall, the combination of XRD, Raman, and SAED data indicate possible global templating in electrospun nanofibers as a result of small GO additive. This observation is consistent with strong changes in structure and properties of graphene nanocomposites observed at very low graphene concentrations.

In some implementations, fiber constraint during stabilization can be used to prevent PAN fiber shrinkage. The constraint prevents fast entropic PAN fiber shrinkage and loss of orientation in the non-crystalline regions that can lead to defect formation in these disordered regions and reduced carbon fiber strength. Interestingly, no external mechanical constraint was applied during stabilization in our experiments. At the same time, XRD evidence of significant crystallinity reduction in the presence of GO nanoparticles indicated that it was most likely the amorphous phase that interacted with GO particles. Crystallization of PAN was disrupted by the irregularly shaped crumpled inclusions. Despite the observed increase in the amorphous phase content and the lack of constraint during nanofiber stabilization and carbonization, Raman and SAED data indicate that the graphitic structure and orientation of GO-modified carbon nanofibers were significantly improved. We speculate that anchoring of polymer chains on GO surface could play a role of the traditional mechanical constraint (applied usually through stretch). This anchoring prevented polymer shrinkage and loss of orientation in the beginning of the stabilization process. Irregular crumpling might have further helped anchoring via mechanical interlocking.

Large voids in the PAN-based fibers graphitized at high temperatures are formed when growing ordered graphitic regions "consume" their neighboring disordered regions. These voids are detrimental to fiber strength and are the main reason for the classical strength-modulus trade-off in carbon fibers. Void formation in the templated nanofibers can be reduced as the graphitic structure evolution progresses via continuous growth in the direction perpendicular to the nanoparticle surface. Other void formation mechanisms in carbon fibers, such as inadequate oxygen diffusion or entrapment of gaseous products during stabilization and carbonization reactions, will be alleviated in CNFs by the small nanofiber diameter. Better graphitic structure and orientation with fewer voids may lead to simultaneous improvements in modulus and strength of carbon nanofibers.

In general, incorporation of small amount of GO was shown to have beneficial effect on CNF graphitic structure and orientation. Experimental results indicate possible global improvement of orientation and templating. The observed dramatic effects were achieved at relatively low carbonization temperatures. Coupled with the low cost and ultrasmall quantity of the templating agent and the low cost of the top-down electrospinning process, these results can lead to new ultralow-cost processes and materials with improved graphitic structure and simultaneously high mechanical and transport properties.

Example B

Improved Graphitic Structure and Orientation of Continuous Carbon Nanofibers Via Incorporation of Double Wall Carbon Nanotubes In some implementations, the processes and methods described in this disclosure can generate continuous nanofibers using a combination of PAN polymers and carbon nanotubes, such as double wall nanotube bundles (DWNT). In general, carbon nanotubes can be used as a reinforcing element in high-performance composites and fibers at high-volume-fractions. However, problems with processing of such fibers, as well as alignment, and non-optimal stress transfer have so far prevented full utilization of the superb mechanical properties of carbon nanotubes. The following description includes an alternative use of carbon nanotubes, at very small concentration, as a templating agent for formation of carbon structure in fibers. The method includes manufacturing continuous carbon nanofibers (CNF) from polyacrylonitrile (PAN) with 1.2% wt/wt of double wall nanotube bundles (DWNT) by electrospinning. Fine, axially-aligned DWNT bundles are shown in the nanofiber cross-sections. XRD and Raman analyses showed decreased PAN crystallinity in as-spun templated nanofibers, with respect to pristine PAN fibers, and increased graphitic order and crystal size in nanofibers carbonized at 800° C. Select area electron diffraction (SAED) evaluation revealed significantly increased orientation of graphitic basal planes in templated CNFs. Unlike pristine PAN nanofibers, orientation in templated CNFs was less diameter dependent.

Raman analysis was performed for CNFs carbonized at different temperatures from 600° C. to 1850° C. revealed the largest templating improvements at lower temperatures. Graphitic order parameters in the templated CNFs carbonized at 1000° C. exhibited structure similar to the one achieved in the non-templated CNFs at 1850° C. The obtained results indicate that global improvement in orientation/templating of graphitic structure in fine CNFs can be achieved at very small concentrations of well-dispersed DWNTs. The outcomes reveal a simple and inexpensive route to manufacture continuous CNFs with improved structure and properties for a variety of mechanical and functional applications. The demonstrated significant improvement of graphitic order at low carbonization temperatures in absence of stretch shows promise as a potential new manufacturing technology for next generation carbon fibers.

Manufacturing techniques that produce neat or near-neat nanotube fibers and yarns can include (i) spinning from surfactant-stabilized nanotube solutions with subsequent coagulation in polymer solution flow, (ii) super-acid solution spinning, (iii) direct solid-state spinning from nanotube aerogels formed in a CVD reactor, (iv) solid-state spinning from vertically grown nanotube arrays or forests, and (v) twist-stretching CVD-grown nanotube ribbons. Often, the resulting fibers and yarns can be further impregnated with polymers or otherwise densified and post-processed. These high nanotube-fraction yarns and fibers are typically very lightweight (highly porous), even after densification. Such fibers demonstrated ultrahigh specific toughness and some also demonstrated high strength.

An alternative way to use nanocarbons in structural materials may be to utilize them in small quantities as catalysts or nuclei for directed crystallization or other structural transformations. Such applications can utilize ultrahigh specific surface area of nanotubes or graphene/GO and their potential strong interaction with surrounding materials. These templated materials could also be economically viable as the relatively expensive nanocarbons would be utilized in low quantities and their dispersion and processing would be significantly easier than in the case of high volume fraction materials. Strong nanocarbons could potentially deliver synergistic simultaneous structural improvements and reinforcement.

Carbon nanotubes have been shown to improve crystallization and chain orientation in polypropylene and PAN fibers. Graphene-polymer nanocomposites show dramatic reduction in glass transition temperature and improved mechanical properties at low graphene content.

An intriguing opportunity to achieve more significant property change presents itself in carbon materials, particularly carbon fibers. Carbon fibers are the strongest commercial material today and they dominate the advanced composites market. After four decades of development, their property levels appear to have reached saturation. Modern efforts are mostly focused on improved quality control and cost reduction. However, the incorporation of nanotubes or graphene into carbon fibers might change carbon structure and further improve properties. Nanocarbons are ideally suited as both reinforcement and possible structural change agent for carbon fibers. Incorporation of nanotubes in carbon microfibers has been shown to result in improved graphitic order and mechanical properties. However, good nanotube orientation is difficult to achieve in fibers with micrometer-size diameters.

The following figure descriptions discuss a comprehensive experimental study to explore the magnitude, extent, and mechanisms of graphitic structure and orientation evolution in double-wall carbon nanotube-modified CNFs. CNFs with a small quantity of DWNTs were nanomanufactured by electrospinning and their structure was characterized by a variety of methods. The results were analyzed and discussed in the context of commercial carbon fiber manufacturing and structure and it was shown that well-dispersed and well-aligned carbon nanotubes can guide polymer chain orientation, while also providing anchoring to the polymer chains during carbonization. Global nature of the observed improvements in the graphitic structure and orientation in the templated CNFs shows promise as a future carbon fiber manufacturing technology.

Figure 12A:
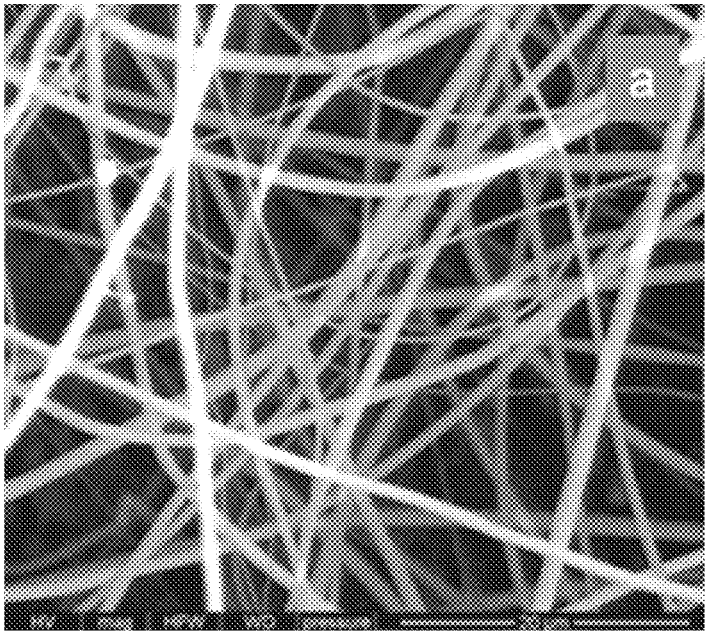
FIGS. 12A-B illustrate an example morphology of as-spun polyacrilonitrile (PAN) and 1.2% DWNT/PAN nanofibers
Figure 12B:
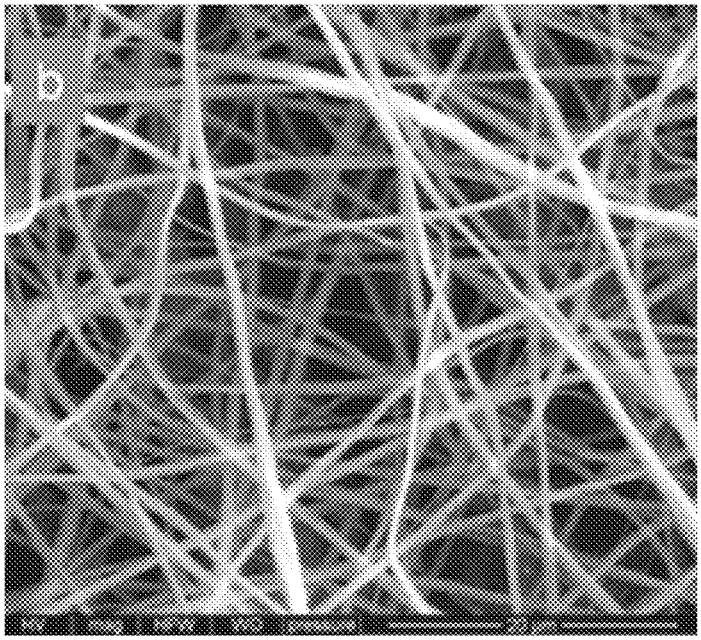

FIG. 12A-B illustrate an example morphology of as-spun PAN and 1.2% DWNT/PAN nanofibers. FIG. 12 C shows that both pristine PAN and 1.2% DWNT/PAN samples exhibited reasonably uniform, good quality nanofibers with similar diameter distributions. The diameter distribution for the 1.2% DWNT NFs was slightly broader (after measuring approximately 200 fibers in each sample) and had a small large-diameter peak that was absent in the pristine NF sample. To examine the DWNT distribution within the nanofibers, a carbonized templated nanofiber mat was broken and examined by SEM and TEM. In nearly all of the several tens of fracture sites imaged, the cross sections of the nanofibers contained a few pulled out DWNT bundles (as shown in FIGS. 12D-E). As shown, the DWNT bundles were well aligned along the CNF axis. As shown in FIG. 12E, most of the CNF cross-sections showed several fine DWNT bundles that appeared evenly distributed within the cross section. As shown in FIG. 12D, some of the CNF cross-sections exhibited slightly thicker bundles. Good DWNT distribution and alignment within the CNFs correlates with their good dispersion in DMF. The latter appears to be enhanced by the presence of organic functional groups on the surfaces of DWNT bundles and their favorable interaction with PAN molecules.

Figure 12C:
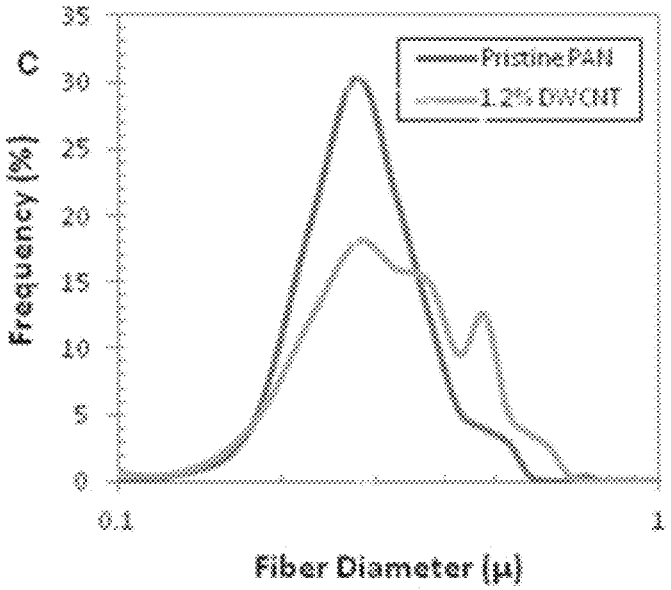
FIG. 12C illustrates diameter distributions for pristine PAN and 1.2% DWNT/PAN samples.
Figure 12D:
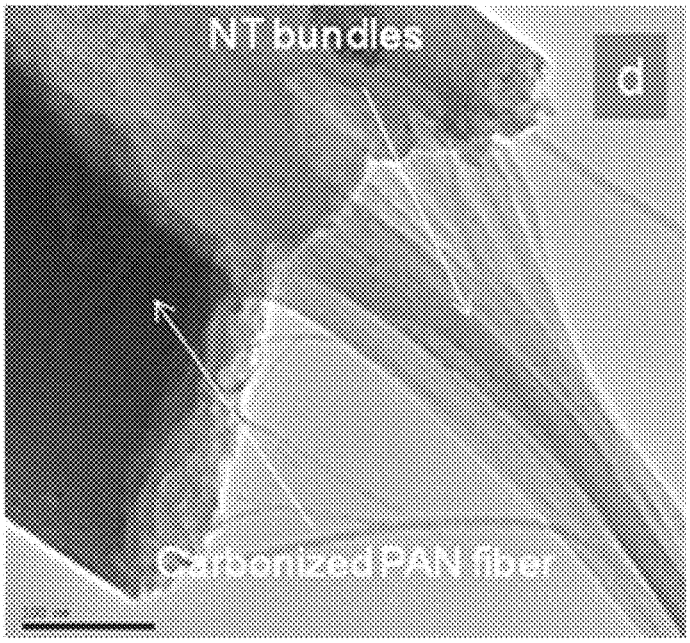
FIG. 12D illustrates a Transmission Electron Microscopy (TEM) micrograph of a broken edge of carbon nanofiber (CNF) with nanotube bundles.
Figure 12E:
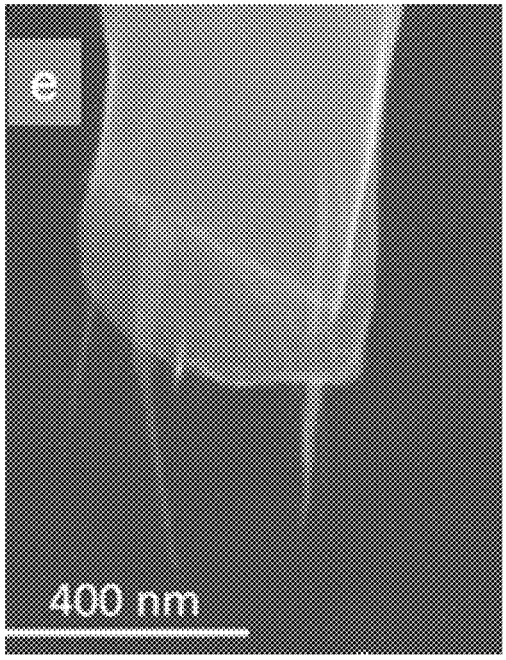
FIG. 12E illustrates Scanning Electron Microscopy (SEM) micrograph of the fracture surface of CNF.

FIG. 12C illustrates diameter distributions for pristine PAN and 1.2% DWNT/PAN samples (as measured from approximately 200 fibers). FIG. 12D illustrates a TEM micrograph of a broken edge of CNF with nanotube bundles. The pulled out DWNT bundles seemed to have uniform distribution along the length and within the cross section of the CNFs. FIG. 12E illustrates SEM micrograph of the fracture surface of CNF.

Figure 12F:
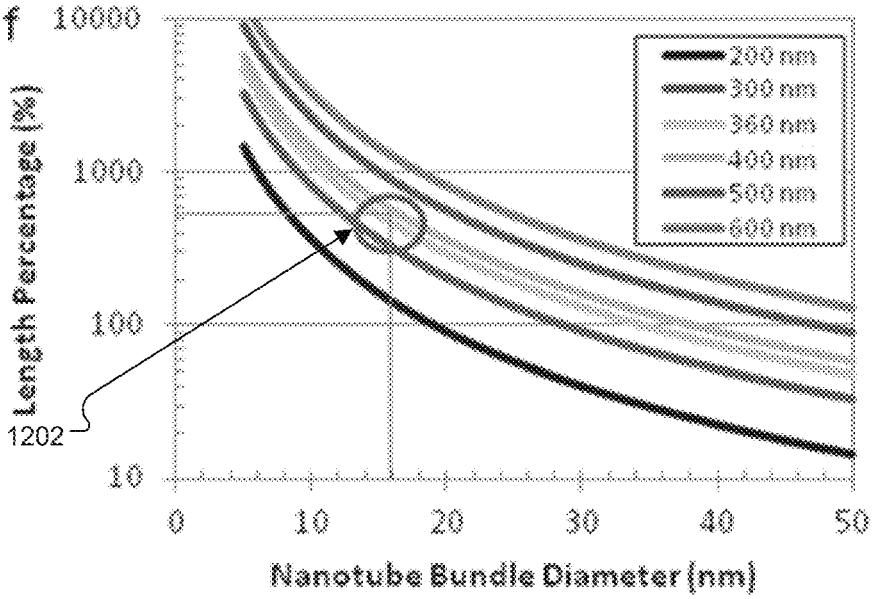
FIG. 12F illustrates length coverage (LC) of nanotube bundles in PAN nanofibers for different bundle and fiber diameters.

A theoretical calculation shows that the DWNTs cover the entire length of the electrospun nanofibers. The average percentage of the DWNT bundle length coverage in the precursor PAN nanofibers, LC, can be estimated as shown in equation (3) below:

$$LC = \frac{wt_{CNT}}{wt_{PAN}} \times \left(\frac{D_{PAN}}{D_{bundle}}\right)^2 \times \frac{\rho_{PAN}}{\rho_{bundle}} \tag{3}$$

where DPAN, Dbundle, pPAN, pbundle are the diameters and mass densities of the PAN nanofibers and the DWNT bundles, respectively (pPAN=1.2 g/cm$^3$, pbundle=1.575 g/cm$^3$). FIG. 12F illustrates length coverage (LC) of nanotube bundles in PAN nanofibers for different bundle and fiber diameters. The average fiber diameter measured for this sample was 360 nanometers and the typical bundle diameter measured was 16 nanometers, as shown by circle 1202.

Given the thermal stability of CNTs and their encapsulation in nanofibers, the length coverage is expected to remain the same during the carbonization process (as can be seen from the micrographs, e.g., FIGS. 12D and 12E, the nanotube bundles survived the carbonization process intact). Therefore, every given cross section of the bundles can be expected to be reinforced, on average, by a few bundles. This simple analysis is consistent with the fractographic investigations of CNF breaks.

Figure 13A:
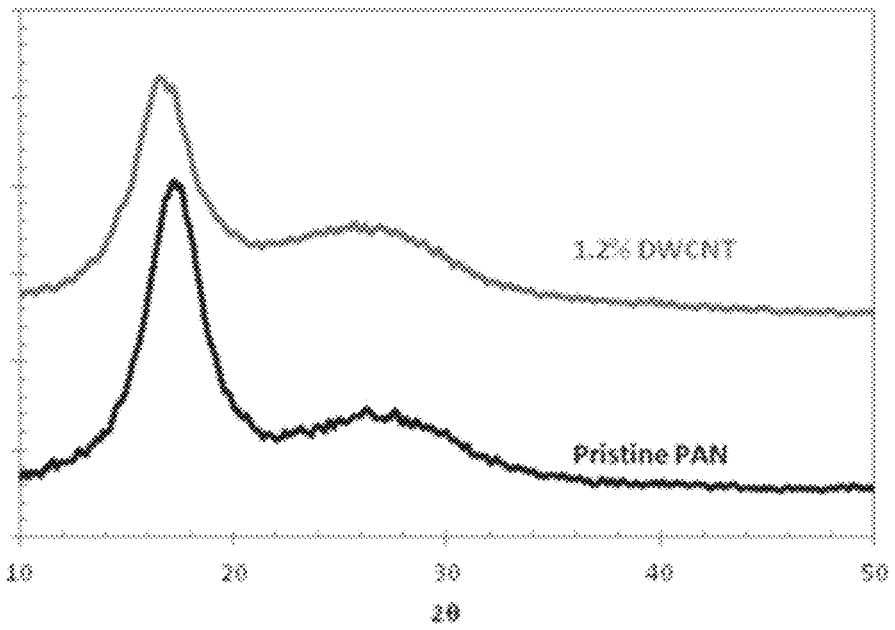
FIG. 13A-B illustrate an XRD analysis of as-spun nanofibers for a) XRD diffractograms of neat PAN and 1.2% double wall nanotube (DWNT)/PAN nanofibers and b) computed XRD crystallinity and crystal size for neat PAN and 1.2% DWNT/PAN.
Figure 13B:
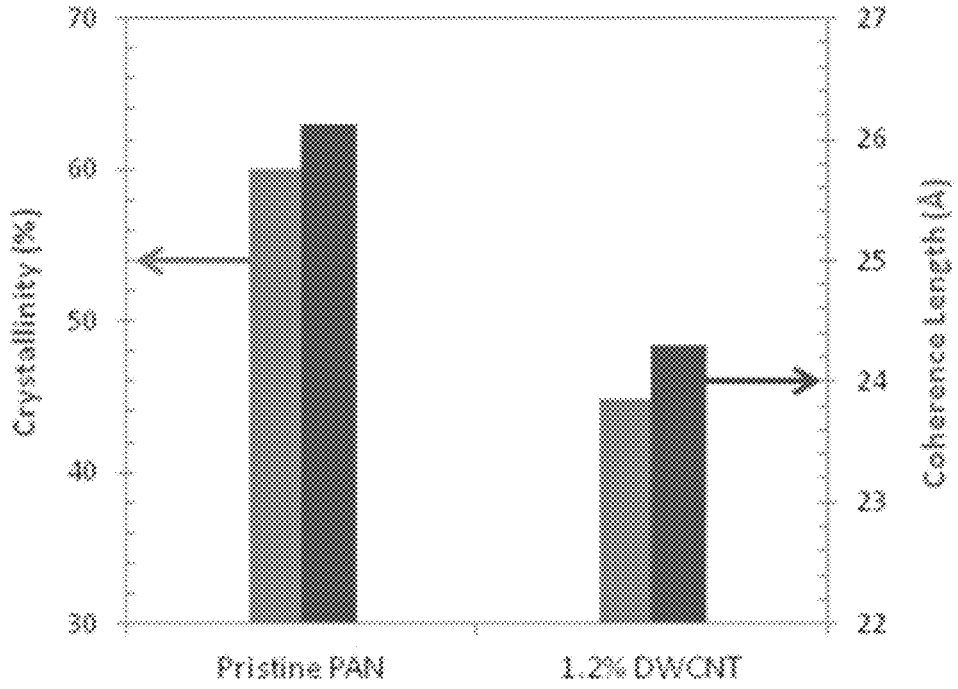

To understand the influence of polymer precursor on CNF structure, as-spun nanofibers were analyzed by X-ray diffraction. Resulting diffractograms are shown in FIG. 13A. The spectra exhibit a crystalline peak at 2θ~17.4° and a broad amorphous halo at approximately 2θ~26.9°, typical of semicrystalline PAN. The background was removed and the crystalline peak and the amorphous halo were fitted using Lorentzian peak shapes. The polymer crystallinity was evaluated by dividing the area under the crystalline peak by the total area under the curve. The coherence length (i.e., "crystal size") was calculated from the width of the main crystalline peak, using the Scherrer equation:

$$C.L.\ (\text{Å}) = \frac{K\lambda}{\beta \text{Cos}\Theta} = \frac{0.9 * 1.542}{\sqrt{(FWHM(\text{Rad})^2 - 0.002^2)}\ \text{Cos}\Theta} \tag{4}$$

where shape factor (K) was taken as 0.9, the λ is the standard wavelength for a copper source, 0.002 was the instrumental peak widening calculated based on a single crystal Si standard, and θ is the Bragg angle for the crystalline peak. The results shown in FIG. 13B indicate that both XRD crystallinity and average crystal size of PAN decreased in the presence of DWNTs.

Reduction of PAN crystallinity in the presence of DWNT can be explained by the reduced macromolecular mobility as a result of strong polymer-NT interaction. PAN crystallization could also be disrupted by the nanotube bundles. Reduced crystallinity results in a larger fraction of disordered or amorphous polymer chains that need to be constrained during stabilization and carbonization in order to achieve a well ordered structure in the of carbon fibers.

Figure 14A:
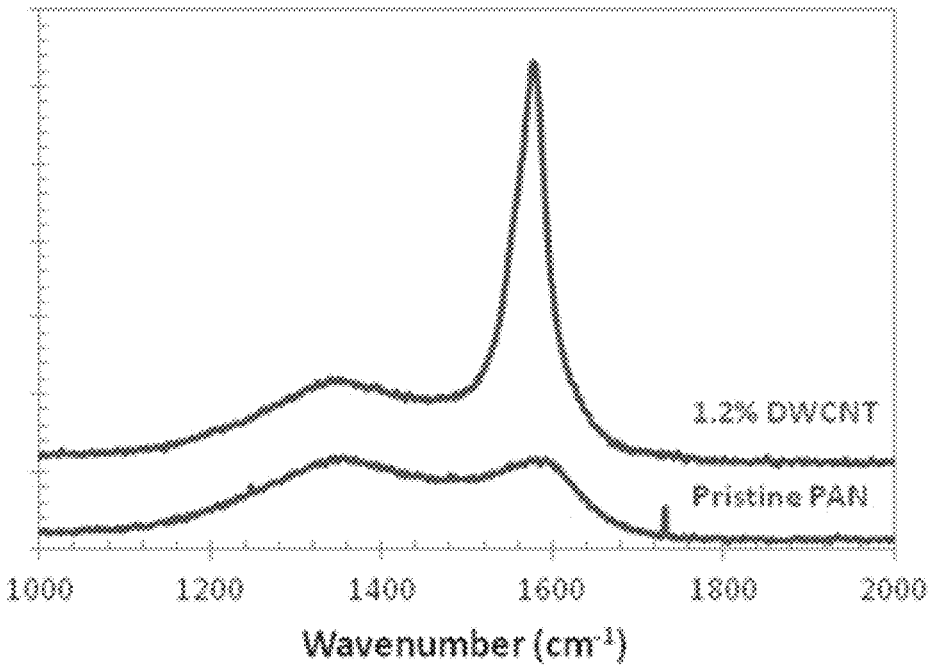
FIGS. 14A-B illustrate first order Raman spectra and XRD of pristine and templated carbon nanofibers.
Figure 14B:
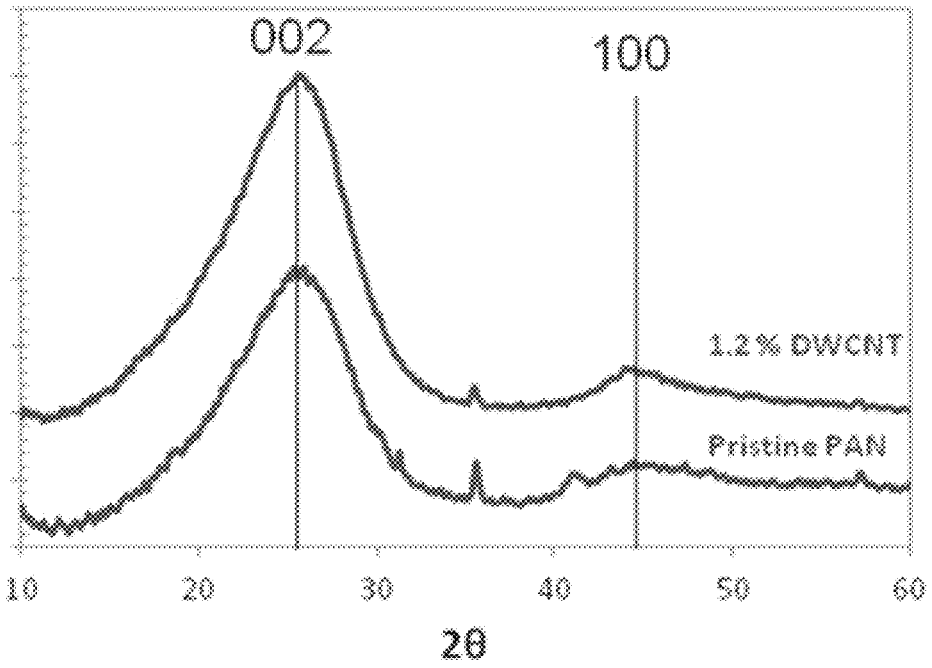

The graphitic structure of CNFs carbonized at 800° C. was investigated by XRD and Raman spectroscopy. First order Raman spectra of pristine and templated CNFs are shown in FIG. 14A. The spectra exhibited typical behavior for carbon materials, with a D band around 1358 cm$^{-1}$ and 1354 cm$^{-1}$, and G band around 1579 cm$^{-1}$ and 1572 cm$^{-1}$ for the pristine and the 1.2% DWNT samples, respectively. The spectra show a significant difference in relative peak intensities as a result of the addition of a small amount of DWNT. Raman spectrum of the 1.2% DWNT sample showed a pronounced G band, which was significantly stronger and sharper than the one for the pristine CNFs. The spectra for the templated CNFs were compared to the Raman spectra from uncarbonized PAN/DWNT samples (not shown). The uncarbonized samples exhibited a low wavenumber shoulder in the G band as well as a general shift in the G band towards higher wavenumbers (to approximately 1590 cm$^{-1}$). Both features are characteristic of a pure nanotube signal and both are not distinct after carbonization because the signal from newly formed, less perfect graphitic structures dominated the signal.

The D and G bands of the carbonized samples were fitted using Lorentzian curve shapes and the integrated intensities, ID and IG, and the width of G band were calculated. For every nanofiber mat, an average value and standard deviation were calculated based on measurements at five different locations on the mat.

Crystal structure parameters were formally extracted and are shown in FIG. 15. The 1.2% DWNT CNF sample showed improved graphitic structure as indicated by the smaller R and lower FWHM of the G band (see FIG. 15). Note, however that the spectrum for the DWNT-templated NFs included the intrinsic nanotubes' contribution that, although expected to be small, could not be separated from the overall signal of the templated CNF.

CNF mats carbonized at 800° C. were also examined by XRD in the range between 2θ=10 and 60° (shown in FIG.

14B). The diffractions showed broad 002 and 100 peaks, which became sharper for the 1.2% DWNT sample, indicating improvement in the graphitic structure. The calculated 002 spacings for both pristine and templated CNFs were typical for turbostratic graphite. Crystal sizes $L_c$ and $L_a$ evaluated using the Scherrer equation are shown in FIG. 15. While the $L_c$ remained similar for both pristine PAN and 1.2% DWNT samples (about 1 nanometer) and comprised 3-4 graphene layers, the $L_a$ increased by almost a factor of two for the 1.2% DWNT sample to approximately 2.9 nanometers. The latter was only 25% less than the corresponding crystal size reported for the commercial carbon fiber T-300. The XRD results were consistent with the Raman data.

XRD and Raman analyses of carbonized nanofibers indicate significant changes in the structure of CNFs as a result of small addition of DWNT. A comparison with the results from the as-spun polymer nanofibers suggests that the oriented polymer chains in the extensive amorphous PAN phase most likely were internally constrained via strong interaction with the DWNT bundles. These polymer chains were originally oriented by the strong extensional forces in the electrospun jets as well as by interacting with well-oriented DWNTs. However, if unconstrained, these chains would quickly lose their orientation via entropic shrinkage upon heating, resulting in poor graphitic structure. Such shrinkage is normally prevented during carbon fiber manufacture by applying external stretch during stabilization and carbonization. As no such stretch was applied to the nanofibers in the case studied, the observed significant improvement of graphitic structure in the templated CNFs serves as an indicator of an internal constraint in the templated system. Such a constraint could be provided by anchoring polymer chains on the axially oriented surface of nanoparticles. The analysis showed a reduced polymer shrinkage and nanotube-promoted formation of condensed aromatic ladder structure during stabilization of nanotube-containing PAN fiber. Note that both Raman analysis and XRD are not localized and produce average information for nanofiber mats containing a quantity of nanofilaments.

Figure 16A:
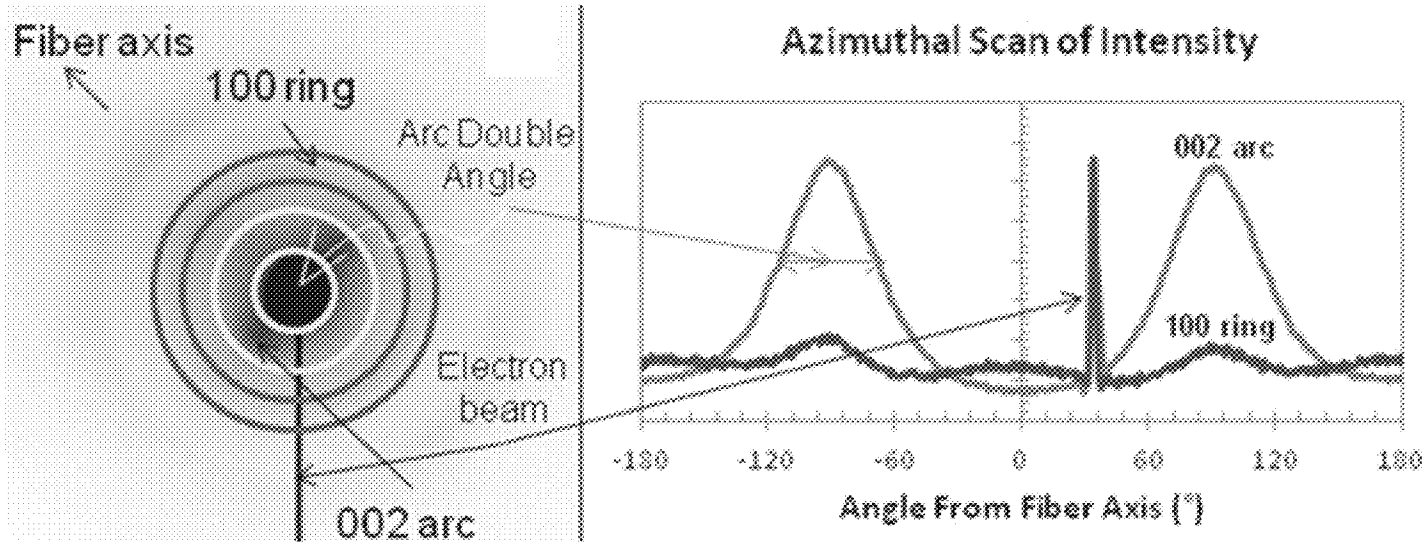
FIG. 16A illustrates electron diffraction analysis of carbon nanofibers with (i) a 2D Selected Area Electron Diffraction (SAED) scan and (ii) azimuthal variations of scattering intensities for the 002 arc and 100 ring.
Figure 16B:
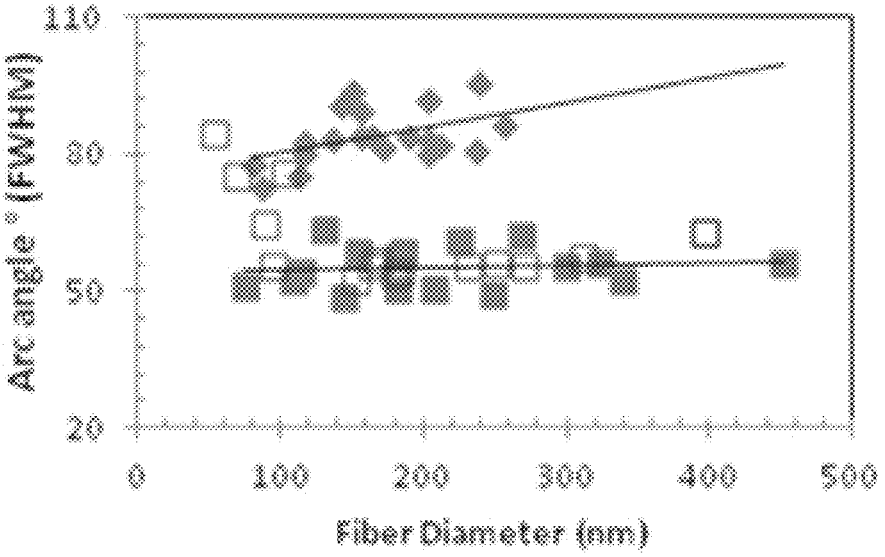
FIG. 16B illustrates variations of 002 arc double angles with nanofiber diameter for carbonized pristine PAN, 1.2% DWNT sample from the areas with and without visible nanotube bundles.
Figure 16C:
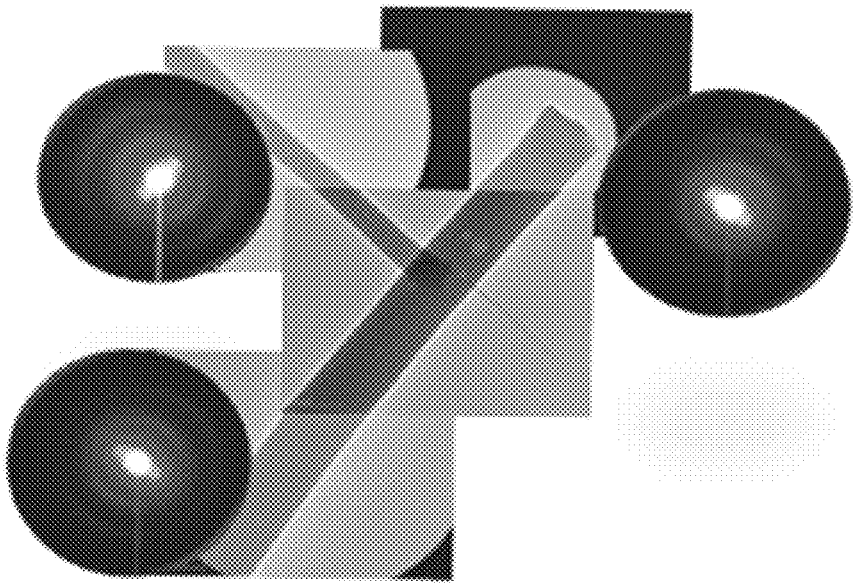
FIG. 16C illustrates a TEM micrograph and SAED diffraction patterns from carbonized DWNT/PAN nanofiber in the areas with and without visible DWNT.

In one example, pristine PAN and 1.2% DWNT nanofibers carbonized at 800° C. were examined in a TEM and their graphitic crystal orientation was evaluated based on electron diffraction. A typical 2D SAED spectrum is shown in FIG. 16A with corresponding azimuthal intensity variations. A preferred orientation of the 002 planes along the nanofiber axis is clearly visible. The degree of this orientation as expressed by the 002 arc double angle was computed and plotted for the two samples as a function of nanofiber diameter (see FIG. 16B). FIG. 16B shows that variations of 002 arc double angles with nanofiber diameter for carbonized pristine PAN (diamonds) and 1.2% DWNT sample from the areas with (filled squares) and without (empty squares) visible nanotube bundles. Scale bars are 200 nm. In the case of 1.2% DWNT templated CNFs, graphitic crystal orientation was examined both near the broken ends of the nanofibers with visible protruding nanotube bundles and in the areas of nanofibers where there were no visible nanotubes (as shown in FIG. 16C)

As shown in the previous figures, there is a significant systematic improvement in graphitic crystal orientation in the DWNT-templated sample compared to the pristine CNFs. The orientation remained relatively constant irrespective of the nanofiber diameter for the templated sample, as opposed to the observed gradual improvement in crystal orientation with the reduction of diameter of pristine CNFs.

In some implementations, graphitic orientation is directly linked to carbon fiber modulus and conductivity. As mentioned above, a degree of orientation is generally correlated to the strength of carbon fibers. Orientation in carbon fibers is achieved by creating and maintaining polymer chain orientation throughout the stabilization and carbonization process. Analysis of FIG. 16B indicates that polymer chain orientation in pristine NFs increased as their diameter decreased. This is consistent with the extensive relevant data in the literature and our own analysis of numerous polymer nanofibers. Comparison with the behavior of the templated CNFs (FIG. 4B) shows that the DWNTs further significantly increased initial polymer chain orientation (indicated by the dramatically improved graphitic orientation) and also made it less dependent on nanofiber diameter. The latter finding has a potential to relax the small diameter requirement for the high CNF properties that can have important manufacturing implications, as it is easier to produce larger diameter nanofibers uniformly.

In some implementations, the polymer chain orientation in the templated nanofibers translated into an improved carbon orientation without external stretch during CNF stabilization and carbonization. As mentioned earlier, the latter is considered paramount in commercial carbon fiber manufacturing. Its function is to freeze polymer orientation and prevent entropic shrinkage and loss of orientation in the disordered polymer regions. Analysis of the SAED data provides additional argumentation for the hypothesis that, in the templated system, an internal constraint created by anchoring of polymer chains on the surface of oriented DWNTs has replicated, at least in part, the effect of external stretch. In some implementations, CNF manufacturing processes can be adapted to relax or alternatively, eliminate a stretch requirement during CNFs processing. The latter will be especially beneficial for the cases when stretch is difficult or impossible to apply. Examples of such cases include random or multidirectional layered nanofiber systems and various 3D CNF architectures created by integrated single-step nanomanufacturing processes.

Analysis of graphitic plane orientation data from templated CNFs (FIG. 16B—see filled and empty squares) indicates that the DWNT templating effect was global, at least down to the nanofiber diameters of approximately 100 nanometers. This may be the result of axial propagation of the templated graphitic growth nucleated by DWNTs or simply the consequence of good DWNT length coverage and the fact that most CNF cross-sections contained one or several DWNT bundles. As shown in FIG. 12F, the length coverage index, LC, reduces with the decrease of CNF diameters. Local absence of nanotube can be the reason for several high data points in FIG. 16B for the ultrafine CNFs from the areas without visible DWNTs (an indirect indication of the link between the observed templating extent and DWNT length coverage). It is worth noting, however, that the length coverage can be easily optimized by controlling DWNT concentration and/or bundle diameter. We point out that excellent solution dispersability of DWNT in PAN/DMF and good resulting distribution of DWNTs in the electrospun nanofibers may be at least partially due to the beneficial organic sizing of the DWNTs produced by the floating catalyst CVD method.

Overall, the combination of XRD, Raman, and SAED analyses indicate large and global graphitic templating in the electrospun continuous CNFs with small concentration of DWNT.

Figure 17A:
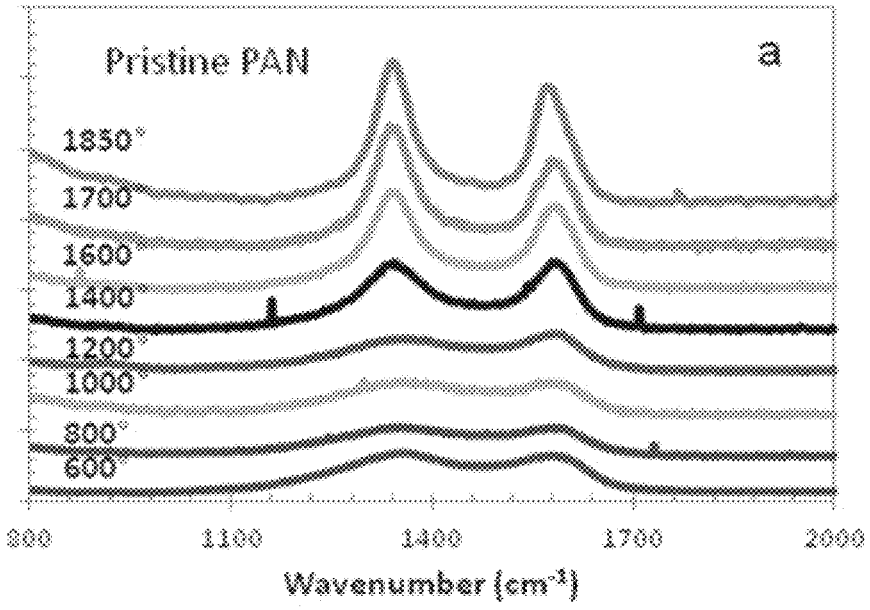
FIGS. 17A-D illustrate analysis of the effect of carbonization temperature.
Figure 17B:
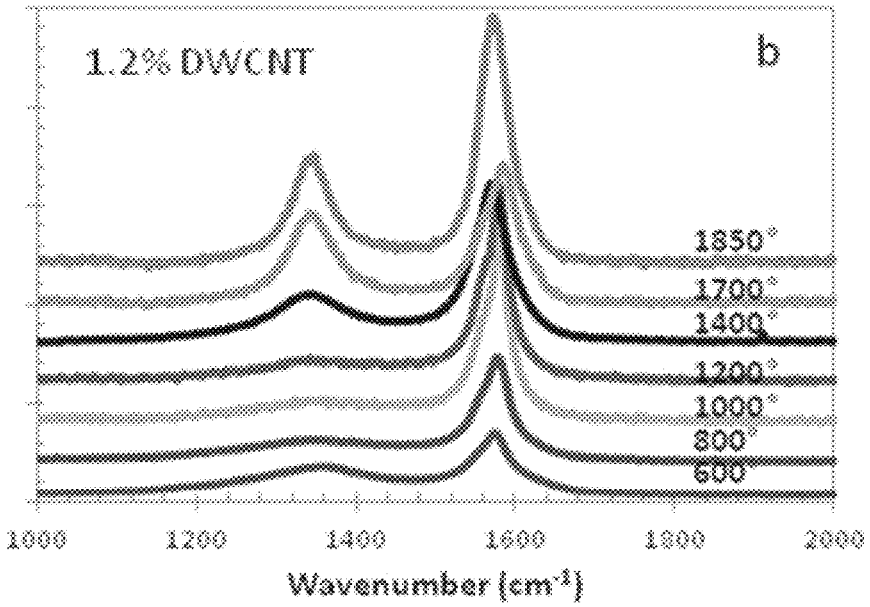
Figure 17C:
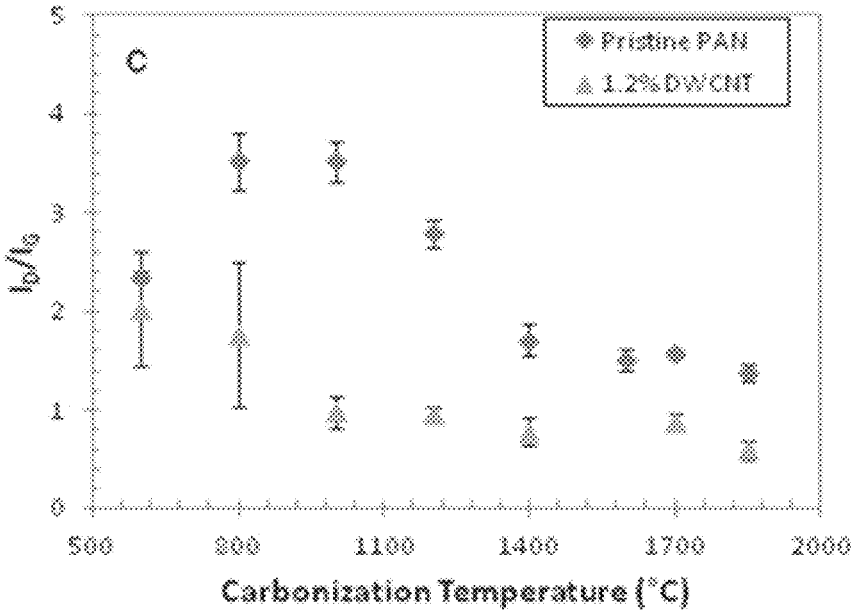
Figure 17D:
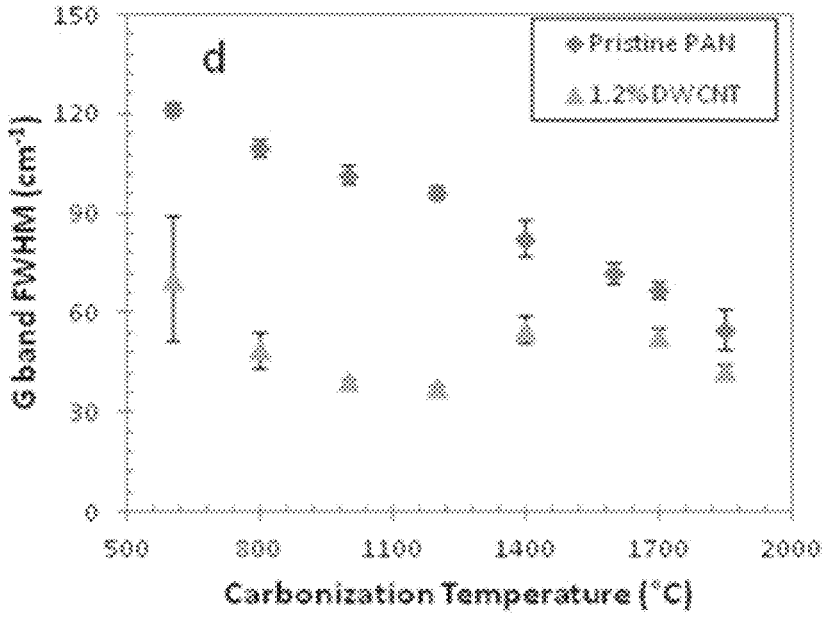

The following FIGS. 17A-D show the effect of carbonization temperature. In particular, FIG. 17A illustrates the Raman spectra of the carbonized pristine PAN sample for different carbonization temperatures; FIG. 17B illustrates the Raman spectra of the carbonized 1.2% DWNT sample for different carbonization temperatures; FIG. 17C illustrates an ID/IG ratio as a function of carbonization temperature for both samples, where the ratio is inversely proportional to in-plane graphitic crystal size La; FIG. 17D illustrates an FWHM of G band as a function of carbonization temperature for both samples. Smaller band width indicates better graphitic structure.

The Raman spectra for CNFs carbonized at different temperatures were collected and analyzed. The results are presented in FIGS. 17A-B. AS shown, the 1.2% DWNT samples exhibited better graphitic structure (as indicated by significantly reduced ID/IG ratio and G band width) for all carbonization temperatures. As expected, the graphitic structure of CNFs improved with the increase of carbonization temperature for both pristine and templated CNFs. However, it is seen that the improvement was significantly accelerated by the presence of DWNTs. Analysis of temperature variations of the extracted structural order parameters, (FIGS. 17C-D), shows that the largest templating effect was achieved at lower carbonization temperatures. The templating effect reaches the maximum at around 1000° C. The level of graphitic order achieved in the templated system carbonized at 1000° C. is comparable to or better than the order in the pristine system carbonized at 1850° C.

Increase of carbonization temperature is a common method of improving graphitic structure of carbon materials and fibers. It has been successfully used to improve graphitic structure of CNFs by graphitizing them at temperatures up to 3000° C. However, high temperature graphitization is expensive. One of the main advantages of PAN-based carbon fibers is that their structure and graphitic order can be controlled by applying stretch at much lower temperatures, eliminating the need for high temperature post-treatment. Further reduction of carbonization temperature is always desirable and will further reduce the cost of carbon fiber production. Our overall data indicates that DWNT templating may simultaneously relax the stretch requirement and provide significant structural improvements at lower carbonization temperatures. Better graphitic structure and orientation are likely to result in better mechanical properties. Coupled with the possibility of achieving better structure in CNFs of larger diameters (based on recorded diameter independence of the orientation in templated CNFs discussed above) and further building on the general low cost of the top-down nanofiber manufacturing by electrospinning, our results open up attractive new route for controlled ultra-low cost nanomanufacturing of high quality CNFs.

In summary, good quality PAN/1.2% DWNT nanofibers were produced from PAN/DWNT solutions by electrospinning. Nanofiber quality and uniformity were significantly better than that of typical nanotube-modified nanofibers reported in the literature (the majority of past reports were using MWNTs). DWNT bundles were found to be present in most CNF cross-sections and were well aligned along the CNF axis. The incorporation of a small amount of DWNT was shown to have a dramatic effect on CNF graphitic structure and orientation. The templating effect was most significant at lower carbonization temperatures, leading to graphitic quality in the templated system carbonized at 1000° C. being on par with the quality of pristine CNFs carbonized at 1850° C. Incorporation of DWNT led to improved graphitic orientation that was, in addition, diameter-independent (in the range of CNF diameters studied). Several experimental indicators show that the templating effects were global.

Overall, the results of this work suggest a new inexpensive route to manufacture continuous nanofibers with improved structure and properties. The low cost is assured by economic top-down nanomanufacturing, lower temperature carbonization, relaxed or eliminated requirements on stretch during nanofiber stabilization and/or carbonization, and possible increase of useable nanofiber diameters.

Example Experiment I

Materials and Fiber Fabrication: PAN fibers were electrospun at ambient conditions from 8-11% wt/wt solution of the polymer (Pfaltz and Bauer, Inc.; cat #P21470, MW 150,000) in DMF (Sigma-Aldrich; cat #271012) using a 20 ga needle. Fibers were collected on a stationary target. The applied voltage was 10-12 KV; the distance between the spinneret and collector was 20 cm. Fiber diameters were varied by varying the voltage and PAN concentration. As-spun and annealed fibers were prepared using similar electrospinning parameters. Annealing was performed at 130° C. in air for 1 hour.

Example Experiment II

DWNTs were produced in a CVD process and partially purified to reduce organic sizing content to 5 wt %. The DWNT length was around 50 μm.

DWNTs were dispersed in dimethylformamide (DMF) using high speed shear mixing at 17500 rpm for 6 hours. PAN polymer (Pfaltz and Bauer, Inc.; cat #P21470, MW 150,000) was then added and fully dissolved to produce a 10% PAN/0.12% DWNT wt/wt dispersion in DMF. The dispersion underwent ultrasonication in an ultrasonic bath for 1.5 hr and the quality of the dispersion was examined in an optical microscope. The above weight ratio resulted in 1.2% weight fraction of DWNT in PAN nanofibers after electrospinning. Note that the DWNT weight fraction in carbonized nanofibers is higher due to the weight loss of PAN during oxidation and carbonization. The exact weight loss is unknown, therefore, for simplicity, both PAN and carbon nanofibers containing DWNT were labeled as 1.2% DWNT nanofibers.

Nanofibers were electrospun at 12 kV using a 0.6 ml/h feed rate and a 20 ga needle. The spinneret-collector distance was 20 cm. Templated polymer and carbon nanofibers were compared with pristine PAN and carbon nanofibers produced under similar conditions (10% wt/wt solution of PAN in DMF). As-spun nanofibers were examined by FE SEM (FEI Quanta 200FEG) and analyzed by wide-angle X-ray diffraction (WAXD) using Rigaku Multiflex X-ray diffractometer with Cu Kα radiation in the range of 2θ between 10 and 50 degrees.

As-spun nanofibers were converted to carbon nanofibers using known protocols 38. Nanofiber mats were stabilized in oxygen atmosphere at 270° C. for 1 hr and carbonized at several carbonization temperatures in different environments. Carbonization at temperatures between 600° C. and 1200° C. was performed in nitrogen; carbonization at 1400° C. and 1600° C. was performed in argon; and carbonization at 1700° C. and 1850° C. was performed in vacuum. All carbonization processes used heating rate 10°/min and dwell time of 1 hour.

Graphitic structure of the carbonized samples was evaluated by Raman spectroscopy using a 514 nanometer laser.

First order Raman spectra (800-2000 $cm^{-1}$) were recorded at a resolution of 1.68 $cm^{-1}$. Each CNF mat was examined in five different locations to produce average values and standard deviations for the G band width and the ID/IG ratios. Fiber mats carbonized at 800° C. were also examined by WAXD. The carbonized nanofibers were examined in a TEM and 002 crystal plane orientations were evaluated using select area electron diffraction (SAED) from azimuthal scans as a function of nanofiber diameter.

A number of implementations have been described. Nevertheless, it will be understood that various modifications may be made without departing from the spirit and scope of the systems, devices, methods and techniques described here. For example, various forms of the flows shown above may be used, with steps re-ordered, added, or removed. It will be appreciated that any appropriate time interval may be used to make the determinations described above, and that the determinations may be made using any appropriate number of data points within the time interval. Accordingly, other implementations are within the scope of the following claims.

What is claimed is:

1. A method of fabricating a continuous nanofiber, the method comprising:

preparing a solution of one or more polymers and one or more solvents;

electrospinning the solution, the electrospinning comprising discharging the solution through one or more liquid jets into an electric field to yield one or more continuous nanofibers, and wherein the electrospinning (i) highly orients one or more polymer chains in the one or more continuous nanofibers along a fiber axis of the one or more continuous nanofibers, and (ii) suppresses polymer crystallization in the one or more continuous nanofibers, the one or more continuous nanofibers having diameters below about 250 nanometers and exhibiting an increase in fiber strength and modulus while maintaining strain at failure, resulting in an increase in fiber toughness;

wherein highly orienting the one or more polymer chains comprises decreasing a diameter of one or more of the continuous nanofibers by introducing, during the electrospinning process, one or more jet instabilities to one or more of the liquid jets using at least one of mechanical or electromagnetic perturbations.

2. The method of claim 1, wherein highly orienting the one or more polymer chains comprises decreasing a diameter of one or more of the continuous nanofibers by introducing, during the electrospinning process, one or more jet instabilities to one or more of the liquid jets using mechanical perturbations.

3. The method of claim 1, wherein highly orienting the one or more polymer chains comprises decreasing a diameter of one or more of the continuous nanofibers by stretching one or more of the continuous nanofibers during or after performing the electrospinning.

4. The method of claim 1, wherein the increase in fiber true strength comprises an increase to about 1750 MPa and the increase in fiber toughness comprises an increase to about 600 MPa.

5. The method of claim 1, wherein suppressing polymer crystallization comprises disrupting formation of one or more intermolecular bonds during the electrospinning process by using one or more solvents interacting with polymer molecules, including in the solution one or more additives, or by altering molecular structure of the polymer using atactic sequences or side groups resulting in suppressing polymer crystallization in the one or more continuous nanofibers.

6. The method of claim 1, further comprising performing a liquid soaking of the one or more continuous nanofibers, the liquid soaking resulting in a disruption of crystallization.

7. The method of claim 1, wherein the polymer is selected from the group consisting of polyacrilonitrile (PAN), flexible chain polymers, rigid chain polymers, semi-flexible chain polymers, liquid crystalline polymers, polyester, polyamide 6, nylon 66, Nomex, semi-crystalline polymers, Polyaramid, Kevlar, PBO, PBI, M5, polyimide, soluble polyimide, thermoplastic or thermoset polymers, precursors for carbon or ceramic fibers, natural biopolymers, proteins, collagen, DNA, silk, recombinant silk, biocompatible synthetic polymers, biodegradable polymers, hybrid biological polymers, and hybrid biological-synthetic polymers.

8. The method of claim 1, wherein the diameter of the one or more continuous nanofibers is about 5 nanometers to about 50 nanometers.

9. The method of claim 1, wherein the one or more continuous nanofibers is adapted to form a sheet, a membrane, a yarn, a fabric, a two dimensional assembly or array, a three dimensional assembly or array, or a coating.

10. The method of claim 1, wherein the diameter of the one or more continuous nanofibers is based at least in part on an applied electric field strength of about 10 kilovolts to about 12 kilovolts over the spinning distance of about 5 centimeters to about 40 centimeters.

11. The method of claim 1, further comprising applying one or more of heat, ultraviolet radiation, or a chemical reagent to the one or more continuous nanofibers resulting in an additional increase in fiber modulus, strength, or toughness for the one or more continuous nanofibers.

12. The method of claim 1, wherein the increase in fiber true strength comprises an increase to about 6500 MPa and the increase in fiber toughness comprises an increase to about 2200 MPa.

13. The method of claim 1, wherein the increase in fiber true strength comprises an increase to about 12500 MPa and the increase in fiber toughness comprises an increase to about 2500 MPa.

14. The method of claim 1, comprising applying ultraviolet radiation to the one or more continuous nanofibers resulting in an additional increase in fiber modulus, strength, or toughness for the one or more continuous nanofibers.

15. The method of claim 1, comprising applying a chemical reagent to the one or more continuous nanofibers resulting in an additional increase in fiber modulus, strength, or toughness for the one or more continuous nanofibers.

* * * * *